US011022265B2

(12) United States Patent
Suetsugu et al.

(10) Patent No.: US 11,022,265 B2
(45) Date of Patent: Jun. 1, 2021

(54) VEHICULAR HEADLIGHT

(71) Applicant: KOITO MANUFACTURING CO., LTD., Tokyo (JP)

(72) Inventors: Makiko Suetsugu, Shizuoka (JP); Hiroki Kawai, Shizuoka (JP); Akira Hanada, Shizuoka (JP); Kenichi Takada, Shizuoka (JP); Yuusuke Mochiduki, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/980,734

(22) PCT Filed: Mar. 13, 2019

(86) PCT No.: PCT/JP2019/010360
§ 371 (c)(1),
(2) Date: Sep. 14, 2020

(87) PCT Pub. No.: WO2019/177050
PCT Pub. Date: Sep. 19, 2019

(65) Prior Publication Data

US 2021/0010651 A1 Jan. 14, 2021

(30) Foreign Application Priority Data

Mar. 15, 2018 (JP) ..... JP2018-048610
Mar. 15, 2018 (JP) ..... JP2018-048611
Mar. 15, 2018 (JP) ..... JP2018-048617

(51) Int. Cl.
*F21S 8/00* (2006.01)
*B60Q 1/04* (2006.01)
(Continued)

(52) U.S. Cl.
CPC ..... *F21S 41/147* (2018.01); *F21S 41/151* (2018.01); *F21S 41/255* (2018.01); *F21S 41/275* (2018.01); *F21S 41/40* (2018.01); *F21Y 2115/10* (2016.08)

(58) Field of Classification Search
CPC ..... F21S 41/147; F21S 41/40; F21S 41/275; F21S 41/255; F21S 41/43
See application file for complete search history.

(56) References Cited

U.S. PATENT DOCUMENTS

2007/0230204 A1 10/2007 Tatsukawa
2010/0226142 A1 9/2010 Brendle et al.
(Continued)

FOREIGN PATENT DOCUMENTS

JP 2007-265864 A 10/2007
JP 2007265864 A * 10/2007 ..... F21S 41/275
(Continued)

OTHER PUBLICATIONS

International Search Report for PCT/JP2019/010360, dated May 28, 2019.

*Primary Examiner* — Karabi Guharay
(74) *Attorney, Agent, or Firm* — Sughrue Mion, PLLC

(57) ABSTRACT

A vehicular headlight includes: a first light emitting element (55) that emits a first light (L1); a second light emitting element (63) that emits a second light (L2); a shade (43); and a projection lens (20), in which an upper surface of the shade (43) has a first reflection surface (43*a*) that reflects another part of the first light (L1) to the projection lens (20) side, and a lower surface of the shade has a second reflection surface (43*b*) that reflects another part of the second light (L2) to the projection lens (20) side, and a front end (43*c*) of the shade (43) has a step (43*cs*) in an up and down direction corresponding to a shape of a cut line of a light distribution pattern of the low beam.

6 Claims, 27 Drawing Sheets

(51) Int. Cl.

| | |
|---|---|
| ***F21S 41/147*** | (2018.01) |
| ***F21S 41/275*** | (2018.01) |
| ***F21S 41/255*** | (2018.01) |
| ***F21S 41/40*** | (2018.01) |
| ***F21S 41/151*** | (2018.01) |
| *F21Y 115/10* | (2016.01) |

(56) References Cited

U.S. PATENT DOCUMENTS

| | | | |
|---|---|---|---|
| 2017/0184268 | A1 | 6/2017 | Kanayama et al. |
| 2017/0276310 | A1 | 9/2017 | Nakazawa et al. |
| 2018/0363874 | A1 | 12/2018 | Kawai et al. |

FOREIGN PATENT DOCUMENTS

| | | | | |
|---|---|---|---|---|
| JP | 2014-229441 | A | | 12/2014 |
| JP | 2015-005339 | A | | 1/2015 |
| JP | 2016-039020 | A | | 3/2016 |
| JP | 2016-213023 | A | | 12/2016 |
| JP | 2017-120745 | A | | 7/2017 |
| JP | 2017-174737 | A | | 9/2017 |
| JP | 2018-018590 | A | | 2/2018 |
| JP | 2018018590 | A | * | 2/2018 |
| JP | 2018-098105 | A | | 6/2018 |
| WO | 2017/104678 | A1 | | 6/2017 |

* cited by examiner

VEHICULAR HEADLIGHT

CROSS REFERENCE TO RELATED APPLICATIONS

This application is a National Stage of International Application No. PCT/JP2019/010360 filed Mar. 13, 2019, claiming priority based on Japanese Patent Application No. 2018-048610 filed Mar. 15, 2018, Japanese Patent Application No. 2018-048611 filed Mar. 15, 2018 and Japanese Patent Application No. 2018-048617 filed Mar. 15, 2018.

TECHNICAL FIELD

The present invention relates to a vehicular headlight.

BACKGROUND ART

As a vehicular headlight represented by an automobile headlight, there is known a vehicular headlight equipped with a light source for a low beam that illuminates the front at night and, in addition, a light source for a high beam that illuminates a distance farther than the low beam. The light from the light source for the high beam includes light emitted above the low beam. Furthermore, a vehicular headlight in which these light sources are provided in one lamp unit is known.

For example, Patent Literature 1 below discloses a vehicular lamp including: a first light source that emits light upward; a first reflector that is arranged so as to cover the first light source from above; a second light source that is arranged below the first light source and emits light downward; and a second reflector that is arranged so as to cover the second light source from below.

[Patent Literature 1] JP 2014-229441 A

SUMMARY OF INVENTION

A vehicular headlight according to a first aspect of the present invention includes: a first light emitting element that emits a first light serving as a low beam, and has an emission surface of the first light whose normal line is directed obliquely downward to the front; a second light emitting element that is arranged below the first light emitting element, emits a second light, and has an emission surface of the second light whose normal line is directed obliquely upward to the front; a shade that extends forward from between the first light emitting element and the second light emitting element; and a projection lens that is arranged forward from the shade, and through which part of the first light and part of the second light directly pass, in which an upper surface of the shade has a first reflection surface that reflects another part of the first light so that the another part of the first light passes through the projection lens, a lower surface of the shade has a second reflection surface that reflects another part of the second light so that the another part of the second light passes through the projection lens, and a front end of the shade has a step in an up and down direction corresponding to a shape of a cut line of a light distribution pattern of the low beam.

In the vehicular headlight according to the first aspect, the part of the first light and the part of the second light directly pass through the projection lens. That is, the part of the first light and the part of the second light are incident on the projection lens without being reflected, and pass through the projection lens. As described above, since it is premised that the part of the first light and the part of the second light are directly incident on the projection lens, the vehicular headlight described above does not require a large reflector such as one disclosed in Patent Literature 1 described above. Furthermore, the another part of the first light is reflected by the first reflection surface of the shade arranged below the first light emitting element and incident on the projection lens, and the another part of the second light is reflected by the second reflection surface of the shade arranged above the second light emitting element and incident on the projection lens. Therefore, the first light and the second light can be effectively used. Moreover, in the vehicular headlight described above, the cut line of the light distribution pattern of the low beam is formed by the front end of the shade. As described above, in the vehicular headlight described above, the first light and the second light are efficiently incident on the projection lens even if a large reflector is not used, and a cut line of light distribution of a low beam is formed. Accordingly, upsizing of the vehicular headlight described above can be suppressed.

Furthermore, in the vehicular headlight according to the first aspect, it is preferable that a plurality of the first light emitting element are provided in parallel in a right and left direction, and the plurality of first light emitting elements arranged in one side of the right and left direction with reference to a specific one of the first light emitting elements, and a plurality of the first light emitting elements arranged in another side have different heights at which they are provided.

When the low beam is applied to a vertical surface, the cut lines of the light distribution pattern of the low beam have different heights in one side and another side in the right and left direction with reference to a specific position. Accordingly, it is preferable that front ends of the shade forming the cut line have different heights in one side and another side in the right and left direction with reference to the specific position. Here, by arranging the plurality of first light emitting elements in different stages as described above, it becomes easy to match the position of the emission surface of each first light emitting element with the height of the front end of the shade. Therefore, the first light emitted from each first light emitting element easily reaches near a front end of the shade forming the cut line of the light distribution pattern of the low beam, and the luminous intensity near the cut line in the light distribution pattern of the low beam may be increased.

Furthermore, in the vehicular headlight according to the first aspect, it is preferable that an average interval between the specific first light emitting element and a pair of first light emitting elements arranged to sandwich the specific first light emitting element is narrower than an average interval of another plurality of first light emitting elements adjacent to each other.

By adjusting the average interval of the plurality of first light emitting elements as described above, the average interval of the plurality of first light emitting elements arranged adjacent to each other in the vicinity of the center in the right and left direction may be made narrower than the average interval of the plurality of first light emitting elements arranged adjacent to each other in both end sides in the right and left direction. Therefore, as compared with the case where the same number of first light emitting elements are arranged at equal intervals, the light distribution pattern of the low beam may spread in the right and left direction and the vicinity of the center of the light distribution pattern of the low beam may become bright.

Furthermore, in the vehicular headlight according to the first aspect, it is preferable that, in a front view, the specific first light emitting element and the step of the front end of the shade overlap with each other in the up and down direction, a plurality of the first light emitting element arranged in one side of the right and left direction with reference to the specific first light emitting element is provided at a position lower than a plurality of the first light emitting element arranged in another side, and one side of the right and left direction of the front end of the shade is formed lower than another side with reference to the step.

By arranging the plurality of first light emitting elements and forming the front end of the shade as described above, the plurality of first light emitting elements may be arranged along the shape of the front end of the shade. Therefore, the first light emitted from each first light emitting element more easily reaches near a front end of the shade forming the cut line of the light distribution pattern of the low beam, and the luminous intensity near the cut line in the light distribution pattern of the low beam may be increased more.

Furthermore, in the vehicular headlight according to the first aspect, it is preferable that a rear end of the first reflection surface has a step corresponding to the shape of the cut line of the light distribution pattern of the low beam.

Since the front end of the shade and the rear end of the first reflection surface on the upper surface of the shade each have a step corresponding to the shape of the cut line of the light distribution of the low beam, the first light may more easily reach near the front end of the shade. Therefore, in the low beam light distribution pattern, the luminous intensity near the cut line may be increased.

Furthermore, in the vehicular headlight according to the first aspect, it is preferable that, in a front view, the step of the front end of the shade and the step of the rear end of the first reflection surface overlap each other in the up and down direction.

By forming the shade as described above, the first light may more easily reach the vicinity of the front end of the shade. Therefore, in the low beam light distribution pattern, the luminous intensity near the cut line may be increased.

As described above, according to the first aspect of the present invention, there is provided a vehicular headlight that can be prevented from being upsized.

Furthermore, a vehicular headlight according to a second aspect of the present invention includes: a first light emitting element that has an emission surface whose normal line is directed obliquely downward to the front, and emits a first light serving as a low beam; a second light emitting element that is arranged below the first light emitting element, has an emission surface whose normal line is directed obliquely upward to the front, and emits a second light serving as a high beam; a shade that is arranged between the first light emitting element and the second light emitting element in the up and down direction; and a projection lens that is arranged forward from the shade, and through which part of the first light and part of the second light directly pass, in which a focus of the projection lens is located between the projection lens and the front end of the shade, and the second light emitting element is arranged at a position closer to the focus of the projection lens than the first light emitting element.

In the vehicular headlight according to the second aspect, the part of the first light and the part of the second light directly pass through the projection lens. That is, the part of the first light and the part of the second light are incident on the projection lens without being reflected, and pass through the projection lens. As described above, since the first light emitting element and the second light emitting element are arranged such that the part of the first light and the part of the second light are directly incident on the projection lens, the vehicular headlight described above does not require a large reflector such as one disclosed in Patent Literature 1 described above. Therefore, upsizing of the vehicular headlight described above can be suppressed.

Furthermore, in the vehicular headlight according to the second aspect described above, the second light emitting element is arranged closer to the focus of the projection lens than the first light emitting element. That is, the second light emitting element is arranged at a position closer to the focus of the projection lens than the first light emitting element in at least one side of the front and rear direction or the up and down direction. Therefore, at the focus of the projection lens, the luminous intensity of the second light serving as the high beam may be easily increased more than the luminous intensity of the first light serving as the low beam. Therefore, in the vehicular headlight described above, the maximum luminous intensity of the high beam emitted through the projection lens and emitted forward may be increased more than the maximum luminous intensity of the low beam. On the other hand, by arranging the first light emitting element at a position farther from the focus of the projection lens than the second light emitting element, in the focal surface of the projection lens, the irradiation range of the first light may be more easily widened than the irradiation range of the second light. Therefore, in the vehicular headlight described above, the irradiation range of the low beam may be wider than the irradiation range of the high beam.

Furthermore, in the vehicular headlight according to the second aspect described above, it is preferable that the second light emitting element is arranged such that, in front of the first light emitting element, the normal line of the emission surface of the second light emitting element is closer to the vertical than the normal line of the emission surface of the first light emitting element.

By arranging the second light emitting element in front of the first light emitting element, it is easier to bring the second light emitting element closer to the focus of the projection lens than the first light emitting element. Here, when the angle formed by the normal line of the emission surface of the second light emitting element and the vertical surface and the angle formed by the normal line of the emission surface of the first light emitting element and the vertical surface are approximately the same, either one of the first light and the second light is difficult to pass near the focus of the projection lens. By arranging the second light emitting element such that the normal line of the emission surface of the second light emitting element is closer to the vertical than the normal line of the emission surface of the first light emitting element, the first light emitting element and the second light emitting element may be arranged such that both the second light and the first light pass near the focus of the projection lens. Therefore, in the vehicular headlight described above, the luminous intensity of the low beam and the high beam may be increased.

Furthermore, in the vehicular headlight according to the second aspect described above, it is preferable that the another part of the first light is applied to the upper surface of the shade, and the upper surface of the shade has a first reflection surface that reflects the another part of the first light toward the focus of the projection lens.

By reflecting the another part of the first light as described above, the first light is collected at the focus of the projection lens, and the luminous intensity of the low beam may be increased more.

Furthermore, in the vehicular headlight according to the second aspect described above, it is preferable that the another part of the second light is applied to the lower surface of the shade, and the lower surface of the shade has a second reflection surface that reflects the another part of the second light toward the focus of the projection lens.

By reflecting the another part of the second light as described above, the second light is collected at the focus of the projection lens, and the luminous intensity of the high beam may be increased more.

Furthermore, in the vehicular headlight according to the second aspect, it is preferable that a plurality of the second light emitting elements are provided in parallel in the right and left direction, and an average interval of the second light emitting elements arranged in the central portion in the right and left direction is narrower than an average interval of the second light emitting elements arranged at least at one end in the right and left direction.

By adjusting the average interval of the plurality of second light emitting elements as described above, the maximum luminous intensity near the center of the high beam may be increased as compared with the case where the same number of second light emitting elements are arranged at equal intervals.

As described above, according to the second aspect of the present invention, there is provided a vehicular headlight that can be prevented from being upsized.

Furthermore, a vehicular headlight according to a third aspect of the present invention includes: a first light emitting element that emits a first light serving as a low beam; a second light emitting element that is arranged below the first light emitting element, and emits a second light serving as a high beam; a shade that is arranged between the first light emitting element and the second light emitting element in the up and down direction, and shields part of the first light; and a projection lens that is arranged in front of the shade, and which another part of the first light and part of the second light are directly incident on and passes through, in which a front surface or a back surface of the projection lens has a plurality of first regions in which no unevenness is formed, a region sandwiching each of the first regions is an uneven region in which an unevenness is formed, and an average surface roughness of the uneven region sandwiched by the plurality of first regions and an average surface roughness of the uneven region that is not sandwiched by the plurality of first regions are different from each other.

In the vehicular headlight according to the third aspect, the part of the first light and the part of the second light directly pass through the projection lens. That is, the part of the first light and the part of the second light are incident on the projection lens without being reflected, and pass through the projection lens. As described above, since the first light emitting element and the second light emitting element are arranged such that the part of the first light and the part of the second light are directly incident on the projection lens, the vehicular headlight described above does not require a large reflector such as one disclosed in Patent Literature 1 described above. Therefore, upsizing of the vehicular headlight described above can be suppressed.

By the way, as described above, when the light distribution pattern is formed by using the two light sources arranged in the up and down direction through the shade, part of the light is shielded by the shade to form a dark portion in the light distribution pattern, in some cases. Here, if light emitted from the projection lens is diffused by forming a plurality of uneven portions on the entire front surface or back surface of the projection lens, the boundary between the light distribution pattern formed by the first light and the light distribution pattern formed by the second light is unclear. Accordingly, it is possible to suppress the formation of the dark portion in the light distribution pattern formed by the first light and the second light. However, in this case, the cut line of the low beam tends to become unclear when the first light is diffused. As described above, there is a trade-off relationship between the clarification of the cut line of the low beam by the first light and the suppression of the dark portion in the light distribution pattern by the first light and the second light. The projection lens of the vehicular headlight has a plurality of first region in which no unevenness is formed and a plurality of uneven regions in which an unevenness is formed. Diffusion of the first light transmitted through the first region is suppressed, which may contribute to clarifying the cut line of the low beam. On the other hand, the light transmitted through the uneven region can be diffused and obscure the boundary between the first light distribution pattern and the second light distribution pattern to suppress the formation of the dark portion. Therefore, the vehicular headlight described above can suppress the formation of the dark portion in the light distribution pattern while clarifying the cut line of the low beam. As described above, the vehicular headlight described above may suppress the formation of the dark portion in the light distribution pattern while suppressing the increase in size.

Furthermore, when no unevenness is formed in the entire front and back surfaces of the projection lens, in addition to the dark portion as described above, brightness irregularity by the light directly incident on the projection lens from the light source and the light reflected by other members and incident on the projection lens tends to be noticeable. Furthermore, when a plurality of light sources are provided, brightness irregularity by the interval between the light sources also tends to be noticeable. The average surface roughness of the uneven region sandwiched by the plurality of first regions and the uneven region not sandwiched by the plurality of first regions are made different, so that it is easy to adjust the degree of blurring of the light emitted from the projection lens by blurring the light passing through the region close to the first region is blurred and projected, and brightness irregularity can be suppressed.

Furthermore, in the vehicular headlight according to the third aspect, it is preferable that the first region is formed in a band shape.

The band shape means a shape having a predetermined width and extending in a direction orthogonal to the width direction, and the extending direction may be linear, wavy, or broken line.

Furthermore, in the vehicular headlight according to the third aspect, it is preferable that, in a front view, the first region or the uneven region sandwiched by the plurality of the first regions is formed at a position where the optical axis of the projection lens passes.

In the vehicular headlight according to the third aspect, the first light emitted from the first light emitting element and the second light emitted from the second light emitting element are incident on the entire projection lens and transmitted therethrough. However, the luminous intensities of the first light and the second light in the projection lens are not constant and tend to increase in the vicinity of the optical axis. By forming the first region or the uneven region sandwiched by the plurality of first regions at a position where the optical axis of the projection lens passes, the first region and the uneven region sandwiched by the plurality of first regions may be formed at a position through which high-luminance light passes. That is, the first region may be formed at a position through which high-luminance light among pieces of light forming the cut line of the low beam easily passes. Accordingly, diffusion of light forming the cut line of the low beam can be further suppressed, and the cut line of the low beam can be made clearer. Furthermore, the uneven region sandwiched by the plurality of first regions may be formed at a position through which high-luminance light among pieces of second light passes. Accordingly, the second light may be diffused more, and it is possible to further suppress the formation of the dark portion in the light distribution pattern by the first light and the second light.

Furthermore, in the vehicular headlight according to the third aspect described above, it is preferable that the average surface roughness of the uneven region sandwiched by the plurality of first regions is larger than the average surface roughness of the uneven region not sandwiched by the plurality of first regions.

In the first region, while the low beam cut line may contribute to more clarification, by clarifying the cut line, the boundary between the light distribution pattern of the first light and the light distribution pattern of the second light may be clarified, which may contribute to the formation of a dark portion in the light distribution pattern by the first light and the second light. By increasing the average surface roughness of the uneven region sandwiched by the plurality of first regions, that is, the uneven region near the plurality of first regions, the second light transmitted through near the plurality of first regions is easily diffused, which may further suppress formation of a dark portion in the light distribution pattern of the first light and the second light.

Furthermore, in the vehicular headlight according to the third aspect, it is preferable that the uneven region has a second region and a third region in which an unevenness smaller than that of the second region is formed.

By forming a region in which the degree of diffusion of light is relatively large and a region in which the degree of diffusion of light is relatively small on the projection lens, the gradation of the brightness of light due to the degree of diffusion of light may be prevented from being conspicuous.

Furthermore, in the vehicular headlight according to the third aspect, it is preferable that, when the uneven region has a second region and a third region in which an unevenness smaller than that of the second region is formed, the second region and the third region are adjacent to each other with the first region interposed therebetween.

Since the second region and the third region are adjacent to each other with the first region interposed therebetween, the gradation of brightness of the light whose diffusion is suppressed by transmitting through the first region and the light diffused by transmitting through the uneven region may be prevented from being conspicuous.

Furthermore, in the vehicular headlight according to the third aspect, it is preferable that the plurality of first regions are formed parallel to a horizontal surface.

By forming the plurality of first regions in parallel with the horizontal surface, the plurality of first regions and the uneven region sandwiched by the plurality of first regions may be formed easily.

Furthermore, in the vehicular headlight according to the third aspect, it is also preferable that the plurality of first regions are formed on a line inclined to the horizontal surface.

When the first region is formed in parallel with the contour of the emission surface of the light source, the difference in brightness with the contours of the emission surface of the light source as a boundary tends to be less likely to be blurred. By the way, an LED chip having a rectangular emission surface is used as a light source of the vehicular headlight in some cases. In a case where such a light source having a rectangular emission surface is used, when the first region is formed on a line inclined to the horizontal surface, in the front view of the projection lens, the extending direction of the first region and the contour of the emission surface of the light source are easy to be made non-parallel to each other. Accordingly, the brightness difference with the contour of the emission surface of the light source as a boundary may be easily blurred.

Furthermore, in the vehicular headlight according to the third aspect, it is preferable that, when the plurality of first regions described above are formed on a line inclined to the horizontal surface, the plurality of first regions described above are formed in a V-shape.

By forming the first region in a V-shape, it may be easier to make the extending direction of the first region and the contour of the emission surface of the light source non-parallel in the front view of the projection lens. Accordingly, the brightness difference with the contour of the emission surface of the light source as a boundary may be more easily blurred.

Furthermore, in the vehicular headlight according to the third aspect, it is preferable that the plurality of first regions are formed left-right symmetrically.

Furthermore, in the vehicular headlight according to the third aspect, it is preferable that the uneven region is formed on a front surface of the projection lens.

When light is diffused on the back surface of the projection lens, that is, the incident surface, the diffused light is refracted and emitted on the front surface of the projection lens, that is, the emission surface. Therefore, the diffusion of light on the front surface of the projection lens may be easier to adjust the degree of diffusion of light than on the back surface of the projection lens.

Furthermore, it is preferable that the vehicular headlight according to the third aspect described above further includes a reflection surface that covers a lower part of the second light emitting element, and reflects another part of the second light so that the another part of the second light is incident on the projection lens.

By making another part of the second light incident on the projection lens, the second light can be effectively used.

Furthermore, in the vehicular headlight according to the third aspect described above, it is preferable that, when a reflection surface that reflects another part of the second light is further provided, the reflection surface reflects the another part of the second light so that the another part of the second light passes through the region other than the first region and the uneven region sandwiched by the plurality of first regions.

As described above, the first region and the uneven region sandwiched by the plurality of first regions may contribute to clarifying the cut line of the low beam and suppressing the formation of a dark portion in the light distribution pattern. Since the another part of the second light transmits through a region other than these regions, clarifying the cut line of the low beam and suppressing the formation of a dark portion in the light distribution pattern due to unintended light may be prevented from being disturbed.

Furthermore, in the vehicular headlight according to the third aspect described above, it is preferable that, when a reflection surface that reflects another part of the second light is further provided, the reflection surface reflects the another part of the second light so that the another part of the second light passes through the region other than the region where the part of the second light directly incident.

The irradiation range of the second light may be widened by causing the another part of the second light to be incident on a region different from the region where the part of the second light is directly incident. For example, when the curvature of the projection lens is controlled so that part of the second light is emitted downward in order to reduce the dark portion of the boundary between the light distribution pattern of the second light and the light distribution pattern of the first light, the light applied to above the light distribution pattern of the second light is weakened in some cases. Here, since the another part of the second light is incident on a region different from the region on which the part of the second light is directly incident, the another part of the second light may be emitted in a different direction from that of the part of the second light. As a result, by emitting the another part of the second light above the part of the second light, it is possible to supplement the light emitted above the light distribution pattern of the second light.

Further, in the vehicular headlight according to the third aspect described above, it is preferable that, when a reflection surface that reflects another part of the second light described above is further provided, the projection lens includes a refraction part that refracts part of the incident light so as to be light for overhead sign, and the reflection surface reflects another part of the second light so as to be incident on a region other than the refraction part.

By suppressing unintended light from being incident on the refraction part for overhead sign, the light for overhead sign may be prevented from being emitted in an unintended direction.

As described above, according to the third aspect of the present invention, it is possible to provide a vehicular headlight that may suppress the formation of the dark portion in the light distribution pattern while suppressing the increase in size.

DESCRIPTION OF EMBODIMENTS

Hereinafter, embodiments for implementing a vehicular headlight according to the present invention will be exemplified with reference to the accompanying drawings. The embodiments exemplified below are for the purpose of facilitating the understanding of the present invention, and are not intended to limit the present invention. The present invention can be modified and improved from the following embodiments without departing from the gist thereof.

First Embodiment

First, a first aspect of the present invention will be described by taking a vehicular headlight according to a first embodiment as an example.

Figure 1:
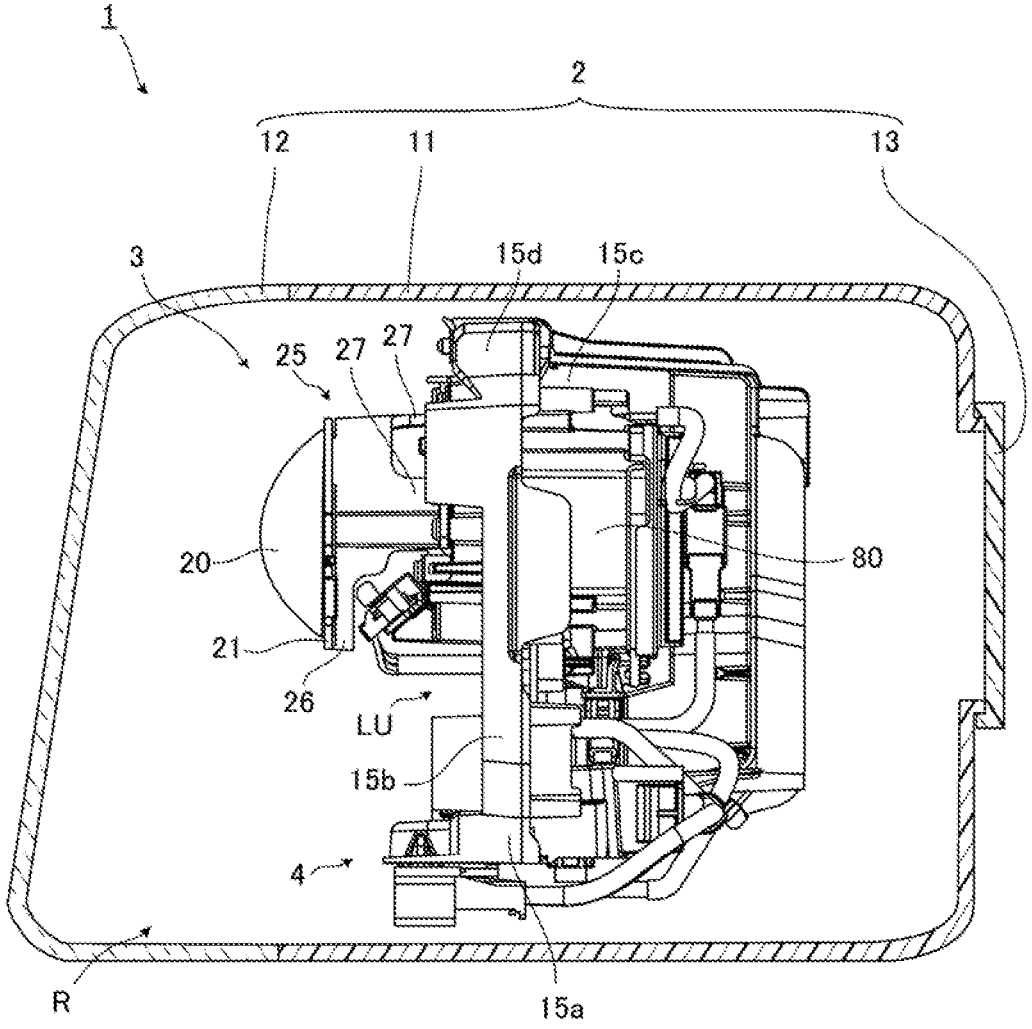
FIG. 1 is a diagram showing a vehicular headlight according to a first embodiment of the present invention.

FIG. 1 is a diagram showing a lamp including a light source unit according to the present embodiment. In the present embodiment, the lamp is a vehicular headlight. A vehicular headlight is generally provided in each sides of the right and left direction in front of the vehicle, and the right and left headlights are configured to be substantially symmetrical in the right and left direction. Accordingly, in the present embodiment, one of the vehicular headlights will be described.

As shown in FIG. 1, a vehicular headlight 1 of the present embodiment mainly includes a housing 2, a lamp unit 3, and a support unit 4. Note that FIG. 1 is a side view of the vehicular headlight 1, and in FIG. 1 the housing 2 is shown in a cross-sectional view for easy understanding.

Next, the housing 2 will be described.

The housing 2 includes a lamp housing 11, a front cover 12, and a back cover 13 as main components. The front of the lamp housing 11 is open, and the front cover 12 having a light transmission property is fixed to the lamp housing 11 so as to close the opening. An opening smaller than that in the front is formed in the rear of the lamp housing 11, and the back cover 13 is fixed to the lamp housing 11 so as to close the opening.

A space formed by the lamp housing 11, the front cover 12 closing the front opening of the lamp housing 11, and a back cover 13 closing the rear opening of the lamp housing 11 is a lamp room R. The lamp unit 3 and the support unit 4 are housed in the lamp room R.

Next, the support unit 4 will be described.

Figure 2:
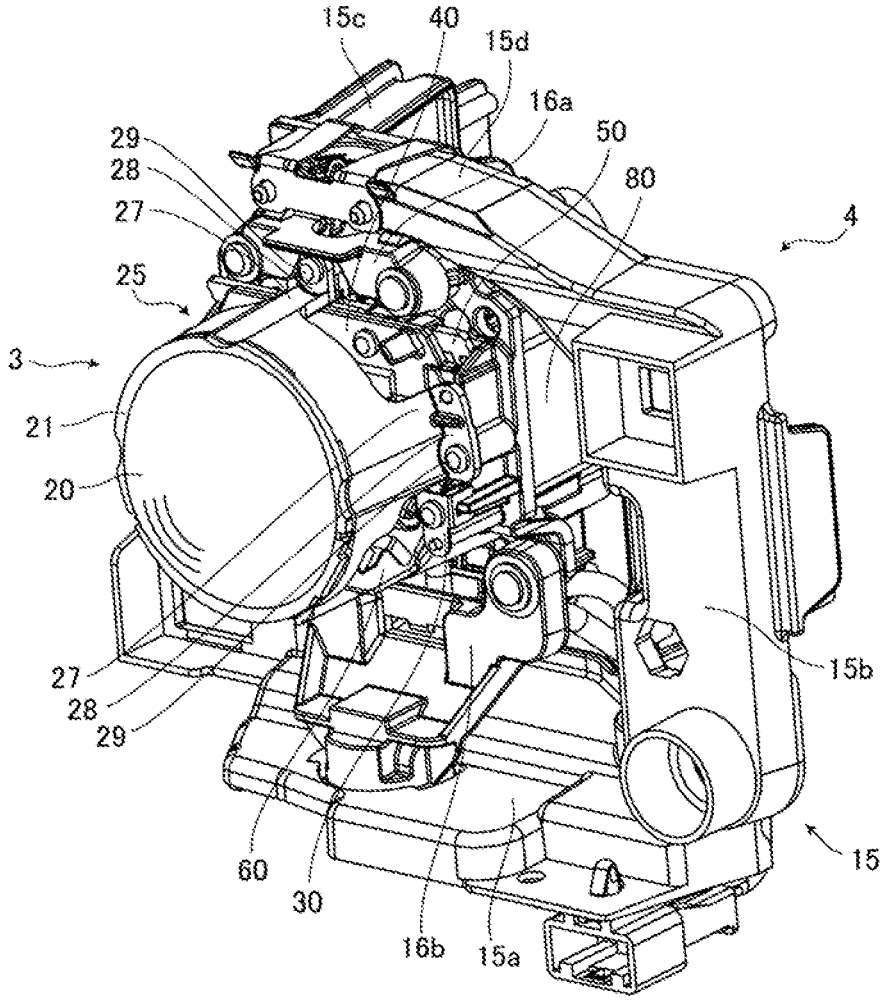
FIG. 2 is a perspective view of a lamp unit and a support unit shown in FIG. 1.

FIG. 2 is a perspective view of a lamp unit and a support unit shown in FIG. 1. As shown in FIGS. 1 and 2, the support unit 4 includes a bracket 15, a first connection arm 16*a*, and a second connection arm 16*b* as main components. The bracket 15 is a frame-shaped body, and includes a base unit 15*a* extending in the right and left direction, pillar units 15*b*, 15*c* extending upward from both right and left end portions of the base unit 15*a*, and a support unit 15*d* extending in the right and left direction, and coupled to the upper end portions of the two pillar units 15*b*, 15*c*. The lamp unit 3 is arranged between the base unit 15*a* and the support unit 15*d*. The upper portion of the lamp unit 3 and the support unit 15*d* of the bracket 15 are coupled by the first connection arm 16*a*, and the lamp unit 3 is suspended from the support unit 15*d* of the bracket 15. Furthermore, the lower portion of the lamp unit 3 and the base unit 15*a* of the bracket 15 are coupled by the second connection arm 16*b*, and the base unit 15*a* side of the second connection arm 16*b* is connected to a drive unit (not shown) attached to the base unit 15*a* via a gear (not shown) or the like. As described above, the lamp unit 3 is attached to the bracket 15 by the first connection arm 16*a* and the second connection arm 16*b*. The lamp unit 3 can be rotated in the right and left direction and inclined to the front and rear direction with respect to the bracket 15 by a drive unit (not shown) attached to the base unit 15*a*. Note that the bracket 15 is fixed to the housing 2 by means not shown.

Next, the lamp unit 3 will be described.

Figure 3:
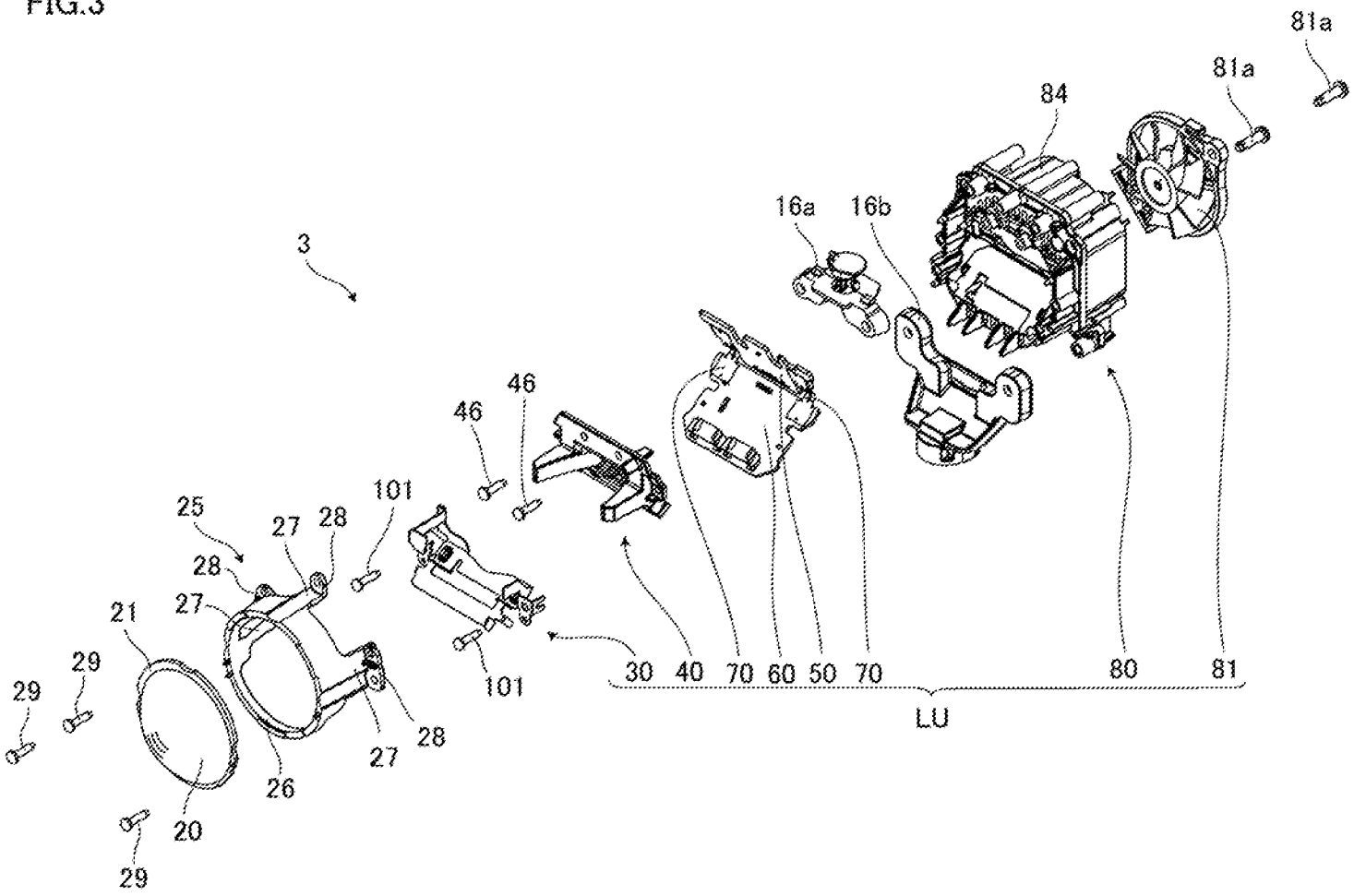
FIG. 3 is an exploded perspective view of the lamp unit shown in FIG. 1 viewed from the front side.
Figure 4:
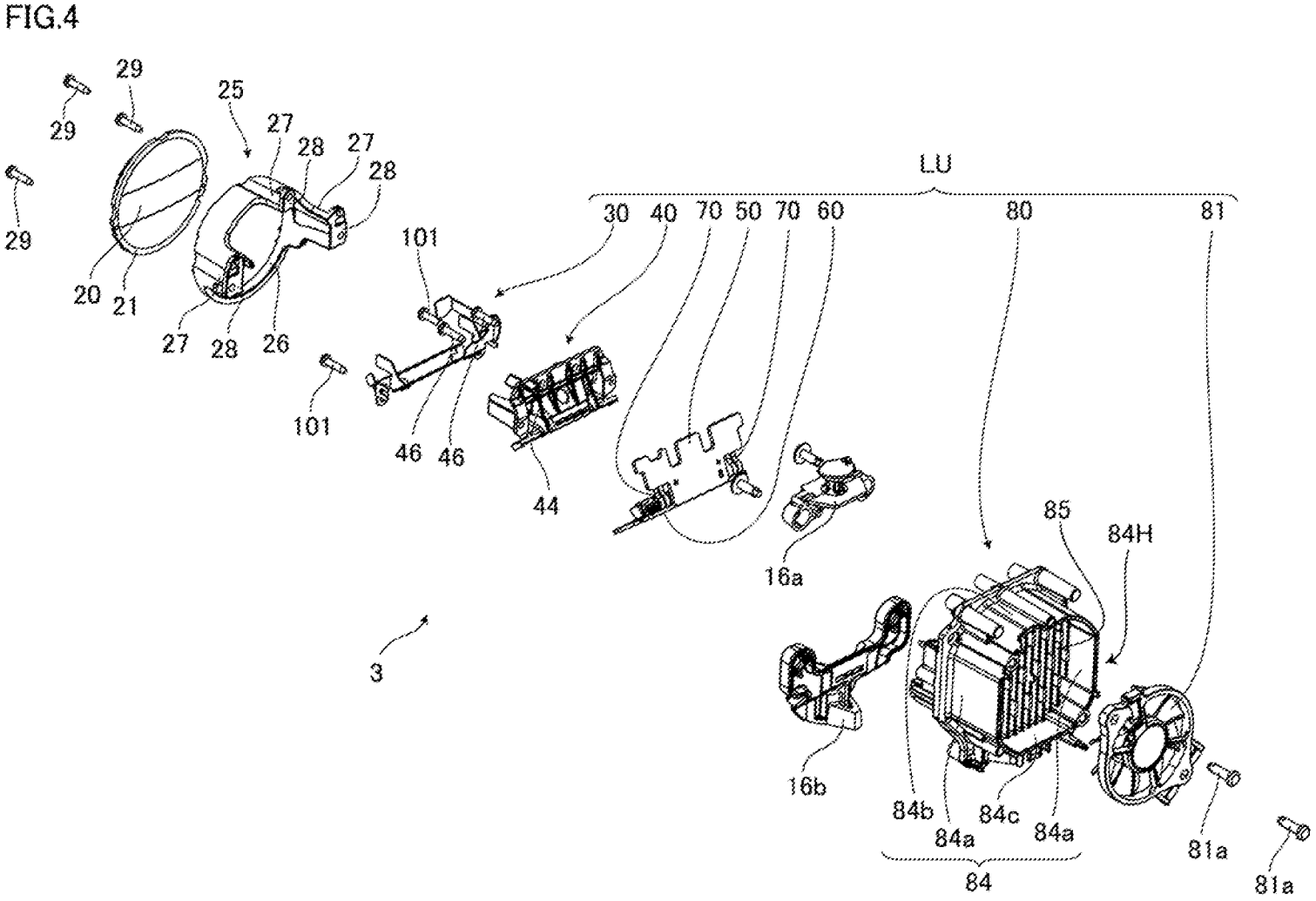
FIG. 4 is an exploded perspective view of the lamp unit shown in FIG. 1 viewed from the rear side.

FIG. 3 is an exploded perspective view of the lamp unit shown in FIG. 1 seen from the front side, and FIG. 4 is an exploded perspective view of the lamp unit shown in FIG. 1 seen from the rear side. Note that, in FIGS. 3 and 4, the first connection arm 16*a* and the second connection arm 16*b* of the support unit 4 are also shown. As shown in FIGS. 3 and 4, the lamp unit 3 according to the present embodiment mainly includes a projection lens 20, a lens holder 25, and a light source unit LU as main components.

Next, the light source unit LU will be described.

As shown in FIGS. 3 and 4, the light source unit LU of the present embodiment includes a support plate 30, a reflector unit 40, a first substrate 50, a second substrate 60, two flexible printed circuit boards 70, a heat sink 80, and a fan 81 as main components.

Next, the heat sink 80 will be described.

Figure 5:
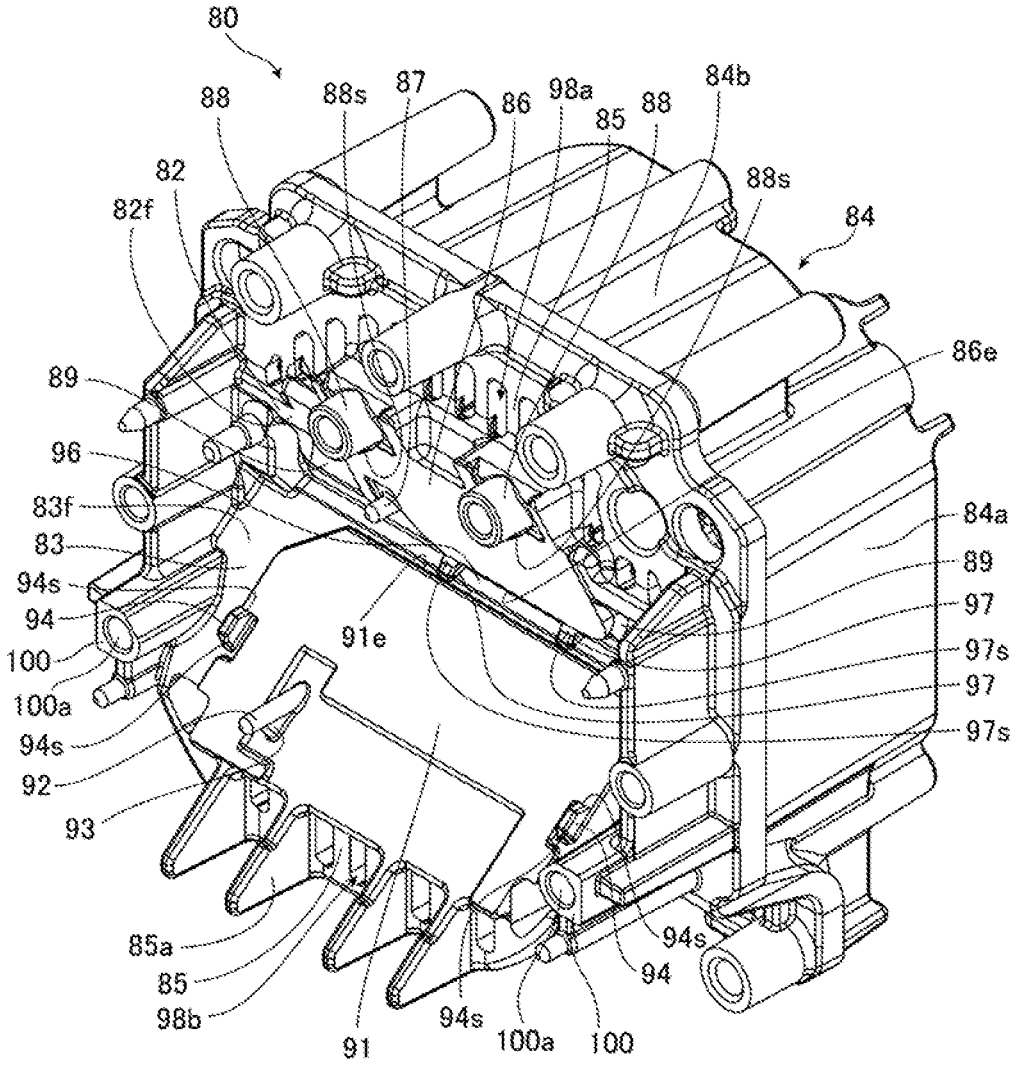
FIG. 5 is a perspective view of a heat sink.
Figure 6:
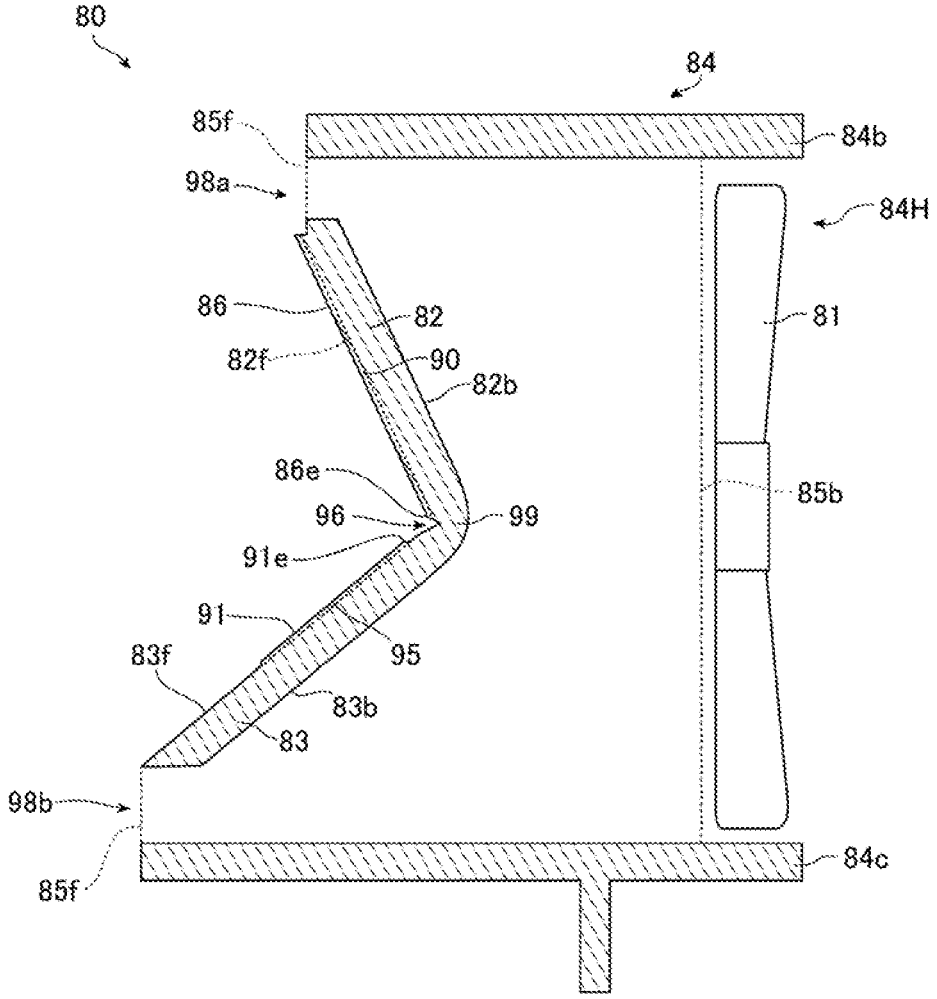
FIG. 6 is a schematic cross-sectional view of the heat sink.

FIG. 5 is a perspective view of the heat sink, and FIG. 6 is a schematic cross-sectional view of the heat sink. Note that a fan 81 is also shown in FIG. 6. As shown in FIGS. 4 to 6, the heat sink 80 is formed of, for example, a metal, and includes a first base plate 82, a second base plate 83, a peripheral wall part 84, and a current plate 85 as main components.

The first base plate 82 is a plate-like body that extends obliquely upward to the front and to the right and left. In the present embodiment, a first placement surface 86, a first ribs 87, a boss 88, and a recess 89 are formed on a front surface 82*f* of the first base plate 82. The first placement surface 86 is a surface on which at least a part of the first substrate 50 is placed, is an end surface of a pedestal 90 projecting forward from the front surface 82*f* of the first base plate 82, and is substantially parallel to the front surface 82*f* of the first base plate 82. Note that "generally parallel" in this specification includes not only a completely parallel state but also a state in which one is inclined with respect to another from the completely parallel state by about 1°. An outer edge 86*e* located at the lower end of the outer edge of the first placement surface 86 extends in the right and left direction.

As shown in FIG. 5, a first rib 87 is formed in a region on the lower side of the front surface 82*f* of the first base plate 82, and the first rib 87 projects forward from the front surface 82*f*. Therefore, the first rib 87 is inclined with respect to the normal line of the first placement surface 86. The first ribs 87 extend from the lower side to the upper side when the first placement surface 86 is viewed in a plan view, and are inclined upward with respect to the first placement surface 86. In the present embodiment, the shape of the cross section of the first rib 87 perpendicular to the longitudinal direction is circular.

Two bosses 88 are formed on the upper side of the first ribs 87 and project forward from the front surface 82*f* of the first base plate 82 in the same manner as the first ribs 87. Therefore, the bosses 88 are each inclined with respect to the normal line of the first placement surface 86. Each boss 88 extends from the lower side to the upper side when the first placement surface 86 is viewed in a plan view, and is inclined upward with respect to the first placement surface 86. On the outer peripheral surface on the lower side of each boss 88, an abutting surface 88*s* that is substantially perpendicular to the first placement surface 86 is formed. Note that "generally perpendicular" in this specification includes not only a completely perpendicular state but also a state in which one is inclined with respect to another from the completely perpendicular state by about 1°. In the present embodiment, the abutting surface 88*s* of each boss 88 is a flat surface that extends to the right and left direction when the first placement surface 86 is viewed in a plan view, and is non-parallel to the up and down direction which is an extending direction of the first ribs 87 when the first placement surface 86 is viewed in a plan view.

Recesses 89 are formed on the right side and the left side from the first placement surface 86, respectively. The recess 89 is a portion where the front surface 82*f* of the first base plate 82 is recessed to the side opposite to the first placement surface 86 side. In the present embodiment, the recess 89 is recessed in an arc shape in the vertical cross section as described later.

The second base plate 83 is a plate-like body that extends obliquely downward to the front and to the right and left. The upper outer edge of the second base plate 83 is connected to the lower outer edge of the first base plate. In the present embodiment, a second placement surface 91, a second rib 92, a rib reinforcing part 93, a projection 94, and two bosses 100 are formed on a front surface 83*f* of the second base plate 83. The second placement surface 91 is a surface on which at least a part of the second substrate 60 is placed, is an end surface of a pedestal 95 projecting forward from the front surface 83*f* of the second base plate 83, and is substantially parallel to the front surface 83*f* of the second base plate 83. Therefore, the normal line extending to the second substrate 60 side of the second placement surface 91 intersects with the normal line extending to the first substrate 50 side of the first placement surface 86, and an angle formed by the first placement surface 86 and the second placement surface 91 is less than 180 degrees. Accordingly, the first placement surface 86 and the second placement surface 91 are non-parallel to each other, and the angle formed by the first substrate 50 and the second substrate 60 is smaller than 180 degrees. Furthermore, since the first base plate 82 and the second base plate 83 are plate-shaped bodies, the back surface 82*b* of the first base plate 82 is inclined with respect to the back surface 83*b* of the second base plate 83, and an angle formed by the back surface 82*b* of the first base plate 82 and the back surface 83*b* of the second base plate 83 is greater than 180 degrees. Specifically, the back surface 82*b* of the first base plate 82 is inclined obliquely upward toward the front, and the back surface 83*b* of the second base plate 83 is inclined obliquely downward toward the front. Note that FIG. 6 is a cross-sectional view perpendicular to the front surface 82*f* of the first base plate 82 and the front surface 83*f* of the second base plate 83. As described above, since the first base plate 82 and the second base plate 83 are plate-shaped bodies, respectively, FIG. 6 is also a cross-sectional view perpendicular to the back surface 83*b* of the first base plate 82 and the back surface 83*b* of the second base plate 83. Furthermore, the outer edge 91*e* located at the upper end that is the first placement surface 86 side among the outer edges of the second placement surface 91 is generally parallel to the outer edge 86*e* located at the lower end that is the second placement surface 91 side among the outer edges of the first placement surface 86.

As shown in FIG. 5, a second rib 92 is formed in a region on the lower side of the front surface 83*f* of the second base plate 83, and the second rib 92 projects forward from the front surface 83*f* of the second base plate 83. Therefore, the second rib 92 is inclined with respect to the normal line of the second placement surface 91. The second ribs 92 extend from the upper side to the lower side when the second placement surface 91 is viewed in a plan view, and are inclined downward with respect to the second placement surface 91. In the present embodiment, the shape of the cross section of the second rib 92 perpendicular to the longitudinal direction is circular. The second rib 92 and the first rib 87 described above are substantially parallel to each other. The second placement surface 91 is visible when viewed from the front, which is a tip end side of the first rib 87 in the extending direction of the first rib 87. Furthermore, the first placement surface 86 is visible when viewed from the front, which is a tip end side of the second rib 92 in the extending direction of the second rib 92.

The rib reinforcing part 93 is formed below the outer peripheral surface of the second rib 92, and the rib reinforcing part 93 is connected to the front surface 83*f* of the second base plate 83. The rib reinforcing part 93 prevents the second rib 92 from being inclined downward with respect to the second placement surface 91. Furthermore, the strength of the second rib 92 is improved as compared with the case where the rib reinforcing part 93 is not provided. In the present embodiment, the rib reinforcing part 93 is not in contact with the second substrate 60.

Projections 94 are formed on both sides of the second base plate 83 in the right and left direction. Each of the projections 94 projects from the front surface 83*f* of the second base plate 83 in the direction normal to the second placement surface 91. On the outer peripheral surface on the upper side and the lower side in each projection 94, an abutting surface 94*s* that is substantially perpendicular to the second placement surface 91 is formed. In the present embodiment, an abutting surface 94*s* is a flat surface that extends to the right and left direction when the second placement surface 91 is viewed in a plan view, and is non-parallel to the up and down direction which is an extending direction of the second ribs 92 when the second placement surface 91 is viewed in a plan view. Furthermore, the second rib 92 described above project more than the projection 94 in the normal direction of the second placement surface 91.

The bosses 100 are formed on both sides of the second base plate 83 in the right and left direction, and the projection 94 is located between the two bosses 100. Each boss 100 projects forward from the front surface 83*f* of the second base plate 83 substantially in parallel with the second rib 92. The tip end of each boss 100 is a plane that is substantially vertical and substantially perpendicular to the projecting direction of the boss 100. Note that "generally vertical" in this specification includes not only a completely vertical state but also a state of being inclined from the completely vertical state by about 1°. A female screw 100*a* is formed at the tip end portion of each boss 100 along the boss 100 from the end surface.

A flow member recess part 96 is formed between the outer peripheral surface of the first base plate 82 on the lower side of the pedestal 90 and the front surface 83*f* of the second base plate 83 on the upper side of the pedestal 95. These two surfaces are lined up from the first placement surface 86 side toward the second placement surface 91 side, and the angle formed by these two surfaces is smaller than 180 degrees. The flow member recess part 96 is connected to these two surfaces. In the present embodiment, as shown in FIG. 6, the shape of the flow member recess part 96 in the vertical cross section is substantially V-shaped. Note that the shape of the flow member recess part 96 in the vertical cross section is not particularly limited, and may be U-shaped, for example.

As shown in FIG. 5, a projection 97 that projects forward is formed on the surface that defines the flow member recess part 96. The projection 97 projects more than the first placement surface 86 in the direction normal to the first placement surface 86. On the outer peripheral surface on the upper side of the projection 97, an abutting surface 97*s* that is substantially perpendicular to the first placement surface 86 is formed. The abutting surface 97*s* is located below the abutting surface 88*s* of the boss 88 formed on the first base plate 82. In the present embodiment, the flow member recess part 96 is connected to the outer peripheral surface on the lower side of the pedestal 90 and the front surface 83*f* of the second base plate 83 above the pedestal 95. Therefore, the projection 97 crosses the flow member recess part 96 in the up and down direction. In the present embodiment, two projections 97 are formed, an abutting surface 97*s* is a flat surface that extends to the right and left direction when the first placement surface is viewed in a plan view, and is non-parallel to the up and down direction which is an extending direction of the first ribs 87 when the first placement surface 86 is viewed in a plan view.

The peripheral wall part 84 is a tubular body extending in the front and rear direction. As shown in FIG. 4, a part of the front end of the peripheral wall part 84 is fixed to the back surface 82*b* of the first base plate 82 and the back surface 83*b* of the second base plate 83. The rear end of the peripheral wall part 84 is an open end, and an opening 84H is formed. In the present embodiment, the peripheral wall part 84 is composed of a pair of side walls 84*a*, 84*a*, an upper wall 84*b*, and a lower wall 84*c*. The pair of side walls 84*a*, 84*a* are plate-like bodies extending in the front and rear direction and the up and down direction at a predetermined interval. In the outer edges on the front side of the pair of side walls 84*a*, 84*a*, a portion from the upper outer edge of the first base plate 82 to the lower outer edge of the second base plate 83 is connected to the back surface 82*b* of the first base plate 82 and the back surface 83*b* of the second base plate 83. As shown in FIG. 6, the upper wall 84*b* is located above the upper outer edge of the first base plate 82, couples the upper outer edges of the pair of side walls 84*a*, 84*a*, and extends in the front and rear and right and left directions. The lower wall 84*c* is located below the lower outer edge of the second base plate 83, couples the lower outer edges of the pair of side walls 84*a*, 84*a*, and extends in the front and rear and right and left directions.

The heat sink 80 has a first ventilation port 98*a* defined by the inner surface of the upper wall 84*b* and the upper outer edge of the first base plate 82. The first ventilation port 98*a* is arranged in front of a connection part 99 between the first base plate 82 and the second base plate 83 and closer to the first base plate 82 side than the connection part 99. Furthermore, the heat sink 80 has a second ventilation port 98*b* defined by the inner surface of the lower wall 84*c* and the lower outer edge of the second base plate 83. The second ventilation port 98*b* is arranged in front of a connection part 99 between the first base plate 82 and the second base plate 83 and closer to the second base plate 83 side than the connection part 99. The first ventilation port 98*a* and the second ventilation port 98*b* communicate the internal space of the peripheral wall part 84 with the external space.

The current plate 85 is a plate-shaped body that is arranged in the internal space of the peripheral wall part 84 and extends from the front end side of the peripheral wall part 84 toward the rear end side. As shown in FIG. 4, in the present embodiment, the current plate 85 extend in the front and rear direction and the up and down direction, and the upper outer edge of the current plate 85 is connected to the inner peripheral surface of the upper wall 84*b* of the peripheral wall part 84, and the lower outer edge of the current plate 85 is connected to the inner peripheral surface of the lower wall 84*c* of the peripheral wall part 84. As shown in FIG. 6, the outer edge 85*f* on the front side of the current plate 85 is connected to the back surface 82*b* of the first base plate 82 and the back surface 83*b* of the second base plate 83. The outer edge 85*b* on the rear side of the current plate 85 is located on the front side of the opening 84H. Note that, in FIG. 6, the outer edge 85*f* on the front side and the outer edge 85*b* on the rear side of the current plate 85 are shown by broken lines. In the present embodiment, the heat sink 80 has a plurality of current plates 85. The plurality of current plates 85 crosses the first ventilation port 98*a* when viewed from the front which is the opening direction of the first ventilation port 98*a*, and crosses the second ventilation port 98*b* when viewed from the front which is the opening direction of the second ventilation port 98*b*. Furthermore, among the plurality of current plates 85, some of the current plates 85 have a projection part 85*a* that extends forward from the second ventilation port 98*b* and projects into the outer space of the peripheral wall part 84.

Next, the fan 81 will be described.

As shown in FIG. 6, the fan 81 is arranged rearward of the current plate 85 in the internal space of the peripheral wall part 84, and the outer periphery of the fan 81 is surrounded by the peripheral wall part 84. The fan 81 is fixed to the heat sink 80 by a screw 81*a* shown in FIG. 4. In the present embodiment, the fan 81 sends out air to the back surface 82*b* of the first base plate 82 and the back surface 83*b* of the second base plate 83. That is, the direction of air flow between the back surfaces 82*b*, 83*b* and the fan 81 is from the rear to the front. Note that the fan 81 is configured so that the air blowing direction can be switched to the opposite direction. That is, the fan 81 can also send air to the opening 84H side instead of the back surface 82*b* of the first base plate 82 and the back surface 83*b* of the second base plate 83 by switching the air blowing direction to the opposite direction. By the way, as described above, the first ventilation port 98*a* and the second ventilation port 98*b* are located in front of the connection part 99 between the first base plate 82 and the second base plate 83. Therefore, the first ventilation port 98*a* and the second ventilation port 98*b* are located in the opposite side from the fan 81 side from the connection part 99 between the first base plate 82 and the second base plate 83 in a cross section perpendicular to the back surface 82*b* of the first base plate 82 and the back surface 83*b* of the second base plate 83.

Next, the first substrate 50, the second substrate 60, and the flexible printed circuit board 70 will be described.

Figure 7:
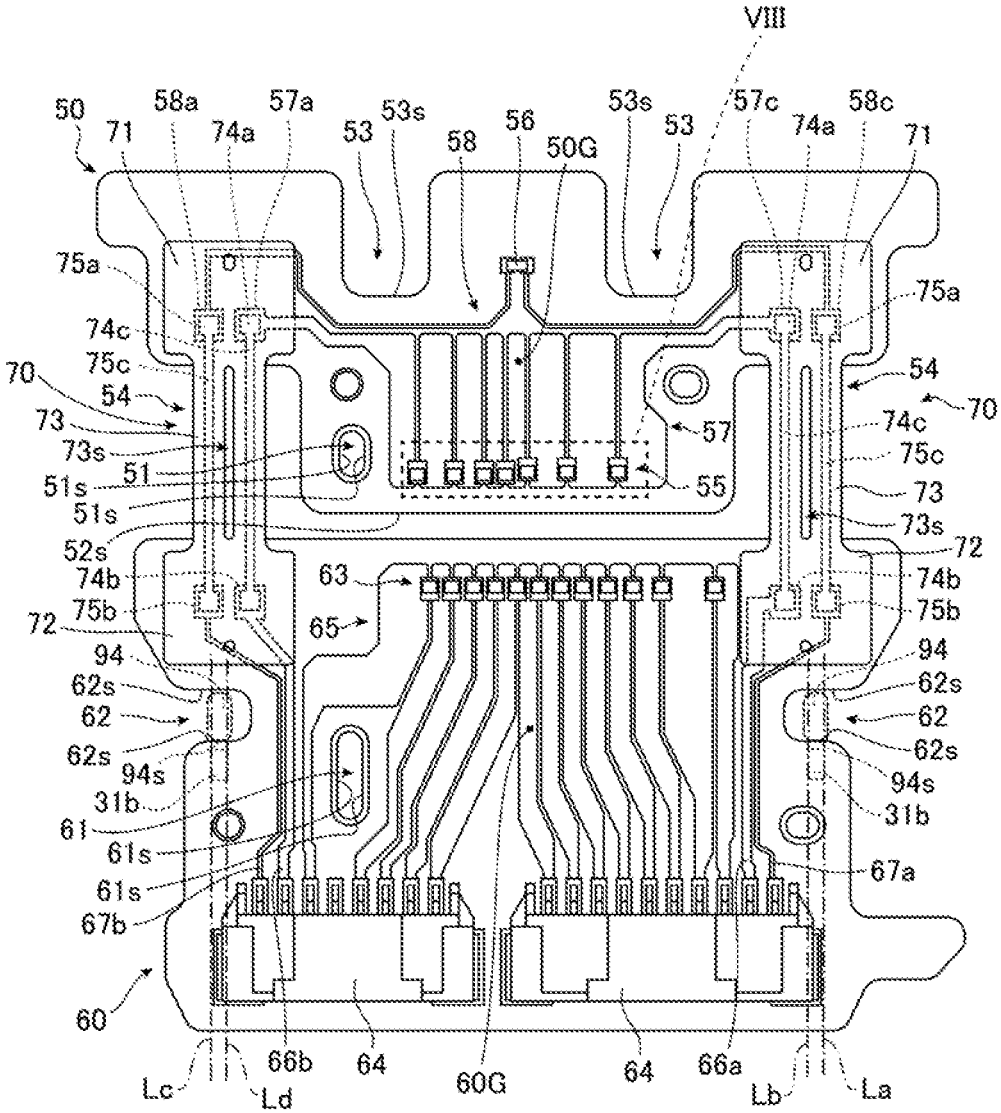
FIG. 7 is a front view of a first substrate, a second substrate, and a flexible printed circuit board.

FIG. 7 is a front view of the first substrate, the second substrate, and the flexible printed circuit board. In FIGS. 3 and 4, the flexible printed circuit board 70 is shown in a curved state, but FIG. 7 shows a state where the flexible printed circuit board 70 is in not curved, and the first substrate 50 and the second substrate 60 are developed on the same plane.

The first substrate 50 is a plate-shaped body and is made of, for example, metal. The first substrate 50 is formed with a through hole 51 penetrating in the plate thickness direction. On the inner peripheral surface of the first substrate 50 that defines the through hole 51, two first abutting surfaces 51*s* that are flat surfaces that face each other from one surface of the first substrate 50 to another surface and are substantially parallel to each other are formed. That is, the first abutting surface 51*s* is a part of the inner peripheral surface of the first substrate 50 that defines the through hole 51. The first abutting surface 51*s* is substantially perpendicular to the front surface and the back surface of the first substrate 50. Furthermore, the through hole 51 is formed at a position corresponding to the first rib 87 on the first base plate 82 of the heat sink 80, and the distance between the two first abutting surfaces 51*s* is slightly larger than the outer diameter of the first rib 87. For example, the distance between the two first abutting surfaces 51*s* may be larger than the outer diameter of the first rib 87 by about 0.05 mm to 0.1 mm.

When the first substrate 50 is viewed in a plan view, the side surface on one side in the direction parallel to the first abutting surface 51*s* is a second abutting surface 52*s* that is substantially perpendicular to the first abutting surface 51*s*. Furthermore, when the first substrate 50 is viewed in a plan view, a positioning recess part 53 whose outer edge is recessed on the second abutting surface 52*s* side is formed on the outer edge on the side opposite to the second abutting surface 52*s* side. On the side surface of the first substrate 50 that defines the positioning recess part 53, a third abutting surface 53*s* that is substantially perpendicular to the first abutting surface 51*s* is formed from one surface of the first substrate 50 to another surface. The positioning recess part 53 is formed at a position corresponding to the boss 88 on the first base plate 82 of the heat sink 80, and two positioning recess parts 53 are formed. The distance between the second abutting surface 52*s* and the third abutting surface 53*s* is slightly smaller than the distance between the abutting surface 88*s* of the boss 88 and the abutting surface 97*s* of the projection 97 in the heat sink 80. For example, the distance between the second abutting surface 52*s* and the third abutting surface 53*s* may be smaller than the distance between the abutting surface 88*s* of the boss 88 and the abutting surface 97*s* of the projection 97 by about 0.05 mm to 0.1 mm. Furthermore, the first substrate 50 is formed with a notch 54 extending from the outer edge on the second abutting surface 52*s* side to a predetermined position on the side opposite to the second abutting surface 52*s* side. In the present embodiment, two notches 54 are formed.

A first light emitting element 55 and a thermistor 56 are mounted on one surface of the first substrate 50. When the first substrate 50 is viewed in a plan view, the first light emitting element 55 is located on the second abutting surface 52*s* side, and the thermistor 56 is located on the opposite side to the second abutting surface 52*s* side. In the present embodiment, a center of gravity 50G of the first substrate 50 is located between the first light emitting element 55 and the thermistor 56.

The first light emitting element 55 emits first light serving as a low beam. That is, the first light emitting element 55 is a low beam light emitting element. Furthermore, the first light emitting element 55 is arranged so that the normal line of the emission surface from which the first light is emitted is directed obliquely downward to the front. The plurality of first light emitting elements 55 are provided in parallel in the right and left direction. In the present embodiment, seven first light emitting elements 55 are provided.

Figure 8:
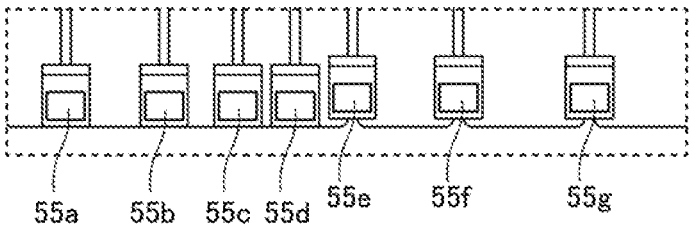
FIG. 8 is an enlarged view showing a portion surrounded by a broken line VIII in FIG. 7.

FIG. 8 is an enlarged view showing a portion surrounded by a broken line VIII in FIG. 7. When it is necessary to distinguish the first light emitting elements 55 from each other, as shown in FIG. 8, the first light emitting elements 55 are referred to as the first light emitting elements 55*a* to 55*g* in order from left to right in a front view. The first light emitting elements 55*a* to 55*d* are provided at positions lower than the first light emitting elements 55*e* to 55*g*. That is, the plurality of first light emitting elements 55*a* to 55*c* arranged on one side in the right and left direction with reference to a specific first light emitting element 55*d* and the plurality of first light emitting elements 55*e* to 55*g* arranged on another side are provided at different heights. In the present embodiment, the specific first light emitting element 55*d* is provided at the same height as the first light emitting elements 55*a* to 55*d* provided on the left side of the specific first light emitting element 55*d* in the front view. The heights of these first light emitting elements 55*e* to 55*g* are determined according to the shape of the cut line of the low beam light distribution pattern described later.

Furthermore, the average interval between the specific first light emitting element 55*d* and the pair of first light emitting elements 55*c*, 55*e* arranged with the specific first light emitting element 55*d* interposed therebetween is narrower than the average interval of the other first light emitting elements 55*a*, 55*b*, 55*f*, 55*g* adjacent to each other. That is, the average interval between the first light emitting elements 55*c*, 55*d*, 55*e* adjacent to each other is narrower than the average interval between the first light emitting elements 55*a*, 55*b*, 55*c* adjacent to each other and the average interval between the first light emitting elements 55*e*, 55*f*, 55*g* adjacent to each other. Accordingly, the interval between the first light emitting elements 55*c*, 55*d*, 55*e* arranged adjacent to each other in the vicinity of the center in the right and left direction is narrower than the average interval of the first light emitting elements 55*a*, 55*b*, 55*c* arranged adjacent to each other on one side of the right and left direction and the average interval of the first light emitting elements 55*e*, 55*f*, 55*g* arranged adjacent to each other on another side.

For example, an LED is used as the first light emitting element 55. In the present embodiment, as described above, the plurality of first light emitting elements 55 are provided in parallel in the right and left direction. Accordingly, the first light emitting element 55 is an LED array including a plurality of LEDs. The LED array is connected in series by a power feeding circuit 57 formed on the first substrate 50. The thermistor 56 is connected to a thermistor circuit 58 formed on the first substrate 50. Note that the first light emitting element 55, the thermistor 56, the power feeding circuit 57, and the thermistor circuit 58 are insulated from the first substrate 50 by an insulating layer (not shown) provided on the surface of the first substrate 50.

The second substrate 60 is a plate-shaped body and is made of, for example, metal. The second substrate 60 is formed with a through hole 61 penetrating in the plate thickness direction. On the inner peripheral surface of the second substrate 60 that defines the through hole 61, two first abutting surfaces 61*s* that are flat surfaces that face each other from one surface of the second substrate 60 to another surface and are substantially parallel to each other are formed. That is, the first abutting surface 61*s* is a part of the inner peripheral surface of the second substrate 60 that defines the through hole 61. The first abutting surface 61*s* is substantially perpendicular to the front surface and the back surface of the second substrate 60. Furthermore, the through hole 61 is formed at a position corresponding to the second rib 92 on the second base plate 83 of the heat sink 80, and the distance between the two first abutting surfaces 61*s* is slightly larger than the outer diameter of the second rib 92. For example, the distance between the two first abutting surfaces 61*s* may be larger than the outer diameter of the second rib 92 by about 0.05 mm to 0.1 mm.

When the second substrate 60 is viewed in a plan view, a positioning recess part 62 is formed in which the outer edge of the second substrate 60 is recessed in a direction substantially perpendicular to the first abutting surface 61*s*. On the side surface of the second substrate 60 that defines the positioning recess part 62, two second abutting surfaces 62*s* that are substantially perpendicular to the first abutting surface 61*s* is formed facing from one surface of the second substrate 60 to another surface. The positioning recess part 62 is formed at a position corresponding to the projection 94 on the second base plate 83 of the heat sink 80, and two positioning recess parts 62 are formed on the second base plate 83. The distance between the two second abutting surfaces 62*s* of each positioning recess part 62 is slightly larger than the distance between the two abutting surfaces 94*s* of the projection 94. For example, the distance between the two second abutting surfaces 62*s* may be larger than the distance between the two abutting surfaces 94*s* of the projection 94 by about 0.05 mm to 0.1 mm.

A second light emitting element 63 and a connector 64 are mounted on one surface of the second substrate 60. When the second substrate 60 is viewed in a plan view, the second light emitting element 63 is located on one side in the direction parallel to the first abutting surface 61*s*, and the connector 64 is located on another side. In the present embodiment, a center of gravity 60G of the second substrate 60 is located between the second light emitting element 63 and the connector 64.

The second light emitting element 63 and the connector 64 are electrically connected by a power feeding circuit 65 formed on the second substrate 60. Furthermore, the second light emitting element 63 is arranged below the first light emitting element 55 and emits second light. The second light emitting element 63 of the present embodiment emits the second light serving a high beam. That is, the second light emitting element 63 of the present embodiment is a high beam light emitting element. Furthermore, the second light emitting element 63 is arranged so that the normal line of the emission surface from which the second light is emitted is directed obliquely upward to the front. The plurality of second light emitting elements 63 are provided in parallel in the right and left direction. In the present embodiment, twelve second light emitting elements 63 are provided. The second light emitting elements 63 are arranged at substantially the same height and in a straight line. Furthermore, in the present embodiment, one second light emitting element 63 arranged at the right end is arranged farther from other second light emitting elements 63 by a distance greatly larger than the interval between the other adjacent second light emitting elements 63.

For example, an LED is used as the second light emitting element 63. In the present embodiment, as described above, the plurality of second light emitting elements 63 are provided in parallel in the right and left direction. Accordingly, the second light emitting element 63 is an LED array including a plurality of LEDs. In the present embodiment, the second light emitting element 63 is an LED array including a plurality of LEDs arranged in parallel in a direction perpendicular to the first abutting surface 61*s* when the second substrate 60 is viewed in a plan view. In this LED array, two adjacent LEDs are connected in parallel by the power feeding circuit 65, and light can be emitted or non-emitted for each two LEDs connected in parallel.

Furthermore, on the second substrate 60, a first power feeding wiring 66*a*, a second power feeding wiring 66*b*, a first thermistor wiring 67*a*, and a second thermistor wiring 67*b* each having one end of which is connected to the connector 64 are formed. In the present embodiment, the first thermistor wiring 67*a* is located on one side from the power feeding circuit 65 in a direction substantially perpendicular to the first abutting surface 61*s* when the second substrate 60 is viewed in a plan view. The first power feeding wiring 66*a* is located between the power feeding circuit 65 and the first thermistor wiring 67*a* in a direction substantially perpendicular to the first abutting surface 61*s* when the second substrate 60 is viewed in a plan view. The second thermistor wiring 67*b* is located on another side from the power feeding circuit 65 in a direction substantially perpendicular to the first abutting surface 61*s* when the second substrate 60 is viewed in a plan view. The second power feeding wiring 66*b* is located between the power feeding circuit 65 and the second thermistor wiring 67*b* in a direction substantially perpendicular to the first abutting surface 61*s* when the second substrate 60 is viewed in a plan view. A wire harness (not shown) is connected to the connector 64. The number of connectors 64 is not particularly limited, and FIG. 7 illustrates an example in which two connectors 64 are mounted in parallel in a direction substantially perpendicular to the first abutting surface 61*s*. Note that each of the second light emitting element 63, the power feeding circuit 65, the first power feeding wiring 66*a*, the second power feeding wiring 66*b*, the first thermistor wiring 67*a*, and the second thermistor wiring 67*b* is insulated from the second substrate 60 by an insulating layer (not shown) provided on the surface of the second substrate 60.

In the present embodiment, the two flexible printed circuit boards 70 have a substantially left-right symmetrical configuration. In the following, one of them will be described and the other will be omitted as appropriate. The flexible printed circuit board 70 has flexibility and is composed of, for example, an insulating sheet and a metal film provided on one surface of the insulating sheet. The flexible printed circuit board 70 of the present embodiment includes a substantially rectangular band part 73, a first connection part 71 connected to one end in the longitudinal direction of the band part 73, and a second connection part 72 connected to another end in the longitudinal direction of the band part 73. The width of the band part 73 in the direction perpendicular to the longitudinal direction is smaller than the width of the first connection part 71 and the second connection part 72 in that direction. In the present embodiment, the band part 73 is provided with a slit 73*s* substantially parallel to the longitudinal direction of the band part 73. Due to the slit 73*s*, the bending rigidity of the band part 73 is lower than that when the slit 73*s* is not formed. In particular, the rigidity of the band part 73 in the direction perpendicular to the longitudinal direction is reduced. The widths of the first connection part 71, the second connection part 72, and the band part 73 are not particularly limited. For example, the width of the band part 73 may be larger than the width of the first connection part 71 and the second connection part 72. Furthermore, the width of the band part 73 may change in the longitudinal direction of the band part 73. Furthermore, the slit 73*s* may not be formed in the band part 73.

A first power feeding terminal 74*a* and a first thermistor terminal 75*a* are formed in the first connection part 71, and a second power feeding terminal 74*b* and a second thermistor terminal 75*b* are formed in the second connection part 72. Furthermore, the flexible printed circuit board 70 is formed with a power feeding wiring 74*c* that electrically connects the first power feeding terminal 74*a* and the second power feeding terminal 74*b* through the band part 73. Furthermore, as similarly to the power feeding wiring 74*c*, a thermistor wiring 75*c* that passes through the band part 73 and electrically connects the first thermistor terminal 75*a* and the second thermistor terminal 75*b* is also formed. The power feeding wiring 74*c* passes through one side in a direction perpendicular to the longitudinal direction of the band part 73 with reference to the slit 73*s* of the band part 73. On the other hand, the thermistor wiring 75*c* passes through the other side in the direction perpendicular to the longitudinal direction of the band part 73 with reference to the slit 73*s* of the band part 73. That is, the flexible printed circuit board 70 has the two wirings 74*c*, 75*c* extending from the first connection part 71 to the second connection part 72, and the slit 73*s* is formed between the two wirings 74*c*, 75*c*.

Each such flexible printed circuit board 70 connects the first substrate 50 and the second substrate 60, and electrically connects the circuit formed on the first substrate 50 and the circuit formed on the second substrate 60. Specifically, the first connection part 71 of each flexible printed circuit board 70 is joined to the mounting surface of the first substrate 50 on which the first light emitting element 55 is mounted, for example, by soldering. The second connection part 72 of each flexible printed circuit board 70 is joined to the mounting surface of the second substrate 60 on which the second light emitting element 63 is mounted, for example, by soldering. As described above, each flexible printed circuit board 70 is connected to the first substrate 50 and the second substrate 60. The longitudinal directions of the band parts 73 of the flexible printed circuit boards 70 are substantially parallel to each other. In the present embodiment, in a state where the first substrate 50 and the second substrate 60 are arranged on the same plane, the first abutting surface 51*s* of the first substrate 50 and the first abutting surface 61*s* of the second substrate 60 are almost parallel. Furthermore, the first light emitting element 55 side of the first substrate 50 is located on the second light emitting element 63 side of the second substrate 60.

The first connection parts 71 of the flexible printed circuit boards 70 are located at substantially the same place in the direction parallel to the first abutting surface 51*s* when the first substrate 50 is viewed in a plan view. The second connection parts 72 of the flexible printed circuit boards 70 are located at substantially the same place in the direction parallel to the first abutting surface 61*s* when the second substrate 60 is viewed in a plan view. The center of gravity 50G of the first substrate 50 and the first light emitting element 55 are located between the first connection parts 71 of the flexible printed circuit boards 70. The first connection parts 71 of the flexible printed circuit boards 70 are located on the side opposite to the first light emitting element 55 side with respect to the center of gravity 50G of the first substrate 50. The center of gravity 60G of the second substrate 60 and the second light emitting element 63 are located between the second connection parts 72 of the flexible printed circuit board 70. Note that the center of gravity 50G of the first substrate 50 and the first light emitting element 55 do not have to be located between the first connection parts 71. Furthermore, the center of gravity 60G of the second substrate 60 and the second light emitting element 63 do not have to be located between the second connection parts 72. A part of the band part 73 of each flexible printed circuit board 70 overlaps with the notch 54 of the first substrate 50 when viewed from the side opposite to the first substrate 50 side of the flexible printed circuit board 70. The width of the notch 54 is set to be larger than the width of the band part 73. Furthermore, from the similar viewpoint, the band part 73 of each flexible printed circuit board 70 does not overlap with the first substrate 50 from the outer edge of the second substrate 60 which the band part 73 crosses to a predetermined position in the notch 54. The band part 73 of the flexible printed circuit board 70 of the present embodiment does not overlap with the first substrate 50 from the outer edge of the second substrate 60 which the band part 73 crosses to the outer edge on the side opposite to the second substrate 60 side among the outer edges that define the notch 54 of the first substrate 50. Furthermore, the first light emitting element 55 of the first substrate 50 is arranged closer to the second substrate 60 than the edge of the notch 54 on the side opposite to the second substrate side when the first substrate 50 is viewed in a plan view. Then, the first light emitting element 55 overlaps with a portion of the band part 73 that does not overlap with the first substrate 50 in the direction perpendicular to the longitudinal direction of the band part 73.

Furthermore, a cathode-side end 57*c* of the power feeding circuit 57 formed on the first substrate 50 is connected to the first power feeding terminal 74*a* of one flexible printed circuit board 70. An anode-side end 57*a* of the power feeding circuit 57 of the first substrate 50 is connected to the first power feeding terminal 74*a* of another flexible printed circuit board 70. Furthermore, a cathode-side end 58*c* of the thermistor circuit 58 formed on the first substrate 50 is connected to the first thermistor terminal 75*a* of one flexible printed circuit board 70. An anode-side end 58*a* of the thermistor circuit 58 formed on the first substrate 50 is connected to the first thermistor terminal 75*a* of another flexible printed circuit board 70.

An end of the second substrate 60 opposite to the connector 64 side of the first power feeding wiring 66*a* is connected to the second power feeding terminal 74*b* of one flexible printed circuit board 70. An end of the second substrate 60 opposite to the connector 64 side of the second power feeding wiring 66*b* is connected to the second power feeding terminal 74*b* of another flexible printed circuit board 70. Furthermore, an end of the second substrate 60 opposite to the connector 64 side of the first thermistor wiring 67*a* is connected to the second thermistor terminal 75*b* of one flexible printed circuit board 70. An end of the second substrate 60 opposite to the connector 64 side of the second thermistor wiring 67*b* is connected to the second thermistor terminal 75*b* of another flexible printed circuit board 70.

By connecting the two flexible printed circuit boards 70 to the first substrate 50 and the second substrate 60 as described above, the connector 64 of the second substrate 60 and the power feeding circuit 65 of the first substrate 50 are electrically connected to each other. Then, power is fed to the first light emitting element 55 of the first substrate 50 via the connector 64. Furthermore, the connector 64 of the second substrate 60 and the thermistor circuit 58 of the first substrate 50 are electrically connected to each other, and a current is applied to the thermistor 56 of the first substrate 50.

Next, mounting of the first substrate 50 on the heat sink 80 will be described.

Figure 9:
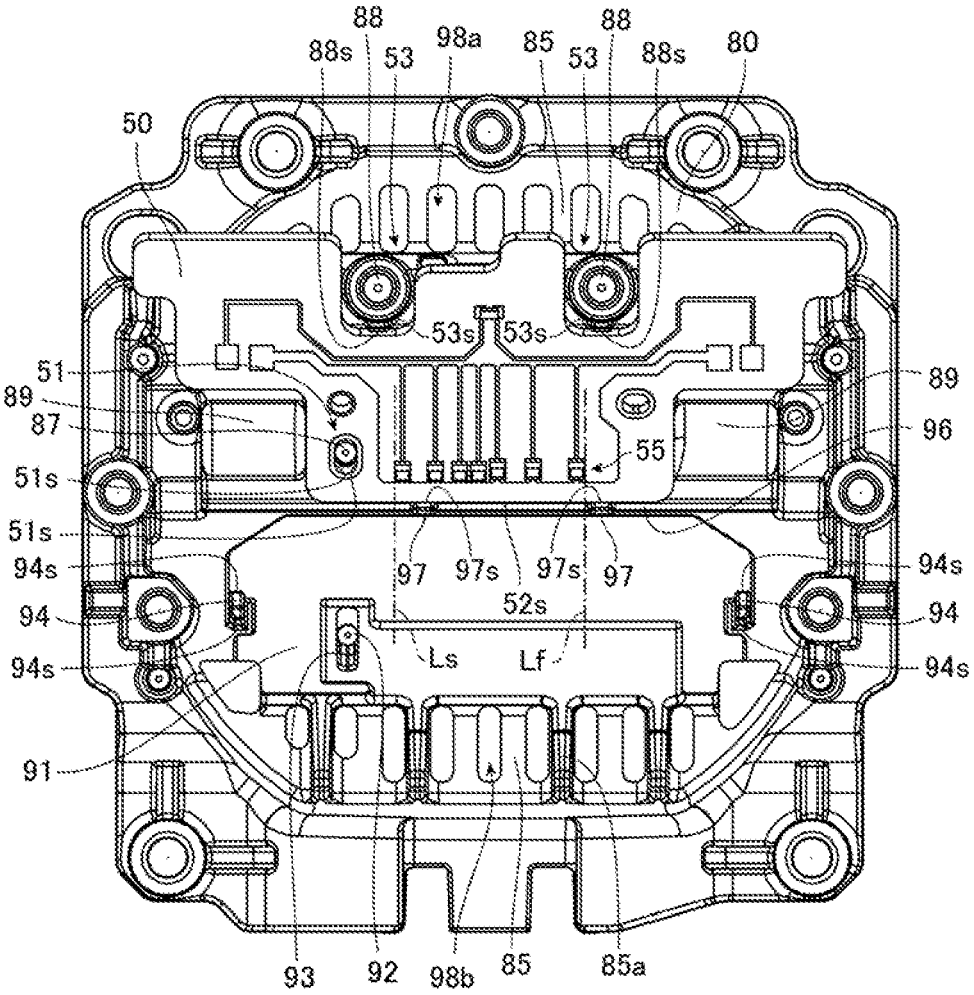
FIG. 9 is a diagram showing a situation where the first substrate is mounted on the heat sink.

FIG. 9 is a diagram showing a situation where the first substrate is mounted on the heat sink. As shown in FIG. 9, the first substrate 50 is placed on the first placement surface 86 in the first base plate 82 of the heat sink 80 in a state where the first abutting surface 51*s* is substantially parallel to the up and down direction and the first light emitting element 55 side is located on the lower side. When the first substrate is viewed in a plan view, the outer edge of the first placement surface 86 is surrounded by the outer edge of the first substrate 50. In the present embodiment, since the surface of the first substrate 50 opposite to the side on which the first light emitting element 55 is mounted is coated with grease as a flow member described later, this grease is interposed between the surface of the first substrate 50 on the side opposite to the side on which the first light emitting element 55 is mounted and the first placement surface 86. The first rib 87 of the first base plate 82 is inserted into the through hole 51 of the first substrate 50. As described above, the first rib 87 is inclined upward with respect to the first placement surface 86 and extends from the lower side to the upper side when the first placement surface 86 is viewed in a plan view, the first rib 87 is inserted in a state of being inclined upward with respect to the opening direction of the through hole 51. As described above, the center of the first rib 87 inserted into the through hole 51 is located between the two first abutting surfaces 51*s* when viewed from the front which is the extending direction of the first rib 87. As described above, the distance between the two first abutting surfaces 51*s* is slightly larger than the outer diameter of the first rib 87. Therefore, when the first substrate 50 moves in the direction perpendicular to the first abutting surface 51*s* along the first placement surface 86 with respect to the heat sink 80, the outer peripheral surface of the first rib abuts on either one side of the two first abutting surfaces 51*s*. Here, when the first placement surface 86 is viewed in a plan view as described above, the first ribs 87 extend from the lower side to the upper side, and the first abutting surface 51*s* is substantially parallel to the up and down direction. Therefore, it can be understood that at least one of the outer peripheral surface on one side and the outer peripheral surface on another side of the first rib 87 in the right and left direction which is a direction perpendicular to the extending direction of the first rib 87 when the first placement surface 86 is viewed in a plan view abuts on the first abutting surface 51*s*. Accordingly, among the positions of the first substrate 50 with respect to the heat sink 80 in the direction parallel to the first placement surface 86, the position in the direction perpendicular to the extending direction of the first ribs 87 when the first placement surface 86 is viewed in a plan view is regulated so as to be within a predetermined range. Note that at least one of the outer peripheral surface on one side and the outer peripheral surface on another side of the first rib 87 in a direction perpendicular to the extending direction of the first rib 87 when the first placement surface 86 is viewed in a plan view may always abut on the first abutting surface 51*s*. For example, the first rib 87 may be press fitted into the through hole 51.

The two bosses 88 of the first base plate 82 are inserted into the two positioning recess parts 53 of the first substrate 50, respectively. As described above, the abutting surface 88*s* of the boss 88 is a plane that is perpendicular to the first placement surface 86 and extends to the right and left when the first placement surface 86 is viewed in a plan view. Furthermore, the third abutting surface 53*s* on the side surface of the first substrate 50 that defines the positioning recess part 53 is substantially perpendicular to the first abutting surface 51*s* that is substantially parallel to the up and down direction. Therefore, the abutting surface 88*s* and the third abutting surface 53*s* are opposed to each other in a substantially parallel state.

The second abutting surface 52*s* of the first substrate 50 is located above the projection 97 of the heat sink 80. As described above, the abutting surface 97*s* of the projection 97 is a plane that is substantially perpendicular to the first placement surface 86 and extends to the right and left when the first placement surface 86 is viewed in a plan view. Furthermore, the second abutting surface 52*s* of the first substrate 50 is substantially perpendicular to the first abutting surface 51*s* that is substantially parallel to the up and down direction. Therefore, the abutting surface 97*s* and the second abutting surface 52*s* are opposed to each other in a substantially parallel state. As described above, the distance between the second abutting surface 52*s* and the third abutting surface 53*s* on the first substrate 50 is slightly smaller than the distance between the abutting surface 88*s* of the boss 88 and the abutting surface 97*s* of the projection 97 in the heat sink 80. Therefore, when the first substrate 50 moves in the direction parallel to the first abutting surface 51*s* along the first placement surface 86 with respect to the heat sink 80, the second abutting surface 52*s* of the first substrate 50 and the abutting surface 97*s* of the projection 97 abut on each other. Furthermore, the third abutting surface 53*s* of the first substrate 50 and the abutting surface 88*s* of the boss 88 abut on each other. Here, as described above, the abutting surface 88*s* is a plane that extends in the right and left direction when the first placement surface 86 is viewed in a plan view, and the abutting surface 88*s* and the third abutting surface 53*s* face each other in a substantially parallel state. Therefore, when the first placement surface 86 is viewed in a plan view, the tangent line when the abutting surface 88*s* and the third abutting surface 53*s* abut on each other extends substantially to the right and left. Therefore, this tangent line is substantially perpendicular to the extending direction of the first rib 87 and non-parallel. Furthermore, as described above, the abutting surface 97*s* is a plane that extends in the right and left direction when the first placement surface 86 is viewed in a plan view, and the abutting surface 97*s* and the second abutting surface 52*s* face each other in a substantially parallel state. Therefore, when the first placement surface 86 is viewed in a plan view, the tangent line when the abutting surface 97*s* and the second abutting surface 52*s* abut on each other extends substantially to the right and left. Therefore, this tangent line is substantially perpendicular to the extending direction of the first rib 87 and non-parallel. Accordingly, among the positions of the first substrate 50 with respect to the heat sink 80 in the direction parallel to the first placement surface 86, the position in the up and down direction which is the extending direction of the first ribs 87 when the first placement surface 86 is viewed in a plan view is regulated so as to be within a predetermined range. Note that, in at least one of the state where the abutting surface 88*s* and the third abutting surface 53*s* abut on each other and the state where the abutting surface 97*s* and the second abutting surface 52*s* abut on each other, the first rib 87 is not in contact with the first substrate 50 in the extending direction of the first ribs 87 when the first placement surface 86 is viewed in a plan view. Note that the second abutting surface 52*s* of the first substrate 50 and the abutting surface 97*s* of the projection 97 may always abut on each other, and the third abutting surface 53*s* of the first substrate 50 and the abutting surface 88*s* of the boss 88 may always abut on each other.

By the way, since the first base plate 82 extends obliquely upward to the front as described above, the first placement surface 86 also extends obliquely upward to the front, and the first substrate 50 placed on the first placement surface 86 also extends obliquely upward to the front. Furthermore, as shown in FIG. 9, when viewed from the front which is the opening direction of the first ventilation port 98*a*, a part of the first substrate 50 overlaps the first ventilation port 98*a*. Furthermore, as described above, the first substrate 50 is placed on the first placement surface 86 of the heat sink 80 in a state where the first abutting surface 51*s* is substantially parallel to the up and down direction. The first light emitting element 55 is an LED array including a plurality of LEDs arranged in parallel in a direction substantially perpendicular to the first abutting surface 51*s*. Therefore, the LED array as the first light emitting element 55 is arrayed in parallel in the right and left direction.

Next, mounting of the second substrate 60 on the heat sink 80 will be described.

Figure 10:
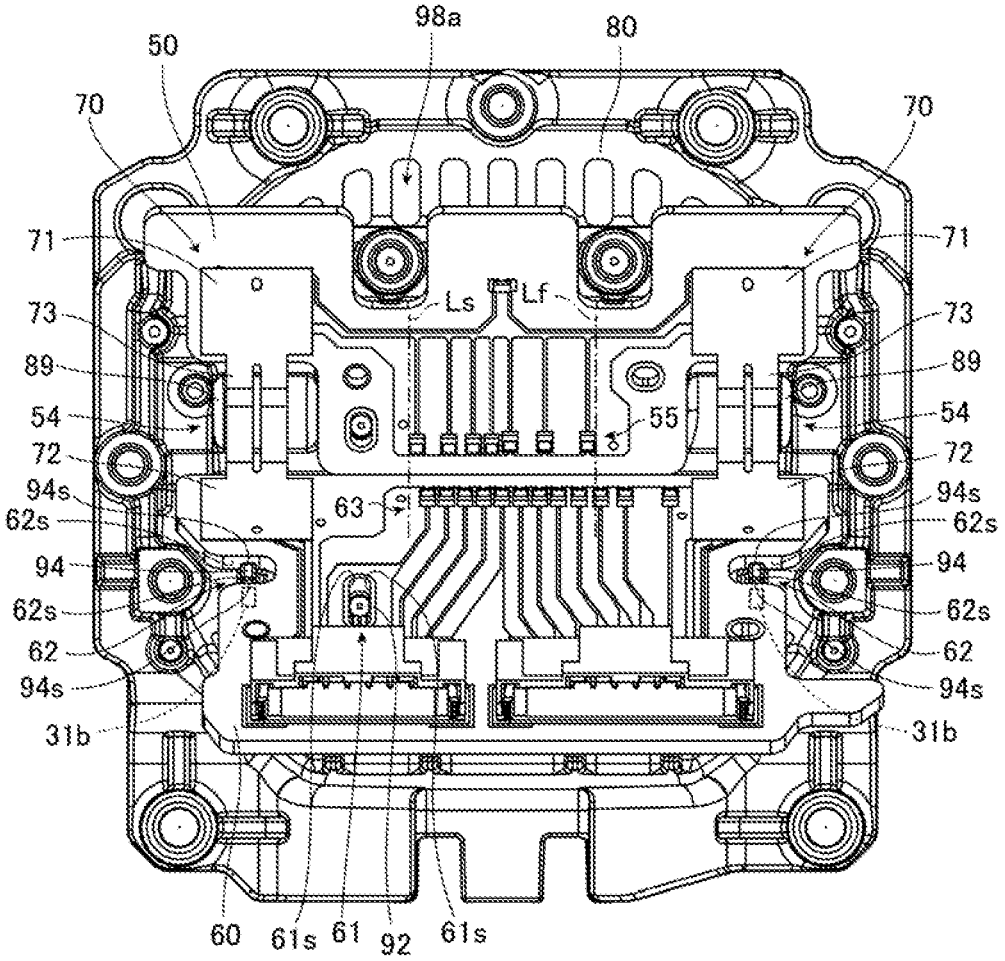
FIG. 10 is a diagram showing a situation where the first substrate and the second substrate are mounted on the heat sink.

FIG. 10 is a diagram showing a situation where the first substrate and the second substrate are mounted on the heat sink. As shown in FIG. 10, the second substrate 60 is placed on the second placement surface 91 in the second base plate 83 of the heat sink 80 in a state where the first abutting surface 61*s* is substantially parallel to the up and down direction and the second light emitting element 63 side is located on the upper side. When the second substrate 60 is viewed in a plan view, the outer edge of the second placement surface 91 is surrounded by the outer edge of the second substrate 60. Note that, in FIG. 10, the first substrate 50 side of the second substrate 60 and the second substrate 60 side of the first substrate 50 overlap each other, but the second substrate 60 and the first substrate 50 are separated from each other. That is, the first substrate 50 and the second substrate 60 are placed on the heat sink 80 with a predetermined interval.

In the present embodiment, since the surface of the second substrate 60 opposite to the side on which the second light emitting element 63 is mounted is coated with grease as a flow member described later as similar to the first substrate 50, this grease is interposed between the surface of the second substrate 60 on the side opposite to the side on which the second light emitting element 63 is mounted and the second placement surface 91. The second rib 92 of the second base plate 83 is inserted into the through hole 61 of the second substrate 60. As described above, the second rib 92 is inclined downward with respect to the second placement surface 91 and extends from the upper side to the lower side when the second placement surface 91 is viewed in a plan view, the second rib 92 is inserted in a state of being inclined downward with respect to the opening direction of the through hole 61. As described above, the center of the second rib 92 inserted into the through hole 61 is located between the two first abutting surfaces 61*s* when viewed from the front which is the extending direction of the second rib 92. As described above, the distance between the two first abutting surfaces 61*s* is slightly larger than the outer diameter of the second rib 92. Therefore, when the second substrate 60 moves in the direction perpendicular to the first abutting surface 61*s* along the second placement surface 91 with respect to the heat sink 80, the outer peripheral surface of the second rib 92 abuts on either one side of the two first abutting surfaces 61*s*. Here, when the second placement surface 91 is viewed in a plan view as described above, the second ribs 92 extend from the upper side to the lower side, and the first abutting surface 61*s* is substantially parallel to the up and down direction. Therefore, it can be understood that at least one of the outer peripheral surface on one side and the outer peripheral surface on another side of the second rib 92 in the right and left direction which is a direction perpendicular to the extending direction of the second rib 92 when the second placement surface 91 is viewed in a plan view abuts on the first abutting surface 61*s*. Accordingly, among the positions of the second substrate 60 with respect to the heat sink 80 in the direction parallel to the second placement surface 91, the position in the direction perpendicular to the extending direction of the second ribs 92 when the second placement surface 91 is viewed in a plan view is regulated so as to be within a predetermined range. Note that at least one of the outer peripheral surface on one side and the outer peripheral surface on another side of the second rib 92 in a direction perpendicular to the extending direction of the second rib 92 when the second placement surface 91 is viewed in a plan view may always abut on the first abutting surface 61*s*. For example, the second rib 92 may be press fitted into the through hole 61.

The two projections 94 of the second base plate 83 are inserted into the two positioning recess parts 62 of the second substrate 60, respectively. As described above, the abutting surfaces 94*s* formed on the outer peripheral surfaces on the upper side and the lower side of the projection 94 are substantially perpendicular to the second placement surface 91, and are planes extending in right and left when the second placement surface 91 is viewed in a plan view. Furthermore, two opposing second abutting surface 62*s* on the side surface of the second substrate 60 that defines the positioning recess part 62 is substantially perpendicular to the first abutting surface 61*s* that is substantially parallel to the up and down direction. Therefore, the abutting surface 94*s* and the second abutting surface 62*s* are opposed to each other in a substantially parallel state. As described above, the distance between the two second abutting surfaces 62*s* of each positioning recess part 62 is slightly larger than the distance between the two abutting surfaces 94*s* of the projection 94. Therefore, when the second substrate 60 moves in the direction parallel to the first abutting surface 61*s* along the second placement surface 91 with respect to the heat sink 80, either one of the opposing abutting surfaces 94*s* and the first abutting surface 61*s* abut on each other. Here, as described above, the abutting surface 94*s* is a plane that extends in the right and left direction when the second placement surface 91 is viewed in a plan view, and the abutting surface 94*s* and the second abutting surface 62*s* face each other in a substantially parallel state. Therefore, when the second placement surface 91 is viewed in a plan view, the tangent line when the abutting surface 94*s* and the second abutting surface 62*s* abut on each other extends substantially to the right and left. Therefore, this tangent line is substantially perpendicular to the extending direction of the second rib 92 and non-parallel. Accordingly, among the positions of the second substrate 60 with respect to the heat sink 80 in the direction parallel to the second placement surface 91, the position parallel to the first abutting surface 61*s* is regulated so as to be within a predetermined range. Note that, in the state where the abutting surface 94*s* and the second abutting surface 62*s* abut on each other, when the second placement surface 91 is viewed in a plan view, the second rib 92 is not in contact with the second substrate 60 in the extending direction of the second rib 92. Note that the second abutting surface 62*s* of the second substrate 60 and the abutting surface 94*s* of the projection 94 may always abut on each other. For example, the projection 94 may be press fitted into the positioning recess part 62.

By the way, since the second base plate 83 extends obliquely downward to the front as described above, the second placement surface 91 also extends obliquely upward to the front, and the second substrate 60 placed on the second placement surface 91 also extends obliquely downward to the front. Furthermore, as shown in FIG. 10, when viewed from the front which is the opening direction of the second ventilation port 98*b*, the second substrate 60 overlaps the second ventilation port 98*b*. Furthermore, as described above, the second substrate 60 is placed on the second placement surface 91 of the heat sink 80 in a state where the first abutting surface 61*s* is substantially parallel to the up and down direction. The second light emitting element 63 is an LED array that is arrayed in parallel in a direction substantially perpendicular to the first abutting surface 61*s*. Therefore, the LED array as the second light emitting element 63 is arrayed in parallel in the right and left direction. Furthermore, as described above, since the first light emitting element 55 side of the first substrate 50 is located on the second light emitting element 63 side of the second substrate 60, the second light emitting element 63 is located closer to the first substrate 50 side than the second substrate 60 side in the second substrate 60. Furthermore, the first light emitting element 55 is located closer to the second substrate 60 than the first substrate 50 side in the first substrate 50.

Furthermore, when viewed from the side opposite to the heat sink 80 side of the flexible printed circuit board 70, the band parts 73 of the two flexible printed circuit boards 70 does not overlap with the first substrate 50 from the outer edge of the second substrate 60 which the band part 73 crosses to a predetermined position in the notch 54. Furthermore, from a similar viewpoint, the first light emitting element 55 of the first substrate 50 overlaps with a portion of the band part 73 that does not overlap with the first substrate 50 in the direction perpendicular to the longitudinal direction of the band part 73. Furthermore, from the similar viewpoint, one recess 89 of the heat sink 80 crosses both edges of the flexible printed circuit board in the direction perpendicular to the longitudinal direction of one flexible printed circuit board 70. Furthermore, another recess 89 crosses both edges of the flexible printed circuit board 70 in the direction perpendicular to the longitudinal direction of another flexible printed circuit board 70.

Figure 11:
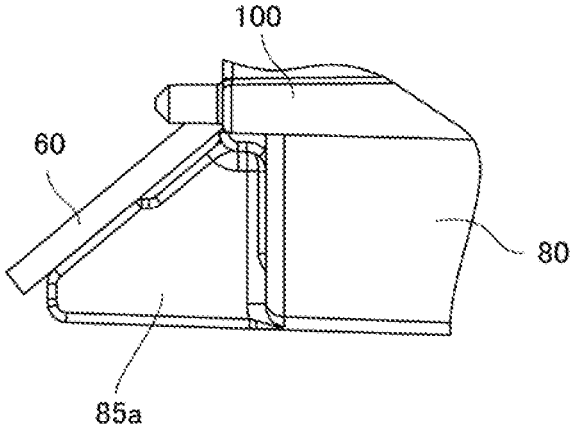
FIG. 11 is a diagram showing a situation where the second substrate is placed on the heat sink.

FIG. 11 is a diagram showing a situation in which the second substrate is placed on the heat sink, and is a partially enlarged view of the second substrate and the heat sink viewed from the side. As described above, among the plurality of current plates 85, some of the current plates 85 have a projection part 85*a* that extends forward from the second ventilation port 98*b* and projects into the outer space of the peripheral wall part 84. As shown in FIG. 11, the projection part 85*a* contacts the surface of the second substrate 60 on the side opposite to the side on which the second light emitting element 63 is mounted. That is, the second substrate 60 is placed also on the projection part 85*a* in addition to the second placement surface 91 of the second base plate 83.

Next, the state of the flexible printed circuit board 70 in a state where the first substrate 50 and the second substrate 60 are mounted on the heat sink 80 will be described.

Figure 12:
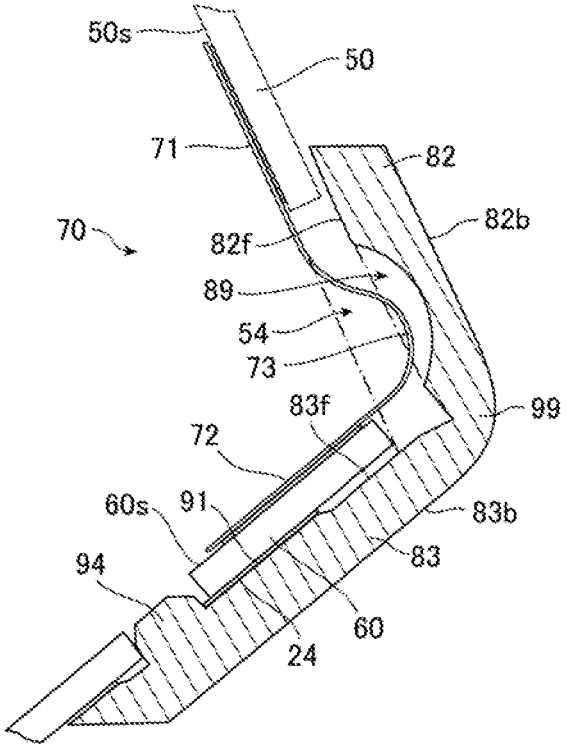
FIG. 12 is a schematic cross-sectional view passing through the flexible printed circuit board in FIG. 10.

In the present embodiment, the two flexible printed circuit boards 70 are substantially in the same state when the first substrate 50 and the second substrate 60 are placed on the heat sink 80. Therefore, in the following, one of them will be described and the other will be omitted. FIG. 12 is a schematic cross-sectional view through the flexible printed circuit board in FIG. 10, and is a schematic cross-sectional view parallel to the longitudinal direction of the band part 73 of the flexible printed circuit board 70. As described above, the first connection part 71 is joined onto the mounting surface 50*s* of the first substrate 50 on which the first light emitting element 55 is mounted, and the second connection part 72 is joined onto the mounting surface 60*s* of the second substrate 60 on which the second light emitting element 63 is mounted. Therefore, the first connection part 71 is connected to the side of the first substrate 50 opposite to the first placement surface 86, and the second connection part 72 is connected to the side of the second substrate 60 opposite to the second placement surface 91. Furthermore, as shown in FIG. 11, the band part 73 of the flexible printed circuit board 70 is recessed toward the heat sink 80 side on the first substrate 50 side with respect to the first connection part 71 in between the first substrate 50 and the second substrate 60. In the present embodiment, the band part 73 of the flexible printed circuit board 70 passes through a region closer to the first placement surface 86 side than the first connection part 71, and also passes through the notch 54 in the first substrate 50. Furthermore, the recess 89 in the heat sink 80 is recessed in an arc shape in the vertical cross section, and is recessed on the side opposite to the flexible printed circuit board 70 side with respect to the first placement surface 86. The band part 73 of the flexible printed circuit board 70 also passes through the recess 89. The flexible printed circuit board 70 that bends in this way is not in contact with the heat sink 80. By the way, for example, due to dimensional errors in the first substrate 50, the second substrate 60, the heat sink 80, and the like, the first substrate 50 and the second substrate 60 are displaced in the right and left direction which is a direction perpendicular to the longitudinal direction of the band part 73 to apply a stress to the band part 73 in the right and left direction, in some cases. However, as described above, by forming the slit 73*s* in the band part 73, the rigidity of the band part 73 particularly in the direction perpendicular to the longitudinal direction is reduced as compared with the case where the slit 73*s* is not formed. Therefore, even if a stress in the right and left direction occurs in the band part 73, the stress acting on the first connection part and the second connection part can be reduced as compared with the case where the slit 73*s* is not formed, which may suppress a problem.

Next, the reflector unit 40 will be described.

Figure 13:
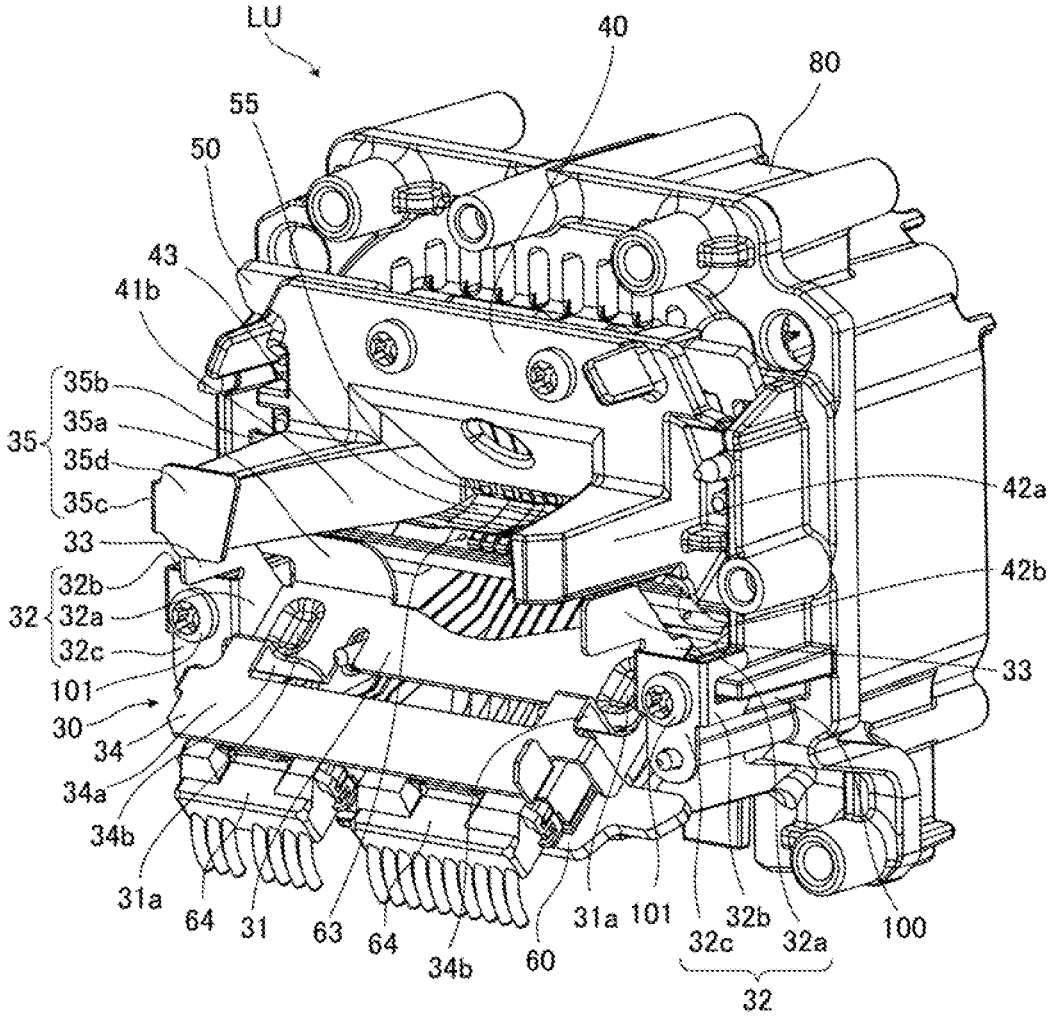
FIG. 13 is a perspective view of a light source unit.
Figure 14:
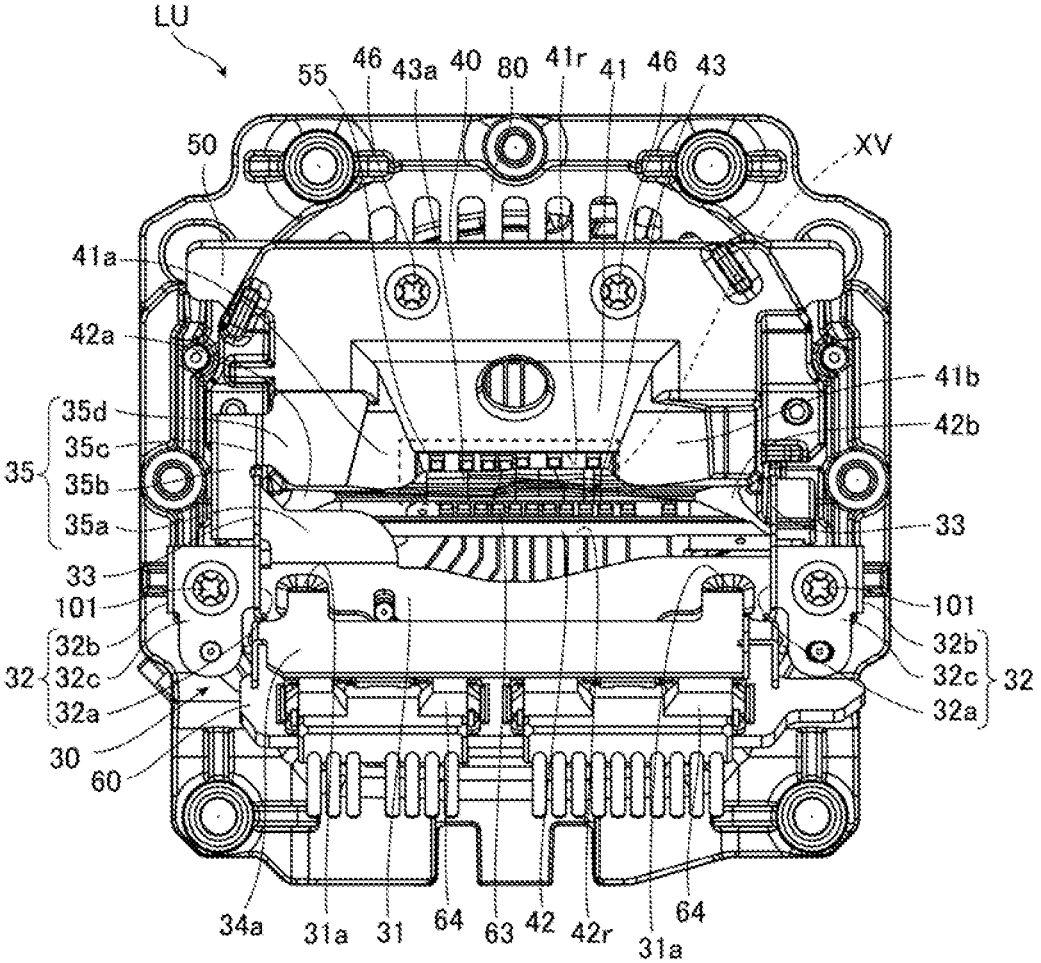
FIG. 14 is a front view of the light source unit.
Figure 15:
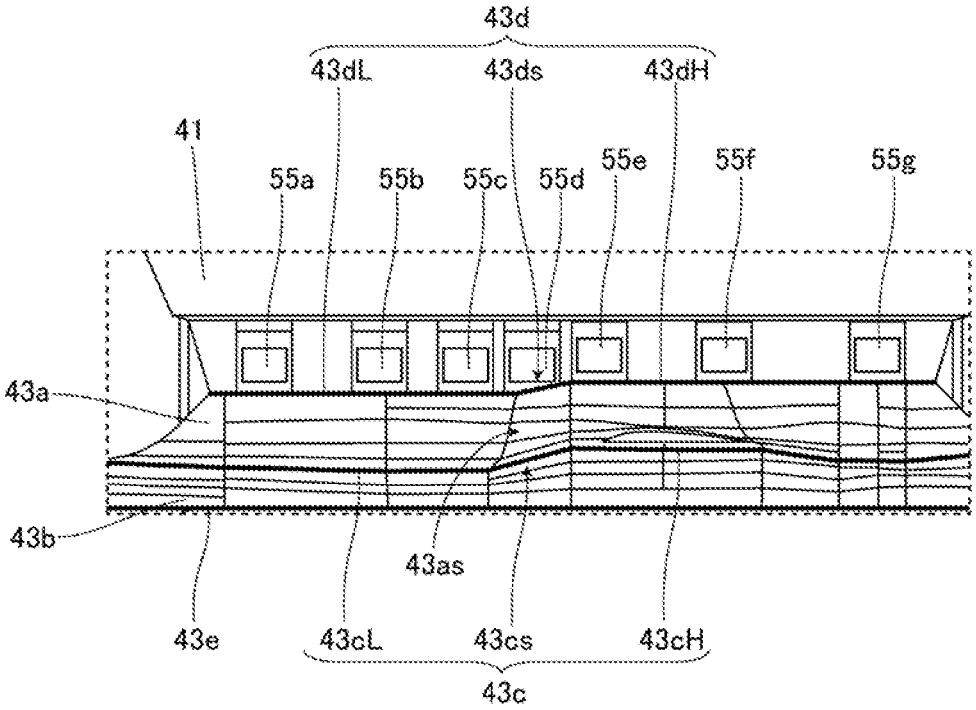
FIG. 15 is an enlarged view showing a portion surrounded by a broken line XV in FIG. 14.
Figure 16:
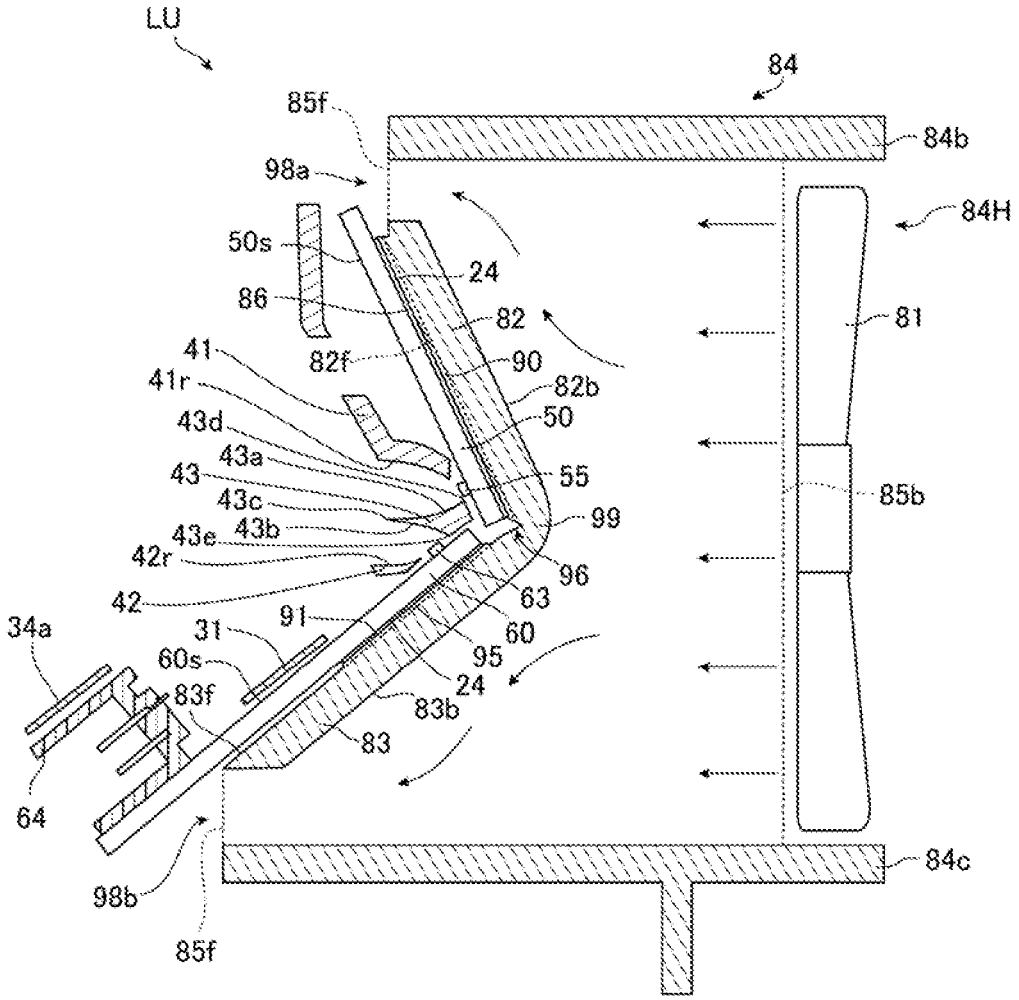
FIG. 16 is a schematic cross-sectional view of the light source unit.

FIG. 13 is a perspective view of the light source unit, FIG. 14 is a front view of the light source unit, FIG. 15 is an enlarged view of a portion surrounded by a broken line XV in FIG. 14, and FIG. 16 is a schematic cross-sectional view of the light source unit. As shown in FIGS. 13 and 14, the reflector unit 40 includes a reflector 41 for the first light emitting element 55, a first side reflector 41*a* for the first light emitting element 55, a second side reflector 41*b* for the first light emitting element 55, a reflector 42 for the second light emitting element 63, a first side reflector 42*a* for the second light emitting element 63, a second side reflector 42*b* for the second light emitting element 63, and a shade 43 as main components.

The reflector unit 40 is arranged on the side opposite to the heat sink 80 side with respect to the first substrate 50. The reflector unit 40 is fixed to the heat sink 80 so that the first substrate 50 is sandwiched between the reflector unit 40 and the heat sink 80. In the present embodiment, two screws 46 are used to fix the reflector unit 40 to the heat sink 80.

The reflector unit 40 also has ribs 44, as shown in FIG. 4. The rib 44 extends toward the first substrate 50, and a part of the end of the rib 44 on the first substrate 50 side contacts the mounting surface 50*s* on which the first light emitting element 55 of the first substrate 50 is mounted. Therefore, the first substrate 50 is pressed against the first placement surface 86 of the heat sink 80 by the reflector unit 40 and fixed to the heat sink 80. In the present embodiment, the reflector unit 40 has a plurality of ribs 44, and when the first substrate 50 is viewed in a plan view, the contact portion of the rib 44 with the first substrate 50 overlaps with the first placement surface 86. Therefore, the first substrate 50 can be pressed against the first placement surface 86 more appropriately, and the relative position of the first substrate 50 with respect to the heat sink 80 is suppressed from changing due to vibration or the like.

By the way, in the present embodiment, since the surface of the first substrate 50 opposite to the side on which the first light emitting element 55 is mounted is coated with grease as a flow member, as shown in FIG. 14, the grease 24 is interposed between the first substrate 50 and the first placement surface 86. Therefore, when the first substrate 50 is pressed against the first placement surface 86, part of the grease 24 is extruded from between the first substrate 50 and the first placement surface 86 in some cases. As described above, the first placement surface 86 is the end surface of the pedestal 90 projecting forward from the front surface 82*f* of the first base plate 82, and the outer edge of the first placement surface 86 is surrounded by the outer edge of the first substrate 50. Therefore, the excess grease 24 extruded from between the first substrate 50 and the first placement surface 86 is extruded on the front surface 82*f* of the first base plate 82 around the pedestal 90. Accordingly, part of the excess grease 24 is prevented from being adhered to the mounting surface 50*s* of the first substrate 50 on which the first light emitting element 55 is mounted, and adhered to the first light emitting element 55.

As shown in FIGS. 14 to 16, the shade 43 extends forward from between the first light emitting element 55 and the second light emitting element 63. Furthermore, the upper surface of the shade 43 has a first reflection surface 43*a* that reflects part of the first light such that part of the first light emitted from the first light emitting element 55 is transmitted through the projection lens 20.

The first reflection surface 43*a* is a reflection surface that extends forward from the first light emitting element 55 side and is recessed downward in a vertical surface parallel to the front and rear direction. Furthermore, the front end of the first reflection surface 43*a*, that is, the front end 43*c* of the shade 43, has a step 43*cs* in the up and down direction as shown in FIG. 15. Note that in FIG. 15, the front end 43*c* of the shade 43 is indicated by a thick line for ease of viewing. The step 43*cs* formed at the front end 43*c* of the shade 43 is formed corresponding to the shape of the cut line of the low beam light distribution pattern described later. The step 43*cs* of the present embodiment is formed near the center of the front end 43*c* in the right and left direction. It is preferable that the front end 43*c* of the shade 43 is formed so that one side in the right and left direction is lower than the another side with respect to the step 43*cs*. In the present embodiment, specifically, a part 43*c*L of the front end 43*c* on the left side of the step 43*cs* is lower than a part 43*c*H of the front end 43*c* on the right side of the step 43*cs*. The step 43*cs* is formed in a diagonal line between the part 43*c*L on the left side of the step 43*cs* and the part 43*c*H on the right side of the step 43*cs*.

Furthermore, when viewed from the front, the specific first light emitting element 55*d* and the step 43*cs* of the front end 43*c* of the shade 43 are arranged so as to overlap with each other in the up and down direction. Note that, as described above, the plurality of first light emitting elements 55*a* to 55*c* arranged on one side in the right and left direction with reference to a specific first light emitting element 55*d* are provided at lower positions than the plurality of first light emitting elements 55*e* to 55*g* arranged on another side. Accordingly, when viewed from the front, the first light emitting elements 55*a* to 55*c* arranged at relatively low positions overlap, in the up and down direction, with the part 43*c*L of the front end 43*c* which is formed relatively low among the front ends 43*c* of the shade 43. Furthermore, when viewed from the front, the first light emitting elements 55*e* to 55*g* arranged at relatively high positions overlap, in the up and down direction, with the part 43*c*H of the front end 43*c* which is formed relatively high among the front ends 43*c* of the shade 43.

Furthermore, although not clearly shown, the front end 43*c* of the shade 43 is gradually recessed rearward from the right and left ends toward the center to form the cut line of the light distribution pattern of the low beam.

The rear end 43*d* of the first reflection surface 43*a* has a step 43*ds* in the up and down direction as shown in FIG. 15. Note that in FIG. 15, the rear end 43*d* of the first reflection surface 43*a* is indicated by a thick line for ease of viewing. The step 43*ds* formed at the rear end 43*d* of the first reflection surface 43*a* is formed corresponding to the shape of the cut line of the low beam light distribution pattern described later. The step 43*cs* of the present embodiment is formed in the vicinity of the center in the right and left direction and overlaps with the step 43*cs* of the front end 43*c* of the shade 43 in the up and down direction in a front view. As Similar to the step 43*cs* of the front end 43*c* of the shade 43, in the front view, the rear end 43*d* of the first reflection surface 43*a* is formed such that the part 43*d*H on the right side of the step 43*ds* is higher than the part 43*d*L on the left side. Furthermore, in a front view, the specific first light emitting element 55*d* overlaps with the step 43*ds* in the up and down direction. The step 43*ds* is formed in a diagonal line between the part 43*d*L on the left side of the step 43*ds* and the part 43*d*H on the right side of the step 43*cs*. Furthermore, the step 43*ds* of the present embodiment is formed longer than the step 43*cs*.

By forming a step at each of the front end 43*c* of the shade 43 and the rear end 43*d* of the first reflection surface 43*a* as described above, the first reflection surface 43*a* has a protrusion surface part 43*as* that protrudes upward extending in the front and rear direction. Furthermore, since the step 43*ds* of the present embodiment is formed longer than the step 43*cs*, the width of the protrusion surface part 43*as* becomes wider from the rear side toward the front side. The protrusion surface part 43*as* has a shape corresponding to the light distribution pattern of the low beam.

Furthermore, the lower surface of the shade 43 has a second reflection surface 43*b* that reflects part of the second light such that part of the second light emitted from the second light emitting element 63 is transmitted through the projection lens 20. The second reflection surface 43*b* is a recessed reflection surface that extends forward from the second light emitting element 63 side and reflects part of the second light forward. As shown in FIG. 15, the rear end 43*e* of the second reflection surface 43*b* is formed in a straight line in the right and left direction. Note that in FIG. 15, the rear end 43*e* of the second reflection surface 43*b* is indicated by a thick line for ease of viewing. The plurality of second light emitting elements 63 are arranged in a straight line along the rear end 43*e* of the second reflection surface 43*b* formed in a straight line.

The reflector 41 is arranged above the first light emitting element 55 and has, on the first light emitting element 55 side, a third reflection surface 41*r* that covers the upper side of the first light emitting element 55. The third reflection surface 41*r* and the first reflection surface 43*a* of the shade 43 form a pair of reflectors extending in the right and left direction and sandwiching the first light emitting element 55 from above and below.

As shown in FIGS. 13 and 14, the first side reflector 41*a* is formed on one side with respect to the first light emitting element 55 in the right and left direction in the space sandwiched between the first reflection surface 43*a* of the shade 43 and the third reflection surface 41*r* of the reflector 41. Furthermore, the second side reflector 41*b* is formed on another side with respect to the first light emitting element 55 in the space. The first side reflector 41*a* and the second side reflector 41*b* are formed such that the interval between them widens from the rear side toward the front side.

As shown in FIG. 16, the reflector 42 is arranged below the second light emitting element 63 and has, on the second light emitting element 63 side, a fourth reflection surface 42*r* that covers the lower side of the second light emitting element 63. The fourth reflection surface 42*r* and the second reflection surface 43*b* of the shade 43 form a pair of reflectors extending in the right and left direction and sandwiching the second light emitting element 63 from above and below.

As shown in FIGS. 13 and 14, the first side reflector 42*a* is formed on one side with respect to the second light emitting element 63 in the right and left direction in the space sandwiched between the second reflection surface 43*b* of the shade 43 and the fourth reflection surface 42*r* of the reflector 42. Furthermore, the second side reflector 42*b* is formed on another side with respect to the second light emitting element 63 in the space. The first side reflector 42*a* and the second side reflector 42*b* are formed such that the interval between them widens from the rear side toward the front side.

Next, the support plate 30 will be described.

Figure 17:
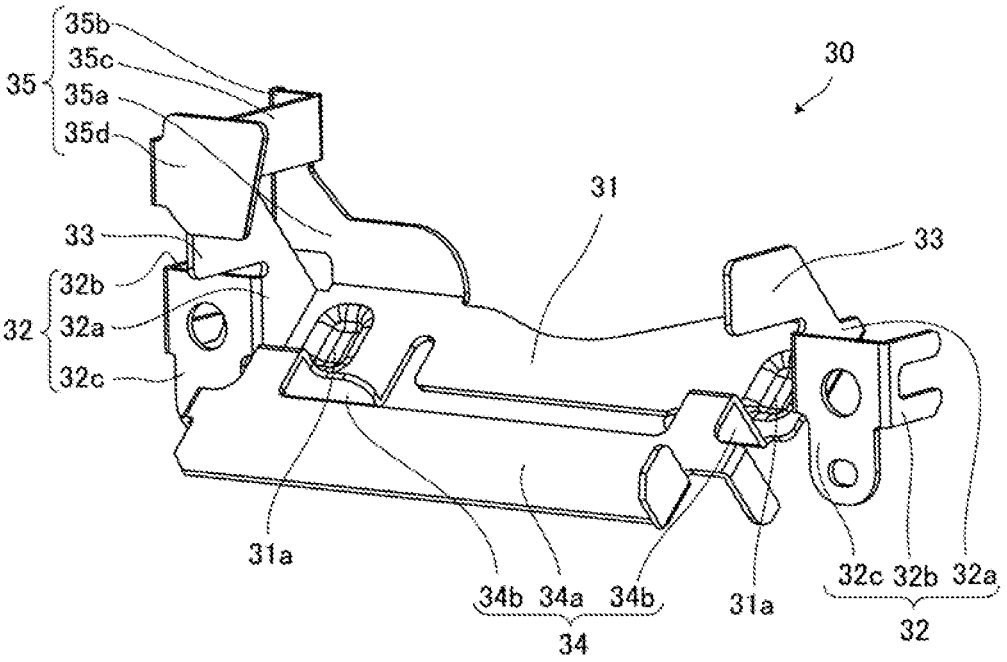
FIG. 17 is a perspective view of a support plate viewed from the front side.
Figure 18:
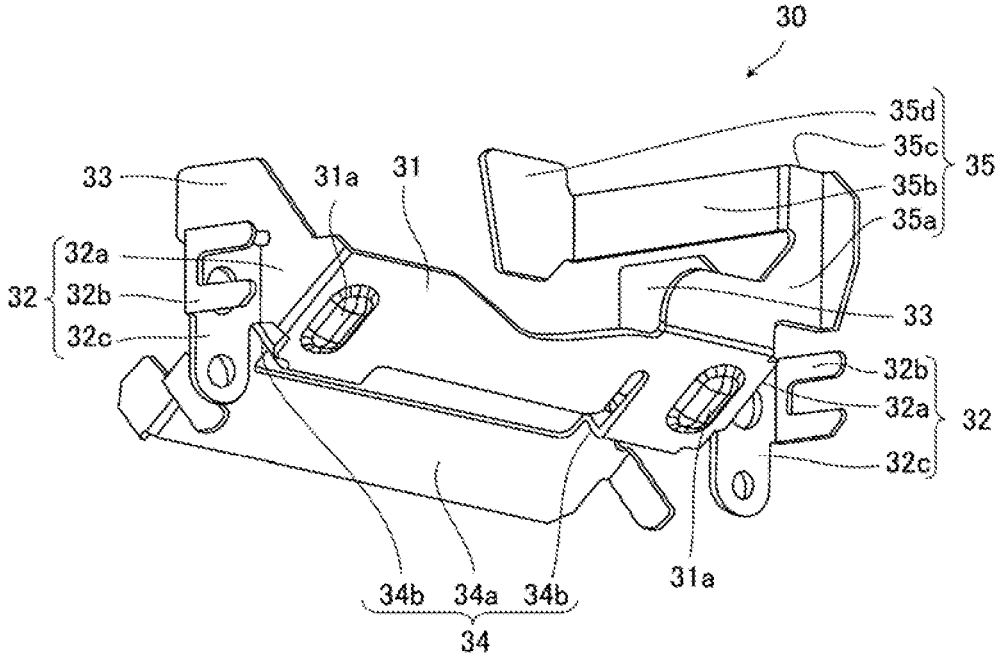
FIG. 18 is a perspective view of the support plate viewed from the rear side.

FIG. 17 is a perspective view of the support plate viewed from the front side, and FIG. 18 is a perspective view of the support plate viewed from the rear side. The support plate 30 has elasticity and, as shown in FIGS. 17 and 18, and has a base part 31, a pair of fixing parts 32, a pair of first light shielding parts 33, a second light shielding part 34, a third light shielding part 35. In the present embodiment, the base part 31, the pair of fixing parts 32, the pair of first light shielding parts 33, the second light shielding part 34, and the third light shielding part 35 are integrally formed by bending a metal plate. As shown in FIGS. 13 and 14, such a support plate 30 is fixed to the heat sink 80 so as to cover a part of the second substrate 60 from the mounting surface 60*s* side on which the second light emitting element 63 is mounted.

Figure 19:
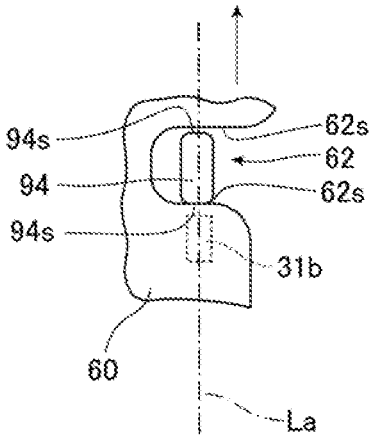
FIG. 19 is a diagram showing a state where the second substrate in FIG. 10 is viewed in a plan view.

The base part 31 is arranged on the side opposite to the heat sink 80 side with respect to the second substrate 60, and extends along the second substrate 60 between the connector 64 and the second light emitting element 63. The base part 31 has a protrusion part 31*a* that projects toward the second substrate 60 side and contacts the surface of the second substrate 60 opposite to the second placement surface 91 side. That is, the protrusion part 31*a* contacts the mounting surface 60*s* of the second substrate 60 on which the second light emitting element 63 is mounted. In the present embodiment, the base part 31 has two protrusion part 31*a*. FIG. 19 is a diagram showing a state in which the second substrate in FIG. 10 is viewed in a plan view, and is an enlarged view of the vicinity of the positioning recess part 62. As shown in FIGS. 7, 10, and 19, the contact parts 31*b* in contact with the two protrusion parts 31*a* on the mounting surface 60*s* of the second substrate 60 on which the second light emitting element 63 is mounted are located on the side opposite to the second light emitting element 63 side with respect to the positioning recess part 62 of the second substrate 60. Note that the number and position of the protrusion parts 31*a* on the support plate 30 are not particularly limited. In other words, the number and position of the contact parts 31*b* that contact the protrusion parts 31*a* on the second substrate 60 are not particularly limited.

One fixing part 32 of the pair of fixing parts 32 is coupled to one outer edge portion of the base part 31 in the right and left direction, as shown in FIGS. 17 and 18. The other fixing part 32 is coupled to the other outer edge portion of the base part 31 in the right and left direction. As shown in FIGS. 17 and 18, the pair of fixing parts 32 are fixed to the two bosses 100 of the heat sink 80 described above by screws 101, respectively.

The pair of fixing parts 32 has a substantially right and left symmetrical configuration, and has an inner side wall part 32*a*, an outer side wall part 32*b*, and a front wall part 32*c*. The inner side wall part 32*a* extends in a direction substantially orthogonal to the base part 31 on the side opposite to the second substrate 60 side with respect to the base part 31, and is coupled to the base part 31. The front wall part 32*c* is located in front of the inner side wall part 32*a* and on the opposite side of the inner side wall part 32*a* from the base part 31 side. The front wall part 32*c* is substantially orthogonal to the inner side wall part 32*a*, extends in a substantially vertical direction, and is coupled to the inner side wall part 32*a*. The outer side wall part 32*b* extends substantially parallel to the inner side wall part 32*a* behind the front wall part 32*c* and is coupled to the front wall part 32*c*. The front wall part 32*c* extends substantially in the vertical direction, and a through hole penetrating the front wall part 32*c* in the plate thickness direction is formed. As described above, since the second substrate 60 extends obliquely downward to the front, the base part 31 along the second substrate 60 also extends obliquely downward to the front. Therefore, the front wall part 32*c* of the fixing part 32 is not parallel to the base part 31. The boss 100 of the heat sink 80 is arranged in a space surrounded by the inner side wall part 32*a*, the outer side wall part 32*b*, and the front wall part 32*c* of the fixing part 32, and the fixing part 32 is fixed to the heat sink 80 by the screw 101.

The second light shielding part 34 is coupled to the outer edge portion of the base part 31 on the connector 64 side. The second light shielding part 34 has an upper wall part 34*a* and a pair of connection wall parts 34*b*. The upper wall part 34*a* is arranged above the connector 64 and extends substantially parallel to the base part 31. One of the connection wall parts 34*b* is coupled to one side of the outer edge portion of the base part 31 on the connector 64 side in the right and left direction and extends to the side opposite to the second substrate 60 side. The outer edge portion of the one connection wall part 34*b* opposite to the base part 31 side is connected to an outer edge portion of the upper wall part 34*a* on the second light emitting element 63 side. The other of the connection wall parts 34*b* is coupled to the other side of the outer edge portion of the base part 31 on the connector 64 side in the right and left direction and extends to the side opposite to the second substrate 60 side. The outer edge portion of the another connection wall part 34*b* opposite to the base part 31 side is connected to an outer edge portion of the upper wall part 34*a* on the second light emitting element 63 side. A part of the connector 64 on the side opposite to the second substrate 60 side is covered with the second light shielding part 34 as described above.

The third light shielding part 35 is coupled to the first side reflector 41*a* side for the first light emitting element 55, of the outer edge portion of the base part 31 on the second light emitting element 63 side. The third light shielding part 35 has a rear side wall part 35*a*, a folded back part 35*b*, a side wall part 35*c*, and a front side wall part 35*d*, and the front side wall part 35*d* shields part of the first light. The rear side wall part 35*a* is arranged on the first side reflector 41*a* side with respect to the first light emitting element 55 and the second light emitting element 63 on the side opposite to the second substrate 60 side with respect to the base part 31. The rear side wall part 35*a* extends in up and down and right and left directions, and is coupled to the base part 31. The folded back part 35*b* is arranged on the side opposite to the first light emitting element 55 side with respect to the first side reflector 41*a*, on the front side of the rear side wall part 35*a*. The folded back part 35*b* extends substantially parallel to the rear side wall part 35*a*, and the side opposite to the first side reflector 41*a* side is coupled to the rear side wall part 35*a*. The side wall part 35*c* is arranged on the side opposite to the first light emitting element 55 side with respect to the first side reflector 41*a*, on the front side with respect to the folded back part 35*b*. The side wall part 35*c* extends in a direction substantially parallel to the inner side wall part 32*a* of the fixing part 32, and is coupled to the folded back part 35*b* on the first side reflector 41*a* side. The front side wall part 35*d* is arranged on the first side reflector 41*a* side with respect to the first light emitting element 55 and the second light emitting element 63, on the front side with respect to the first side reflector 41*a*. The front side wall part 35*d* extends in up and down and right and left directions, and is coupled to the side wall part 35*c*. Such a front side wall part 35*d* shields part of the first light emitted from the first light emitting element.

Next, fixing the second substrate 60 to the heat sink 80 will be described in detail.

Figure 20:
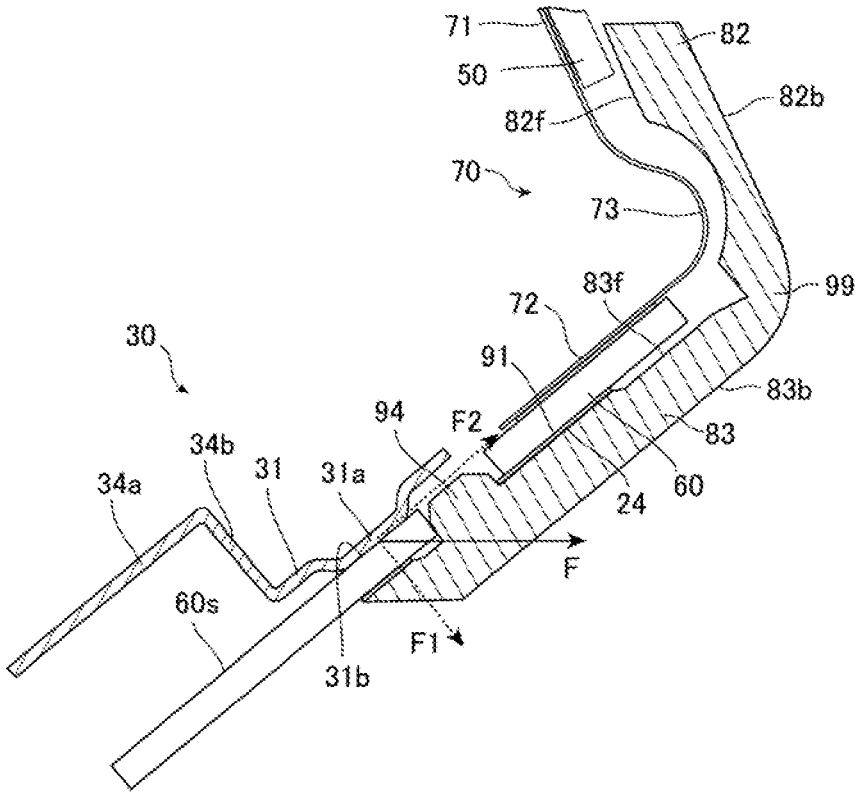
FIG. 20 is a diagram showing a situation where the second substrate is fixed to the heat sink.

FIG. 20 is a diagram showing a situation in which the second substrate is fixed to the heat sink, and is a cross-sectional view of the light source unit LU passing through the protrusion part 31*a* in the base part 31 of the support plate 30. Note that FIG. 20 shows the vicinity of the protrusion part 31*a*. As described above, the support plate 30 is fixed to the heat sink 80 by fixing the pair of fixing parts 32 to the two bosses 100 of the heat sink 80 by the screws 101. Specifically, the front wall part 32*c* in the fixing part 32 is formed such that the end surface of the boss 100 and the front wall part 32*c* are substantially parallel to each other and slightly separated from each other, in a state where the protrusion part 31*a* of the base part 31 is in contact with the second substrate 60 and the positions of the through hole of the front wall part 32*c* and the female screw 100*a* are aligned with each other. When the screw 101 is inserted into the through hole of the front wall part 32*c* and is screwed into the female screw 100*a*, the support plate 30 is fixed to the heat sink 80. At this time, the support plate 30 is pushed toward the heat sink 80 side by the screw 101 such that the gap between the end surface of the boss 100 and the front wall part 32*c* is narrowed. Here, since the front wall part 32*c* that is substantially parallel to the end surface of the boss 100 extends substantially in the vertical direction, the support plate 30 is pushed backward by the screw 101. As described above, the protrusion part 31*a* of the base part 31 is in contact with the mounting surface 60*s* of the second substrate 60 on which the second light emitting element 63 is mounted. Therefore, the support plate 30 is elastically deformed, and the elastic force of the support plate 30 acts on the contact part 31*b* of the second substrate 60. Since the support plate 30 is pushed rearward, the elastic force F of the support plate 30 acting on the contact part 31*b* is directed rearward as shown in FIG. 20. The elastic force F of the support plate 30 fixes the second substrate 60 to the heat sink 80. Here, as described above, since the second substrate 60 placed on the second placement surface 91 extends obliquely downward to the front, the direction in which the support plate 30 is pushed and the mounting surface 60*s* on which the second light emitting element 63 is mounted in the second substrate 60 is non-perpendicular and non-parallel to each other. Therefore, the direction of the elastic force F of the support plate 30 is non-perpendicular and non-parallel to the mounting surface 60*s* in the second substrate 60. Therefore, the elastic force F of the support plate 30 is composed of a force F1 in the direction perpendicular to the second placement surface 91 and a force F2 along the second placement surface 91. Note that since the second substrate placed on the second placement surface 91 extends obliquely downward to the front, the force F2 of the elastic force F of the support plate 30 along the second placement surface 91 is directed upward.

The second substrate 60 is pressed against the second placement surface 91 by the force F1 of the elastic force F of the support plate 30 in the direction perpendicular to the second placement surface 91. Furthermore, the second substrate 60 is pushed upward along the second placement surface 91 by the force F2 along the second placement surface 91 of the elastic force F of the support plate 30, and a part of the side surface of the second substrate 60 is pressed against the outer peripheral surface of the projection 94 of the heat sink 80. More specifically, as shown in FIG. 19, the lower second abutting surface 62*s* of the positioning recess part 62 of the second substrate 60 is pressed against the lower abutting surface 94*s* of the projection 94 of the heat sink 80. That is, the force F2 along the second placement surface 91 of the elastic force F of the support plate 30 is a force that presses the second substrate 60 against the lower abutting surface 94*s* of the projection 94. As described above, the second substrate 60 is pressed against the lower abutting surface 94*s* of the projection 94, and the second substrate 60 is prevented from being displaced along the second placement surface 91 in the direction opposite to the pressing direction with respect to the abutting surface 94*s*.

In the present embodiment, as described above, the two contact parts 31*b* that contact each other are located on the side opposite to the second light emitting element 63 side with respect to the positioning recess part 62 of the second substrate 60, and the projection 94 is inserted into the positioning recess part 62. That is, the lower abutting surface 94*s* of the projection 94 is located in the direction of the force F2 in which the support plate 30 presses the second substrate 60 against the abutting surface 94*s* on the lower side in the projection 94 with respect to the contact part 31*b* when the second substrate 60 is viewed in a plan view. Furthermore, in the present embodiment, as shown in FIG. 7, the two contact parts 31*b* overlap with each other in the direction perpendicular to the direction of the force F2 of the support plate 30 pressing the second substrate 60 against the abutting surface 94*s* when the second substrate is viewed in a plan view. Furthermore, one contact part 31*b* corresponds to one projection 94, and another contact part 31*b* corresponds to another projection 94. More specifically, as shown in FIG. 19, at least a part of the abutting surface 94*s* on the lower side of the one projection 94 is located between a straight line La and a straight line Lb when the second substrate 60 is viewed in a plan view. The straight line La is a straight line parallel to the direction of the force F2 in which the support plate 30 presses the second substrate 60 against the abutting surface 94*s* when the second substrate 60 is viewed in a plan view and passing one end of one contact part 31*b* in the direction perpendicular to the direction. The straight line Lb is a straight line parallel to the straight line La and passing another end of the one contact part 31*b*. Furthermore, as shown in FIG. 7, at least a part of the abutting surface 94*s* on the lower side of the another projection 94 is located between a straight line Lc and a straight line Ld when the second substrate 60 is viewed in a plan view. Here, the positional relationship between the two projections 94 and the second substrate 60 indicated by broken lines in FIG. 7 is a positional relationship in which the second substrate 60 is fixed to the heat sink 80 by the elastic force of the support plate 30. The straight line Lc is a straight line parallel to the direction of the force F2 in which the support plate 30 presses the second substrate 60 against the abutting surface 94*s* when the second substrate 60 is viewed in a plan view and passing one end of another contact part 31*b* in the direction perpendicular to the direction. The straight line Ld is a straight line parallel to the straight line Lc and passing through another end of another contact part 31*b*.

By the way, the straight line La passing through the one contact part 31*b* is located on the side opposite to the another contact part 31*b* side. The straight line Lc passing through the another contact part 31*b* is located on the side opposite to the one contact part 31*b* side. These straight lines La and Lc are straight lines parallel to the direction of the force F2 in which the support plate 30 presses the second substrate 60 against the abutting surface 94*s* when the second substrate 60 is viewed in a plan view. Therefore, the straight line La is also a straight line parallel to the direction of the force F2 in which the support plate 30 presses the second substrate 60 against the abutting surface 94*s* when the second substrate 60 is viewed in a plan view, and passing an end opposite to the another contact part 31*b* side in the one contact part 31*b*. Furthermore, the straight line Lc is also a straight line parallel to the straight line La, and passing the end of the another contact part 31*b* on the side opposite to the one contact part 31*b* side. At least a part of the abutting surface 94*s* on the lower side of the one projection 94 and at least a part of the abutting surface 94*s* on the lower side in the another projection 94 are located between the straight line La and the straight line Lc.

Note that the straight line Lb passing the one contact part 31*b* is located on the another contact part 31*b* side, and the straight line Ld on the another contact part 31*b* is located on the one contact part 31*b* side. These straight lines Lb and Ld are straight lines parallel to the direction of the force F2 in which the support plate 30 presses the second substrate 60 against the abutting surface 94*s* when the second substrate 60 is viewed in a plan view. Therefore, the straight line Lb is also a straight line parallel to the direction of the force F2 in which the support plate 30 presses the second substrate 60 against the abutting surface 94*s* when the second substrate 60 is viewed in a plan view, and passing an end of the another contact part 31*b* side in the one contact part 31*b*. Furthermore, the straight line Ld is also a straight line parallel to the straight line Lb, and passing the end of the another contact part 31*b* on the side of the one contact part 31*b* side. The center of gravity 60G of the second substrate 60 is located between the straight line Lb and the straight line Ld. Therefore, the center of gravity 60G of the second substrate 60 is also located between the straight line La and the straight line Lc.

Furthermore, in the present embodiment, since the surface of the second substrate 60 opposite to the side on which the second light emitting element 63 is mounted is coated with grease 24 as a flow member, as shown in FIGS. 16 and 20, the grease 24 is interposed between the second substrate 60 and the second placement surface 91. Therefore, when the second substrate 60 is pressed against the second placement surface 91, part of the grease 24 is extruded from between the second substrate 60 and the second placement surface 91 in some cases. As described above, the second placement surface 91 is the end surface of the pedestal 95 projecting forward from the front surface 83*f* of the second base plate 83, and the outer edge of the second placement surface 91 is surrounded by the outer edge of the second substrate 60. Therefore, the excess grease 24 extruded from between the second substrate 60 and the second placement surface 91 is extruded on the front surface 83*f* of the second base plate 83 around the pedestal 95. Accordingly, part of the excess grease 24 is prevented from being adhered to the mounting surface 60*s* of the second substrate 60 on which the second light emitting element 63 is mounted, and adhered to the second light emitting element 63. Note that the flow member is not limited to grease. It is sufficient that the flow member is a member having a flowing property at least when the first substrate 50 is placed on the first placement surface 86 and when the second substrate 60 is placed on the second placement surface 91, and is not limited to a member having a constant flowing property. Therefore, the flow member includes an uncured type flow member such as grease or adhesive shown in the present embodiment that is uncured even after the first substrate 50 or the second substrate 60 is placed on the placement surfaces 86, 91, and a cured type flow member such as an adhesive formed of a thermosetting resin or the like that may be cured after the first substrate 50 and the second substrate 60 are placed on the placement surfaces. Furthermore, the flow member interposed between the first substrate 50 and the first placement surface 86 and the flow member interposed between the second substrate 60 and the second placement surface 91 may be similar members, or may be different members.

As described above, flow member recess part 96 is formed between the outer peripheral surface in the heat sink 80 on the lower side of the pedestal 90 and the front surface 83*f* of the second base plate 83 on the upper side of the pedestal 95. The outer edge 86*e* on the second placement surface 91 side among the outer edges of the first placement surface 86 is generally parallel to the outer edge 91*e* located on the first placement surface 86 side among the outer edges of the second placement surface 91 and extends in the right and left direction. The outer edge of the first placement surface 86 is surrounded by the outer edge of the first substrate 50, and the outer edge of the second placement surface 91 is surrounded by the outer edge of the second substrate 60. Therefore, the outer edge 86*e* on the second placement surface 91 side among the outer edges of the first placement surface 86 is the edge on the second substrate 60 side of the region in the first placement surface 86 that overlaps with the first substrate 50. The outer edge 91*e* located on the first placement surface 86 side among the outer edges of the second placement surface 91 is an edge on the first substrate 50 side of the region of the second placement surface 91 that overlaps with the second substrate 60. That is, the flow member recess part 96 is formed between the edge on the second substrate 60 side of the region in the first placement surface 86 overlapping with the first substrate 50, and the edge on the first substrate 50 side of the region in the second placement surface 91 overlapping with the second substrate 60. Therefore, among pieces of excess grease 24 extruded from between the first substrate 50 and the first placement surface 86, part of the grease 24 toward the second substrate 60 side may be accommodated in the flow member recess part 96. Furthermore, among pieces of excess grease 24 extruded from between the second substrate 60 and the second placement surface 91, part of the grease 24 toward the first substrate 50 side may be accommodated in the flow member recess part 96. That is, part of the excess grease 24 accumulated between the first substrate 50 and the second substrate 60 may be accommodated in the flow member recess part 96.

Furthermore, as described above, the outer edge 86*e* located at the lower end that is the second placement surface 91 side among the outer edges of the first placement surface 86 is generally parallel to the outer edge 91*e* located at the upper end that is the first placement surface 86 side among the outer edges of the second placement surface 91, and extends in the right and left direction. Therefore, the region sandwiched between the outer edge 86*e* and the outer edge 91*e* is a region in which the distance between the edge on the second substrate 60 side of the region in the first placement surface 86 overlapping with the first substrate 50, and the edge on the first substrate 50 side of the region in the second placement surface 91 overlapping with the second substrate 60 is minimum. At least a part of the flow member recess part 96 is located in this region.

Furthermore, as shown in FIG. 9, at least a part of the flow member recess part 96 is located between a first straight line Lf passing one end of a direction perpendicular to the direction from the first substrate 50 side in the first light emitting element 55 of the first substrate 50 toward the second substrate 60, and parallel to the direction from the first substrate 50 side to the second substrate 60 side, and a second straight line Ls passing another end and parallel to the first straight line Lf. That is, at least a part of the flow member recess part 96 is located between the first straight line Lf passing one end in the right and left direction in the first light emitting element 55 and parallel to the up and down direction, and the second straight line Ls passing the another end and parallel to the first straight line Lf. Furthermore, although not described with reference to the drawings, at least a part of the flow member recess part 96 is located between a straight line passing one end of a direction perpendicular to the direction from the first substrate 50 side in the second light emitting element 63 of the second substrate 60 toward the second substrate 60, and parallel to the direction from the first substrate 50 side to the second substrate 60 side, and another straight line passing another end and parallel to the straight line. That is, at least a part of the flow member recess part 96 is located between a straight line passing one end in the right and left direction of the second light emitting element 63 and parallel to the up and down direction, and another straight line passing another end and parallel to the straight line.

Next, the projection lens 20 will be described.

The projection lens 20 shown in FIGS. 1 to 4 is a plano-convex lens and is arranged in front of the light source unit LU. The first light and the second light emitted from the light source unit LU enter through the flat incident surface on the back surface side of the projection lens 20 and pass through the projection lens 20. The projection lens 20 has a flange part 21 on the outer circumference. Examples of the material forming the projection lens 20 include resin and glass.

Next, the lens holder 25 will be described.

The lens holder 25 shown in FIGS. 1 to 4 is arranged between the heat sink 80 and the projection lens 20. The projection lens 20 is fixed to the lens holder 25. By fixing the lens holder 25 to the heat sink 80, the relative positions of the projection lens 20, the lens holder 25, and the heat sink 80 are fixed. Furthermore, as described above, the reflector unit 40, the support plate 30, the first substrate 50, and the second substrate 60 are fixed to the heat sink 80. Therefore, the relative positions of the reflector unit 40, the support plate 30, the first substrate 50, the second substrate 60, the projection lens 20, and the lens holder 25 are also fixed.

The lens holder 25 has a cylindrical holding part 26 and a leg part 27. The lens holder 25 is made of, for example, resin, and the holding part 26 and the leg part 27 are integrally formed. The holding part 26 extends from the projection lens 20 side to the heat sink 80 side. The flange part 21 of the projection lens 20 is fixed to the end of the holding part 26 on the projection lens 20 side. The leg part 27 extends from the end portion of the holding part 26 on the heat sink 80 side to the heat sink 80 side. In the present embodiment, the lens holder 25 has three leg parts 27. The two leg parts 27 are arrayed in parallel in the right and left direction, and the other leg parts 27 are arranged above the two leg parts 27 arranged in parallel. The flange part 28 is formed at each end of the three leg parts 27 on the heat sink 80 side, and the flange part 28 is fixed to the heat sink 80 by a screw 29.

The two leg parts 27 arrayed in parallel among the three leg parts 27 fixed to the heat sink 80 as described above sandwiches the pair of first light shielding parts 33 of the support plate 30. Furthermore, as described above, since the pair of first light shielding parts 33 are coupled to the fixing parts 32 that are coupled to the right and left ends of the base part 31 of the support plate 30, respectively, the pair of first light shielding parts 33 are arrayed in parallel in the right and left direction. Therefore, one first light shielding part 33 is located between one leg part 27 of the two leg parts 27 arrayed in parallel to each other and the projection lens 20, and another first light shielding part 33 is located between another leg part 27 and the projection lens 20. By including such a first light shielding part 33, at least part of the incident sunlight that passes through the projection lens 20 is not applied to the leg part 27 of the lens holder 25, and is applied to the first light shielding part 33. Therefore, damage to the lens holder 25 due to sunlight is suppressed.

Furthermore, as described above, the upper wall part 34*a* of the second light shielding part 34 of the support plate 30 is arranged above the connector 64 and extends substantially parallel to the base part 31. Therefore, the upper wall part 34*a* of the second light shielding part 34 is located between the connector 64 and the projection lens 20. By including such a second light shielding part 34, at least part of incident sunlight that passes through the projection lens 20 is not applied to the connector 64 and is applied to the upper wall part 34*a* of the second light shielding part 34. Therefore, damage to the connector 64 due to sunlight is suppressed. Further, it becomes difficult to visually recognize the connector 64 through the projection lens 20, and the design of the lamp unit may be improved.

Next, the emission of light from the vehicular headlight 1 of the present embodiment will be described.

Figure 21:
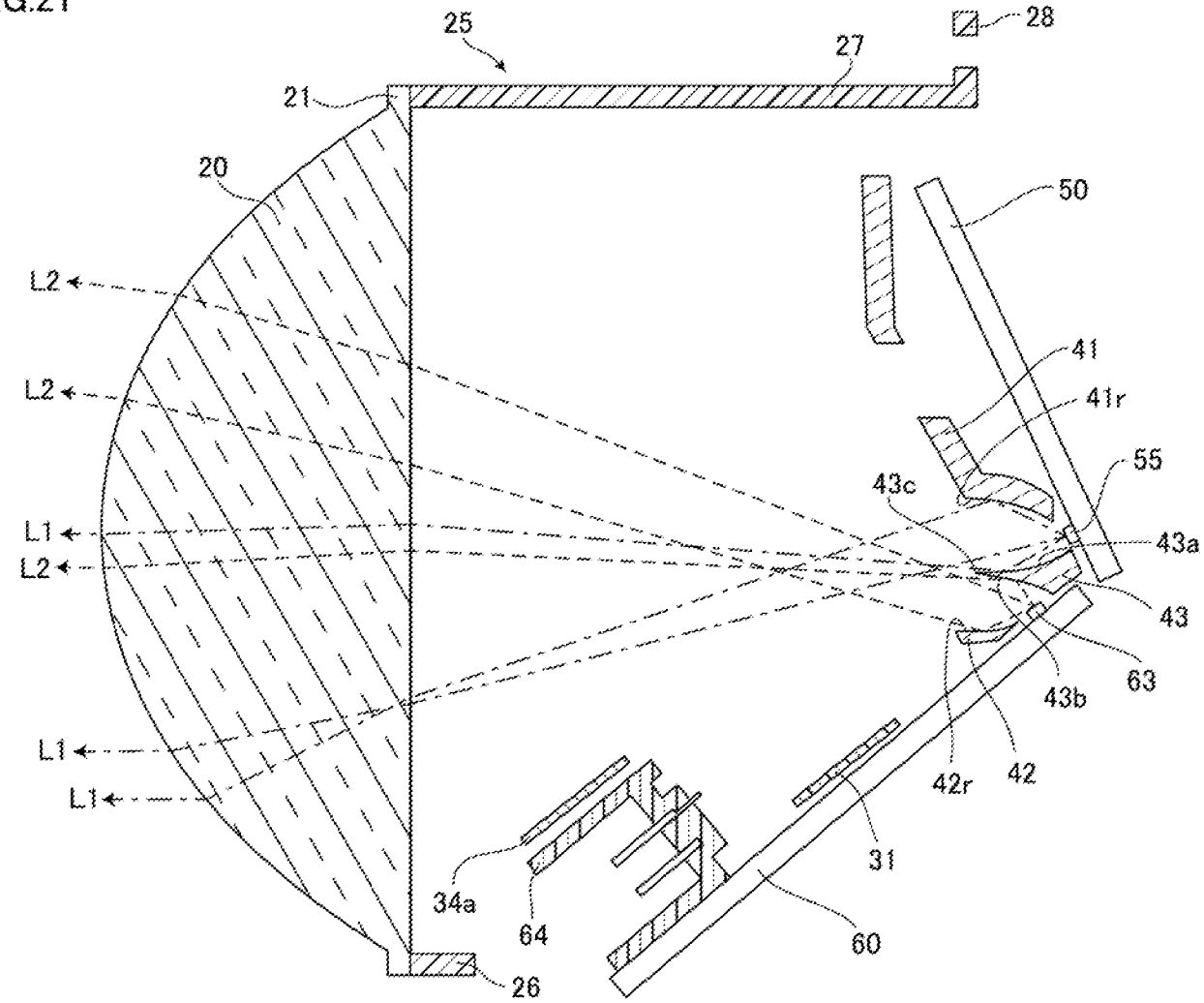
FIG. 21 is a schematic cross-sectional view of the lamp unit.

FIG. 21 is a schematic cross-sectional view of the lamp unit, and is a diagram schematically showing an example of optical paths of light emitted from the first light emitting element and the second light emitting element. Note that the heat sink 80, the fan 81, and the like are omitted in FIG. 21. Furthermore, the angle of each reflection surface, the reflection angle of light, the refraction angle, and the like may not be accurate. Furthermore, as described above, the vehicular headlights are provided symmetrically on the right and left sides of the vehicle. In the following description of light distribution, light distribution when the vehicular headlights provided on the right and left are similarly turned on or off will be described.

As shown in FIG. 21, part of the first light L1 emitted from the first light emitting element 55 is directly incident on the projection lens 20, and another part of the first light L1 is reflected by either the first reflection surface 43*a* of the shade 43 or the third reflection surface 41*r* of the reflector 41 and incident on the projection lens 20. By forming the front end 43*c* of the shade 43 as described above, the first light L1 passing the vicinity of the front end 43*c* of the shade 43 among pieces of the first light L1 incident on the projection lens 20 forms the cut line of the light distribution of the low beam. Furthermore, although not described with reference to the drawings, among pieces of the first light L1 emitted from the first light emitting element 55, part of the light diffused in the right and left direction is reflected by the first side reflector 41*a* and the second side reflector 41*b*, and incident on the projection lens 20. Furthermore, part of the light applied rearward from the front end 43*c* of the shade 43 among pieces of the first light L1 is shielded by the shade 43. Furthermore, part of pieces of light applied to the front side wall part 35*d* in the third light shielding part 35 of the support plate 30 among pieces of the first light L1 is shielded by the front side wall part 35*d*. As described above, the first light L1 emitted from the first light emitting element 55, incident on the projection lens 20 and transmitted therethrough, and emitted via the front cover 12 forms the light distribution of the low beam shown in FIG. 22A. Note that S in FIG. 22A indicates a horizontal line.

Furthermore, part of the second light L2 emitted from the second light emitting element 63 is directly incident on the projection lens 20, and another part of the second light L2 is reflected by either the second reflection surface 43*b* of the shade 43 or the fourth reflection surface 42*r* of the reflector 42 and incident on the projection lens 20. Furthermore, although not described with reference to the drawings, among pieces of the second light L2 emitted from the second light emitting element 63, part of the light diffused in the right and left direction is reflected by the first side reflector 42*a* and the second side reflector 42*b*, and incident on the projection lens 20. Furthermore, part of pieces of light applied to the front side wall part 35*d* in the third light shielding part 35 of the support plate 30 among pieces of the second light L2 is shielded by the front side wall part 35*d*. As described above, the light distribution by the second light L2 emitted from the second light emitting element 63, incident on the projection lens 20 and transmitted therethrough, and emitted via the front cover 12 and the light distribution of the low beam described above are combined to forms the light distribution of the high beam shown in FIG. 22B. Note that S in FIG. 22B indicates a horizontal line.

By the way, in the vehicular lamp disclosed in Patent Literature 1, and in this vehicular lamp, the light emitted from the first light source is emitted upward with respect to the optical axis of the projection lens. The light emitted from the first light source needs to be reflected forward by the first reflector so that the light emitted upward as described above is incident on the projection lens arranged in front of the first light source. The first reflector as described above is provided so as to greatly extend forward so as to cover the first light source. Similarly, the second reflector is also provided so as to greatly extend forward. However, when the first reflector and the second reflector are increased in size, the vehicular lamp tends to be increased in size.

On the other hand, the vehicular headlight 1 of the first embodiment includes the first light emitting element 55, the second light emitting element 63, the shade 43, and the projection lens 20. The shade 43 has the first reflection surface 43*a* on the upper surface and the second reflection surface 43*b* on the lower surface, and the front end 43*c* of the shade 43 has a step 43*cs* in the up and down direction corresponding to the shape of the cut line of the light distribution pattern of the low beam. In the vehicular headlight 1 of the present embodiment, part of the first light and part of the second light directly pass through the projection lens 20. That is, the part of the first light and the part of the second light are incident on the projection lens 20 without being reflected, and pass through the projection lens 20. As described above, since it is premised that the part of the first light and the part of the second light are directly incident on the projection lens 20, the vehicular headlight 1 described above does not require a large reflector such as one disclosed in Patent Literature 1 described above. Furthermore, the another part of the first light is reflected by the first reflection surface 43*a* of the shade 43 arranged below the first light emitting element 55 and incident on the projection lens 20, and the another part of the second light is reflected by the second reflection surface 43*b* of the shade 43 arranged above the second light emitting element 63 and incident on the projection lens 20. Therefore, the first light and the second light can be effectively used. Moreover, in the vehicular headlight 1, the cut line of the light distribution pattern of the low beam is formed by the front end 43*c* of the shade 43. As described above, in the vehicular headlight 1, the first light and the second light are efficiently incident on the projection lens 20 even if a large reflector is not used, and a cut line of light distribution of a low beam is formed. Accordingly, upsizing of the vehicular headlight 1 can be suppressed.

Furthermore, in the vehicular headlight 1 according to the first embodiment, a plurality of the first light emitting element 55 are provided in parallel in a right and left direction, and the plurality of first light emitting elements 55*a* to 55*c* arranged in one side of the right and left direction with reference to a specific one of the first light emitting elements 55*d*, and a plurality of the first light emitting elements 55*e* to 55*g* arranged in another side have different heights at which they are provided. When the low beam is applied to a vertical surface, the cut lines of the light distribution pattern of the low beam have different heights in one side and another side in the right and left direction with reference to a specific position.

Accordingly, it is preferable that front ends 43*c* of the shade 43 forming the cut line have different heights in one side and another side in the right and left direction with reference to the specific position. Here, by arranging the plurality of first light emitting elements 55 in different stages as described above, it becomes easy to match the position of the emission surface of each first light emitting element 55 with the height of the front end 43*c* of the shade 43. Therefore, the first light emitted from each first light emitting element 55 easily reaches near a front end 43*c* of the shade 43 forming the cut line of the light distribution pattern of the low beam, and the luminous intensity near the cut line in the light distribution pattern of the low beam may be increased.

Furthermore, in the vehicular headlight 1 of the first embodiment, the average interval between the specific first light emitting element 55*d* and the pair of first light emitting elements 55*c*, 55*e* arranged with the specific first light emitting element 55*d* interposed therebetween is narrower than the average interval of the other plurality of first light emitting elements 55*a*, 55*b*, 55*f*, 55*g* adjacent to each other. By adjusting the average interval of the plurality of first light emitting elements 55 as described above, the average interval of the first light emitting elements 55*c* to 55*e* arranged adjacent to each other in the vicinity of the center in the right and left direction may be made narrower than the average interval of the first light emitting elements 55*a* to 55*c* and the first light emitting elements 55*e* to 55*g* arranged adjacent to each other in both end sides in the right and left direction. Therefore, as compared with the case where the same number of first light emitting elements are arranged at equal intervals, the light distribution pattern of the low beam may spread in the right and left direction and the vicinity of the center of the light distribution pattern of the low beam may become bright.

Furthermore, in the vehicular headlight 1 of the first embodiment, the first reflection surface 43*a* on the upper surface of the shade 43 has the protrusion surface part 43*as* corresponding to the light distribution pattern of the low beam. When the low beam is applied to the road surface, the light distribution pattern of the low beam is formed such that the irradiation ranges of the light are different in one side and another side of the right and left direction. That is, the low beam has different light irradiation ranges on the opposite lane side and the opposite side thereof. By providing the protrusion surface part 43*as* on the first reflection surface 43*a* on the upper surface of the shade 43 as described above, a desired light distribution pattern of the low beam in which the light irradiation range is different between the right and left as described above can be formed.

Furthermore, in the vehicular headlight 1 of the first embodiment, when viewed from the front, the specific first light emitting element 55*d* and the step 43*cs* of the front end 43*c* of the shade 43 overlap with each other in the up and down direction. Furthermore, the first light emitting elements 55*a* to 55*c* arranged on one side in the right and left direction with reference to a specific first light emitting element 55*d* are provided at lower positions than the first light emitting elements 55*e* to 55*g* arranged on another side. Moreover, the front end 43*c* of the shade 43 is formed so that one side in the right and left direction is lower than the another side with respect to the step 43*cs*. By arranging the plurality of first light emitting elements 55 and forming the front end 43*c* of the shade 43 as described above, the plurality of first light emitting elements 55 may be arranged along the shape of the front end 43*c* of the shade 43. Therefore, the first light emitted from each first light emitting element 55 more easily reaches near the front end 43*c* of the shade 43 forming the cut line of the light distribution pattern of the low beam, and the luminous intensity near the cut line in the light distribution pattern of the low beam may be increased more.

Furthermore, in the vehicular headlight 1 of the first embodiment, the rear end 43*d* of the first reflection surface 43*a* formed on the upper surface of the shade 43 has a step corresponding to the shape of the cut line of the light distribution pattern of the low beam. Since the front end 43*c* of the shade 43 and the rear end 43*d* of the first reflection surface 43*a* on the upper surface of the shade 43 each have a step corresponding to the shape of the cut line of the light distribution of the low beam, the first light may more easily reach near the front end 43*c* of the shade. Therefore, in the low beam light distribution pattern, the luminous intensity near the cut line may be increased.

Furthermore, in the vehicular headlight 1 of the first embodiment, when viewed from the front, the step 43*cs* of the front end 43*c* of the shade 43 and the step 43*ds* of the rear end 43*d* of the first reflection surface 43*a* overlap with each other in the up and down direction. By forming the shade 43 as described above, the first light may more easily reach the vicinity of the front end 43*c* of the shade 43. Therefore, in the low beam light distribution pattern, the luminous intensity near the cut line may be increased.

Although the first aspect of the present invention has been described above with the first embodiment as an example, the first aspect is not limited to this.

For example, the number of first light emitting elements 55 is not particularly limited.

Furthermore, in the first embodiment described above, an example in which the plurality of first light emitting elements 55 are arranged at two levels of height has been described. That is, an example has been described in which the first light emitting elements 55*a* to 55*d* are arranged at the same height and the first light emitting elements 55*e* to 55*g* are arranged at the same height. However, the plurality of first light emitting elements 55 may be divided to be arranged in more stages of heights, or may be provided in a row at the same height. However, it is preferable that the plurality of first light emitting elements 55 are arranged along the shape of the front end 43*c* of the shade 43. Furthermore, it is preferable that the specific first light emitting element is arranged at a position overlapping or higher than a straight line passing the plurality of first light emitting elements arranged on one side in the right and left direction with respect to the specific first light emitting element, and at a position overlapping or lower than a straight line passing the plurality of first light emitting elements arranged on another side in the right and left direction. Accordingly, the first light emitting elements 55*a* to 55*c* may be arranged at the same height, the first light emitting elements 55*e* to 55*g* may be arranged at the same height, and the specific first light emitting element 55*d* may be arranged at a height intermediate between the first light emitting elements 55*a* to 55*c* and the first light emitting elements 55*e* to 55*g*.

Furthermore, in the first embodiment described above, an example in which the intervals between the plurality of first light emitting elements 55 are non-uniform has been described, but the plurality of first light emitting elements 55 may be arranged at equal intervals.

Furthermore, in the first embodiment, an example in which the rear end 43*d* of the first reflection surface 43*a* on the upper surface of the shade 43 has the step 43*ds* corresponding to the shape of the cut line of the light distribution pattern of the low beam has been described, but a step may not be formed at the rear end 43*d* of the first reflection surface 43*a*.

As described above, according to the first aspect of the invention, there is provided a vehicular headlight that may be prevented from being upsized, and the vehicular headlight is available in a field of a headlight for vehicle such as an automobile.

Second Embodiment

Next, a second aspect of the present invention will be described by taking a vehicular headlight according to a second embodiment as an example. Note that the same or equivalent constituent elements as those of the first embodiment are denoted by the same reference numerals, and redundant explanation will be omitted except when particularly described.

In the present embodiment, the number of the second light emitting elements 63 is larger than the number of the first light emitting elements 55, and twelve second light emitting elements 63 are provided. Furthermore, as described later, the second light emitting element 63 is arranged closer to the focus of the projection lens 20 with respect to the first light emitting element 55. Moreover, the average interval of the second light emitting elements 63 arranged in the central portion in the right and left direction is narrower than the average interval of the second light emitting elements 63 arranged in at least one end portion in the right and left direction. For example, when the plurality of second light emitting elements 63 arrayed in the right and left direction are equally divided into three groups, that is, a group at the left end, a group at the central portion, and a group at the right end, the average interval of the second light emitting element 63 in the group at the central portion is narrower than the average interval of the second light emitting elements 63 of at least one of the group at the left end and the group at the right end. In the present embodiment, as shown in FIG. 7, in a front view, the average interval of the second light emitting elements 63 arranged in the central portion in the right and left direction is narrower than the average interval of the second light emitting elements 63 arranged in the right end portion.

Figure 23:
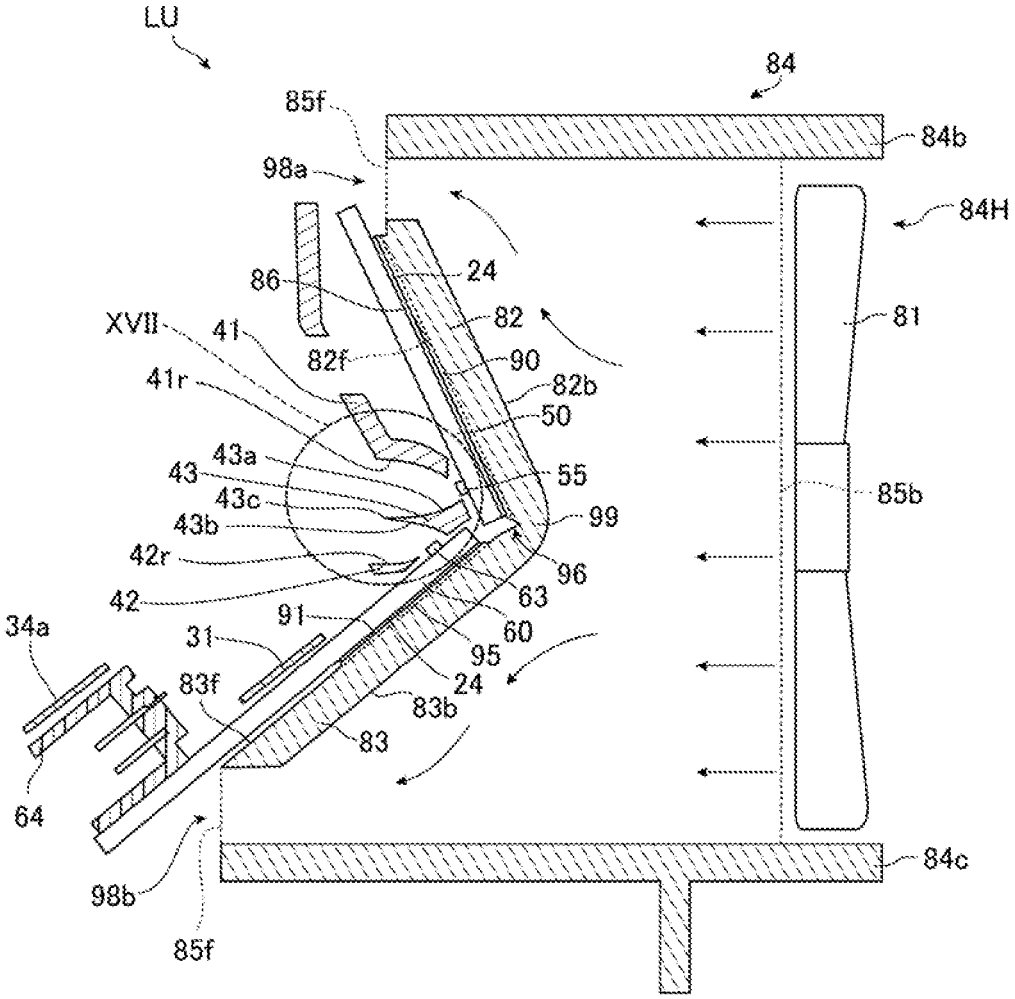
FIG. 23 is a view showing a light source unit according to a second embodiment of the present invention from the same viewpoint as FIG. 16.

FIG. 23 is a view showing a light source unit according to a second embodiment from the same viewpoint as FIG. 16. As shown in FIG. 23, the shade 43 is arranged between the first light emitting element 55 and the second light emitting element 63 in the up and down direction. The shade 43 of the present embodiment extends forward from between the first light emitting element 55 and the second light emitting element 63. In the present embodiment, part of the first light emitted by the first light emitting element 55 is applied to the upper surface of the shade 43, and the upper surface of the shade 43 has the first reflection surface 43*a* that reflects part of the first light to the focus of the projection lens 20. The first reflection surface 43*a* is a recessed reflection surface that extends forward from the first light emitting element 55 side and reflects part of the first light forward. Furthermore, in the present embodiment, part of the second light emitted by the second light emitting element 63 is applied to the lower surface of the shade 43, and the lower surface of the shade 43 has the second reflection surface 43*b* that reflects part of the second light to the focus of the projection lens 20. Furthermore, the front end 43*c* of the shade 43 has a shape conforming to a cut line described later, and is gradually recessed rearward from the right and left ends toward the center.

Figure 25:
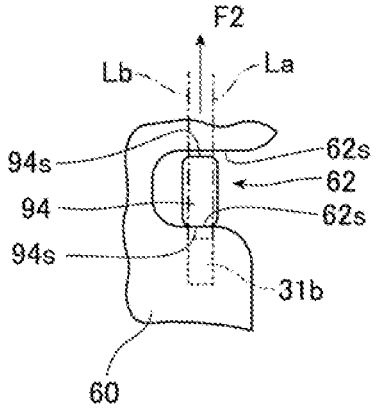
FIG. 25 is a view showing a second substrate according to the second embodiment of the present invention from the same viewpoint as FIG. 19.

FIG. 25 is a diagram showing the second substrate in the present embodiment from the similar viewpoint to that in FIG. 19, and is an enlarged view of the vicinity of the positioning recess part 62. As shown in FIGS. 7, 11, and 25, the contact parts 31*b* in contact with the two protrusion parts 31*a* on the mounting surface 60*s* of the second substrate 60 on which the second light emitting element 63 is mounted are located on the side opposite to the second light emitting element 63 side with respect to the positioning recess part 62 of the second substrate 60. Note that the number and position of the protrusion parts 31*a* on the support plate 30 are not particularly limited. In other words, the number and position of the contact parts 31*b* that contact the protrusion parts 31*a* on the second substrate 60 are not particularly limited.

In the present embodiment, the projection lens 20 shown in FIGS. 1 to 4 described above is a plano-convex lens and is arranged in front of the light source unit LU. That is, the projection lens 20 is arranged in front of the shade 43.

Figure 24:
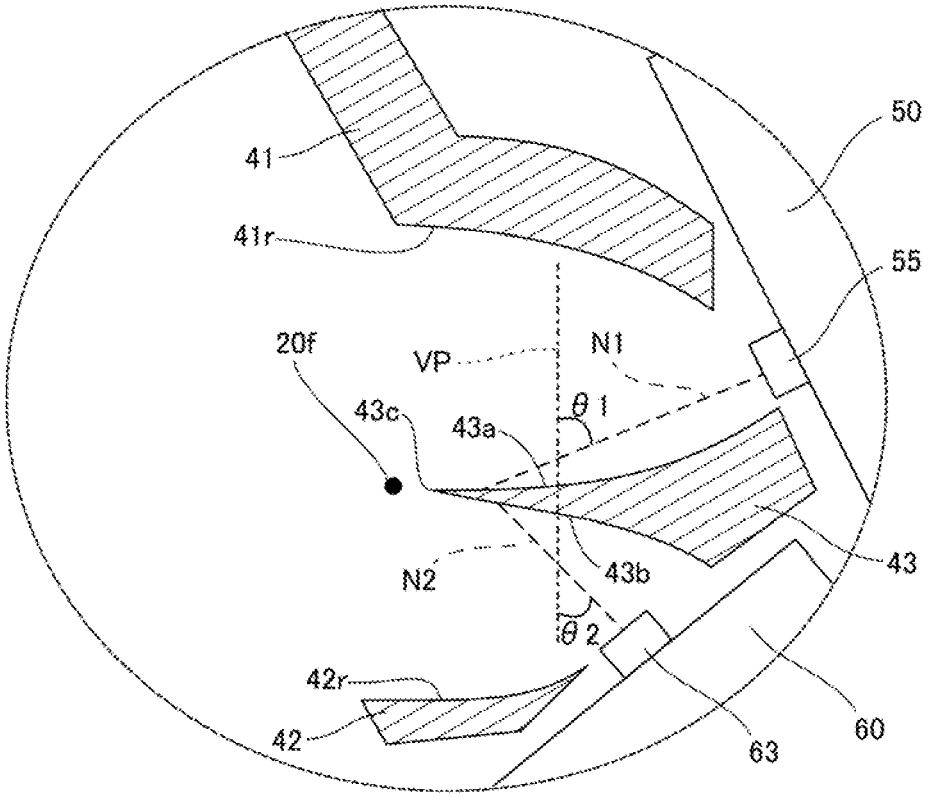
FIG. 24 is an enlarged view showing a portion surrounded by a broken line XVII in FIG. 23.

In the present embodiment, the focus of the projection lens 20 is located between the projection lens 20 and the front end 43*c* of the shade 43. FIG. 24 is an enlarged view showing a portion surrounded by a broken line XVII in FIG. 23. As shown in FIG. 24, the focus 20*f* of the projection lens 20 is located in front of the front end 43*c* of the shade 43.

Furthermore, as shown in FIG. 24, the second light emitting element 63 of the present embodiment is arranged at a position closer to the focus 20*f* of the projection lens 20 with respect to the first light emitting element 55. Specifically, the second light emitting element 63 of the present embodiment is arranged in front of the first light emitting element 55. That is, in the front and rear direction, the second light emitting element 63 of the present embodiment is arranged at a position closer to the focus 20*f* of the projection lens 20 with respect to the first light emitting element 55. However, in the up and down direction, the second light emitting element 63 of the present embodiment may be arranged at a position closer to the focus 20*f* of the projection lens 20 with respect to the first light emitting element 55. That is, the second light emitting element 63 may be arranged at a position closer to the horizontal surface passing the focus 20*f* of the projection lens 20 with respect to the first light emitting element 55. Moreover, the second light emitting element 63 of the present embodiment is arranged such that the normal line N2 of the emission surface of the second light emitting element 63 is closer to the vertical than the normal line N1 of the emission surface of the first light emitting element 55. That is, the first light emitting element 55 and the second light emitting element 63 are arranged such that an acute angle θ2 formed by the normal line N2 of the emission surface of the second light emitting element 63 and a vertical surface VP parallel to the right and left direction is smaller than an acute angle θ1 formed by the normal line N1 of the emission surface of the first light emitting element 55 and the vertical surface VP.

Figure 22A:
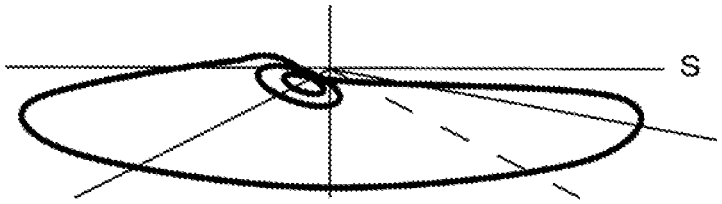
FIG. 22A and FIG. 22B are diagrams showing a light distribution pattern.
Figure 22B:
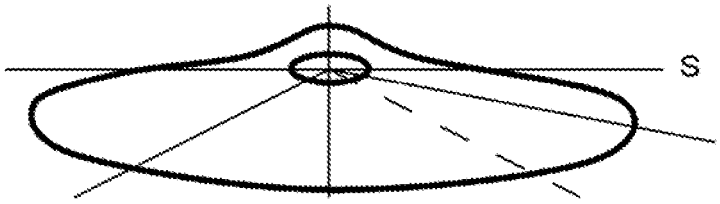
Figure 26:
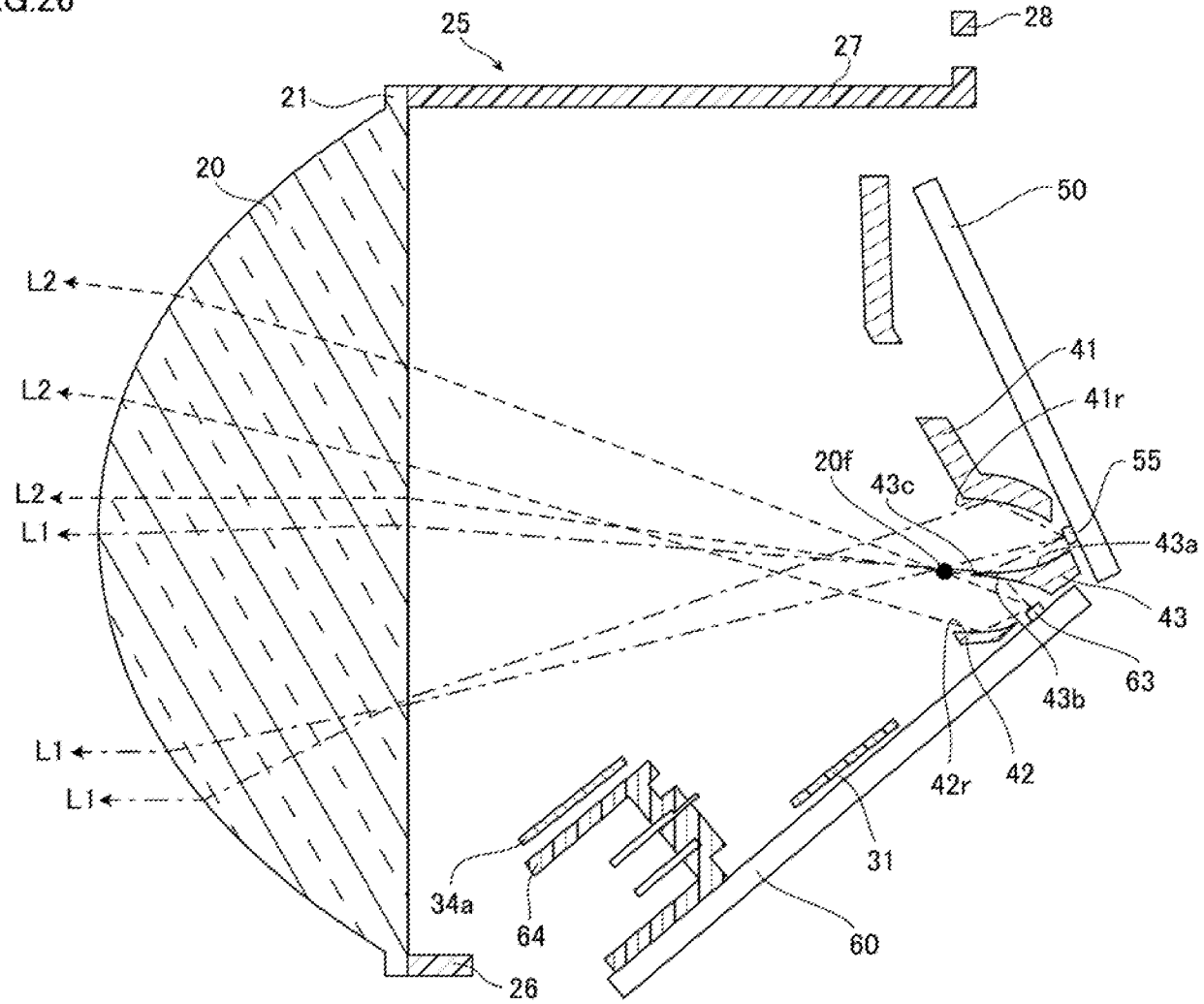
FIG. 26 is a view showing a lamp unit according to a second embodiment of the present invention from the same viewpoint as FIG. 21.

FIG. 26 is a view showing a lamp unit according to a second embodiment invention from the same viewpoint as FIG. 21. As shown in FIG. 26, part of the first light L1 emitted from the first light emitting element 55 passes the vicinity of the focus 20*f* of the projection lens 20 without being reflected and incident directly on the back surface side of the projection lens 20. Furthermore, the first light L1 that is another part of the first light L1, and is emitted from the center of the emission surface of the first light emitting element 55 along the normal line N1 shown in FIG. 24 is reflected by the first reflection surface 43*a* of the shade 43, passes the vicinity of the focus 20*f* of the projection lens 20, and is incident on the back surface side of the projection lens 20. Still another part of the first light L1 is reflected by the third reflection surface 41*r* of the reflector 41 and is incident on the back surface side of the projection lens 20. Furthermore, although not described with reference to the drawings, among pieces of the first light L1 emitted from the first light emitting element 55, part of the light diffused in the right and left direction is reflected by the first side reflector 41*a* and the second side reflector 41*b*, and incident on the back surface side of the projection lens 20. Note that part of pieces of light applied to the front side wall part 35*d* in the third light shielding part 35 of the support plate 30 among pieces of the first light L1 is shielded by the front side wall part 35*d*. As described above, at least part of the first light L1 that is incident from the flat incident surface on the back surface side of the projection lens 20 passes through the projection lens 20 and the front cover 12, and is applied to the front of the vehicle to form the light distribution pattern of the low beam as shown in FIG. 22A.

Furthermore, part of the second light L2 emitted from the second light emitting element 63 passes the vicinity of the focus 20*f* of the projection lens 20 without being reflected and incident directly on the back surface side of the projection lens 20. Furthermore, the second light L2 that is another part of the second light L2, and is emitted from the center of the emission surface of the second light emitting element 63 along the normal line N2 shown in FIG. 24 is reflected by the second reflection surface 43*b* of the shade 43, passes the vicinity of the focus 20*f* of the projection lens 20, and is incident on the back surface side of the projection lens 20. Still another part of the second light L2 is reflected by the fourth reflection surface 42*r* of the reflector 42 and is incident on the back surface side of the projection lens 20. Furthermore, although not described with reference to the drawings, among pieces of the second light L2 emitted from the second light emitting element 63, part of the light diffused in the right and left direction is reflected by the first side reflector 42*a* and the second side reflector 42*b*, and incident on the back surface side of the projection lens 20. Note that part of pieces of light applied to the front side wall part 35*d* in the third light shielding part 35 of the support plate 30 among pieces of the second light L2 is shielded by the front side wall part 35*d*. As described above, at least part of the second light L2 that is incident from the flat incident surface on the back surface side of the projection lens 20 passes through the projection lens 20 and the front cover 12, and is applied to the front of the vehicle. The light distribution of the second light L2 applied as described above and the light distribution of the low beam are combined to form the light distribution of the high beam shown in FIG. 22B.

By the way, in the vehicular lamp disclosed in Patent Literature 1, the light emitted from the first light source and reflected by the first reflector, and the light emitted from the second light source and reflected by the second reflector pass through the projection lens arranged in front of the first light source and the second light source, and are applied. In this vehicular lamp, the light emitted from the first light source is emitted upward with respect to the optical axis of the projection lens. The light emitted from the first light source needs to be reflected forward by the first reflector so that the light emitted upward as described above is incident on the projection lens arranged in front of the first light source. The first reflector as described above is provided so as to greatly extend forward so as to cover the first light source. Similarly, the second reflector is also provided so as to greatly extend forward. However, when the first reflector and the second reflector are increased in size, the vehicular lamp tends to be increased in size.

On the other hand, the vehicular headlight 1 of the second embodiment includes the first light emitting element 55, the second light emitting element 63, the shade 43, and the projection lens 20. The focus 20*f* of the projection lens 20 is located between the projection lens 20 and the front end 43*c* of the shade 43, and the second light emitting element 63 is arranged at a position closer to the focus 20*f* of the projection lens 20 with respect to the first light emitting element 55.

In the vehicular headlight 1 of the present embodiment as described above, part of the first light L1 and part of the second light L2 directly pass through the projection lens 20. That is, the part of the first light L1 and the part of the second light L2 are incident on the projection lens 20 without being reflected, and pass through the projection lens 20. As described above, since the first light emitting element 55 and the second light emitting element 63 are arranged such that the part of the first light L1 and the part of the second light L2 are directly incident on the projection lens 20, the vehicular headlight 1 described above does not require a large reflector such as one disclosed in Patent Literature 1 described above. Therefore, upsizing of the vehicular headlight 1 of the present embodiment may be suppressed.

Furthermore, in the vehicular headlight 1 of the second embodiment, the second light emitting element 63 is arranged closer to the focus 20*f* of the projection lens 20 with respect to the first light emitting element 55. Therefore, at the focus 20*f* of the projection lens 20, the luminous intensity of the second light L2 serving as the high beam may be easily increased more than the luminous intensity of the first light L1 serving as the low beam. Therefore, in the vehicular headlight 1 of the present embodiment, the maximum luminous intensity of the high beam emitted through the projection lens 20 and emitted forward may be increased more than the maximum luminous intensity of the low beam. On the other hand, by arranging the first light emitting element 55 at a position farther from the focus 20*f* of the projection lens 20 with respect to the second light emitting element 63, in the focal surface of the projection lens 20, the irradiation range of the first light L1 may be more easily widened than the irradiation range of the second light L2. Therefore, in the vehicular headlight 1 of the present embodiment, the irradiation range of the low beam may be wider than the irradiation range of the high beam.

In the vehicular headlight 1 of the second embodiment, the second light emitting element 63 is arranged such that the normal line N2 of the emission surface of the second light emitting element 63 is closer to the vertical than the normal line N1 of the emission surface of the first light emitting element 55, in front of the first light emitting element 55. By arranging the second light emitting element 63 in front of the first light emitting element 55, it is easier to bring the second light emitting element 63 closer to the focus 20*f* of the projection lens 20 with respect to the first light emitting element 55. Here, when the angle formed by the normal line N2 of the emission surface of the second light emitting element 63 and the vertical surface VP and the angle formed by the normal line N1 of the emission surface of the first light emitting element 55 and the vertical surface VP are approximately the same, either one of the first light and the second light is difficult to pass near the focus 20*f* of the projection lens 20. By arranging the second light emitting element 63 such that the normal line N2 of the emission surface of the second light emitting element 63 is closer to the vertical with respect to the normal line N1 of the emission surface of the first light emitting element, the first light emitting element 55 and the second light emitting element 63 may be arranged such that both the second light and the first light pass near the focus 20*f* of the projection lens 20. Therefore, in the vehicular headlight 1 of the present embodiment, the luminous intensity of the low beam and the high beam may be increased.

Furthermore, in the vehicular headlight 1 of the second embodiment, another part of the first light L1 is applied to the upper surface of the shade 43, and the upper surface of the shade 43 has the first reflection surface 43*a* that reflects the another part of the first light L1 to the focus 20*f* of the projection lens 20. By reflecting the another part of the first light L1 as described above, the first light L1 is collected at the focus 20*f* of the projection lens 20, and the luminous intensity of the low beam may be increased more.

Furthermore, in the vehicular headlight 1 of the second embodiment, another part of the second light 12 is applied to the lower surface of the shade 43, and the lower surface of the shade 43 has the second reflection surface 43*b* that reflects the another part of the second light L2 to the focus 20*f* of the projection lens 20. By reflecting the another part of the second light L2 as described above, the second light L2 is collected at the focus 20*f* of the projection lens 20, and the luminous intensity of the high beam may be increased more.

Furthermore, in the vehicular headlight 1 of the second embodiment, a plurality of the second light emitting elements 63 are provided in parallel in the right and left direction, an average interval of the second light emitting elements 63 arranged in the central portion in the right and left direction is narrower than an average interval of the second light emitting elements 63 arranged at least at one end in the right and left direction. By adjusting the average interval of the plurality of second light emitting elements 63 as described above, the maximum luminous intensity near the center of the high beam may be increased as compared with the case where the same number of second light emitting elements 63 are arranged at equal intervals.

Although the second aspect of the present invention has been described above with the second embodiment as an example, the second aspect is not limited to this.

For example, in the second embodiment, the first light emitting element 55 and the second light emitting element 63 are arranged such that an acute angle θ2 formed by the normal line N2 of the emission surface of the second light emitting element 63 and a vertical surface VP parallel to the right and left direction is smaller than an acute angle θ1 formed by the normal line N1 of the emission surface of the first light emitting element 55 and the vertical surface VP, but the sizes of the acute angle θ2 and the acute angle θ1 are not particularly limited. However, by making the acute angle θ1 and the acute angle θ2 different from each other, the first light emitting element 55 and the second light emitting element 63 may be arranged so that the second light L2 and the first light L1 both pass near the focus 20*f* of the projection lens 20. Therefore, the luminous intensity of the low beam and the high beam may be increased.

Furthermore, in the second embodiment, an example has been described in which the first light L1 emitted along the normal line N1 of the emission surface of the first light emitting element 55 is reflected by the first reflection surface 43*a* of the shade 43 and passes the focus 20*f* of the projection lens 20. However, the first light L1 emitted along the normal line N1 of the emission surface of the first light emitting element 55 may not be reflected by the first reflection surface 43*a* of the shade 43. For example, the first light L1 emitted along the normal line N1 of the emission surface of the first light emitting element 55 may pass the vicinity of the focus 20*f* of the projection lens 20 and be incident on the back surface side of the projection lens 20 without being reflected. Note that the first reflection surface 43*a* is not an essential component.

Furthermore, in the second embodiment, an example has been described in which the second light L2 emitted along the normal line N2 of the emission surface of the second light emitting element 63 is reflected by the second reflection surface 43*b* of the shade 43 and passes the focus 20*f* of the projection lens 20. However, the second light L2 emitted along the normal line N2 of the emission surface of the second light emitting element 63 may not be reflected by the second reflection surface 43*b* of the shade 43. For example, the second light L2 emitted along the normal line N2 of the emission surface of the second light emitting element 63 may pass the vicinity of the focus 20*f* of the projection lens 20 and be incident on the back surface side of the projection lens 20 without being reflected. Note that the second reflection surface 43*b* is not an essential component.

As described above, according to the second aspect of the invention, there is provided a vehicular headlight that may be prevented from being upsized, and the vehicular headlight is available in a field of a headlight for vehicle such as an automobile.

Third Embodiment

Next, a third aspect of the present invention will be described by taking a vehicular headlight according to a third embodiment as an example. Note that the same or equivalent constituent elements as those of the first and second embodiments are denoted by the same reference numerals, and redundant explanation will be omitted except when particularly described.

In the present embodiment, the first light emitting element 55 emits the first light serving as a low beam with the normal line of the emission surface facing obliquely downward to the front. Examples of the first light emitting element 55 include an LED. In the present embodiment, the first light emitting element 55 is an LED array including a plurality of LEDs arranged in parallel in a direction perpendicular to the first abutting surface 51*s* when the first substrate 50 is viewed in a plan view. Note that the first light emitting element 55, the thermistor 56, the power feeding circuit 57, and the thermistor circuit 58 are insulated from the first substrate 50 by an insulating layer (not shown) provided on the surface of the first substrate 50.

In the present embodiment, the second light emitting element 63 is arranged below the first light emitting element 55, the normal line of the emission surface is directed obliquely upward to the front, and emits the second light serving as a high beam. Examples of the second light emitting element 63 include an LED. In the present embodiment, the second light emitting element 63 is an LED array including a plurality of LEDs arranged in parallel in a direction substantially perpendicular to the first abutting surface 61*s* when the second substrate 60 is viewed in a plan view.

As shown in FIG. 16 described above, the shade 43 is arranged between the first light emitting element 55 and the second light emitting element 63, and shields part of the first light emitted from the first light emitting element 55. Furthermore, the shade 43 has the first reflection surface 43*a* on the upper surface and the second reflection surface 43*b* on the lower surface. The first reflection surface 43*a* is a recessed reflection surface that extends forward from the first light emitting element 55 side and reflects part of the first light forward. The second reflection surface 43*b* is a recessed reflection surface that extends forward from the second light emitting element 63 side and reflects part of the second light emitted from the second light emitting element 63 forward. Furthermore, the front end 43*c* of the shade 43 has a shape conforming to a cut line described later, and is gradually recessed rearward from the right and left ends toward the center.

In the present embodiment, the projection lens 20 shown in FIGS. 1 to 4 described above is a plano-convex lens and is arranged in front of the light source unit LU. That is, the projection lens 20 is arranged in front of the shade 43. Part of the first light emitted from the first light emitting element 55 and part of the second light emitted from the second light emitting element 63 are directly incident on and transmitted through the projection lens 20. That is, the part of the first light and the part of the second light are incident on the back surface of the projection lens 20 without being reflected, and emitted from the front surface of the projection lens 20. Hereinafter, an incident surface of the back surface of the projection lens 20 and the emission surface of the front surface of the projection lens 20 may be referred to. Furthermore, the focus of the projection lens 20 is located between the projection lens 20 and the front end 43*c* of the shade 43.

Figure 27:
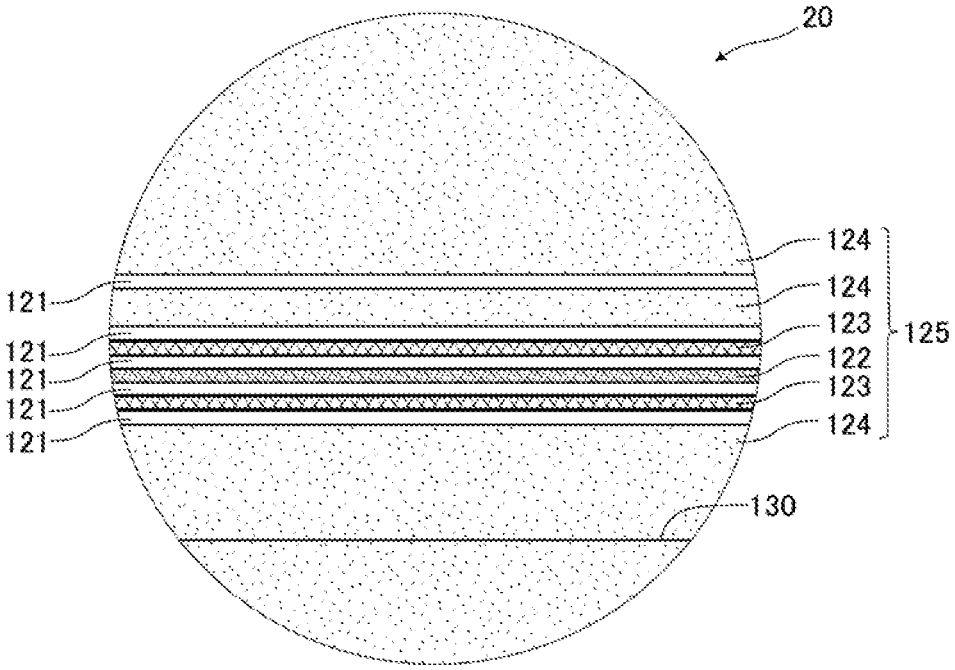
FIG. 27 is a front view of a projection lens according to a third embodiment of the present invention.

FIG. 27 is a front view of the projection lens 20 of the present embodiment. As shown in FIG. 27, the projection lens 20 has a plurality of band-shaped first regions 121 in which no unevenness is formed. Furthermore, the regions sandwiching the respective first regions 121 are uneven regions 125 in which a plurality of uneven portions are formed. The projection lens 20 of the present embodiment has the first region 121 and the uneven region 125 on the emission surface.

The uneven region 125 of the present embodiment has a second region 122, a third region 123 in which unevenness smaller than the second region 122 is formed, and a fourth region 124 in which unevenness smaller than the third region 123 is formed. The second region 122 and the third region 123 of the present embodiment are formed at positions sandwiched by the plurality of first regions 121, and are formed so as to be adjacent to each other with the first region 121 sandwiched therebetween. On the other hand, the fourth region 124 is formed at a position where a part thereof is sandwiched by the plurality of first regions 121 and another part is not sandwiched between the first regions 121. As described above, the end portion in the up and down direction of the emission surface of the projection lens 20 of the present embodiment has smaller unevenness than the center in the up and down direction of the emission surface of the projection lens 20.

The height of the unevenness of the second region 122 is, for example, about 7 μm, the height of the unevenness of the third region 123 is, for example, about 5 μm, and the height of the unevenness of the fourth region 124 is, for example, about 2 μm to 3 μm. Note that the height of the unevenness here means a half size of the distance between a line connecting the highest points of a plurality of protrusion parts and a line connecting the lowest points of recesses between the plurality of protrusion parts in a cross section through the highest points and the lowest points of the unevenness.

As described above, the uneven region 125 includes a plurality of regions having different sizes of unevenness to be formed, and the average surface roughness of the uneven region 125 sandwiched between the plurality of first regions 121 and the average surface roughness of the uneven region 125 not sandwiched between the plurality of first regions 121. The average surface roughness of the uneven region 125 sandwiched by the plurality of first regions 121 of the present embodiment is larger than the average surface roughness of the uneven region 125 not sandwiched by the plurality of first regions 121.

Furthermore, the first region 121 of the present embodiment is formed parallel to the horizontal surface. Accordingly, the second region 122, the third region 123, and the fourth region 124 sandwiched by the plurality of first regions 121 are also formed parallel to the horizontal surface. Moreover, the first region 121 or the uneven region 125 sandwiched by the plurality of first regions 121 of the present embodiment is formed at a position where the optical axis of the projection lens 20 passes. That is, the first region 121 or the uneven region 125 sandwiched by the plurality of first regions 121 of the present embodiment is formed near the center of the projection lens 20. The region sandwiched by the first region 121 formed at the uppermost position and the first region 121 arranged at the lowermost position overlaps with the shade 43 in the front view of the projection lens 20. Furthermore, the length in the up and down vertical direction of the region sandwiched by the first region 121 formed at the uppermost position and the first region 121 arranged at the lowermost position is, for example, about ⅕ to ½, preferably about ⅕ to ⅓ with respect to the length in the up and down direction of the projection lens 20. Furthermore, the first region 121 and the uneven region 125 of the present embodiment are formed from the left end to the right end of the projection lens 20. However, the uneven region 125 may not be formed at the left end or the right end of the projection lens 20.

Furthermore, the first region 121 is preferably formed in a region through which light forming the cut line of the low beam mainly passes. It is preferable that the second region 122 and the third region 123 are formed in the region through which the light forming the upper end of the light distribution pattern of the first light from the first light emitting element 55, and the light forming the lower end of the light distribution pattern of the second light from the second light emitting element 63 mainly pass. It is preferable that the fourth region 124 is formed in a region other than the first region 121, the second region 122 and the third region 123, diffuses the first light from the first light emitting element 55 as a whole, and suppresses glare during low beam lighting.

Furthermore, focusing on the uneven region 125 excluding the first region 121, the unevenness is formed so as to become gradually smaller as it goes away from the second region 122 having the largest unevenness. That is, the second region 122 is adjacent to the third region 123 in which the unevenness is smaller than that in the second region 122 via the first region 121 in the up and down direction, and the third region 123 is adjacent to the fourth region 124 in which the unevenness is smaller than that in the third region 123, via the first region 121, on the side opposite to the second region 122 side.

Furthermore, the projection lens 20 of the present embodiment has the refraction part 130 that refracts a part of the incident light so as to be light for overhead sign. The refraction part 130 of the present embodiment is formed on the incident surface of the projection lens 20.

Figure 28:
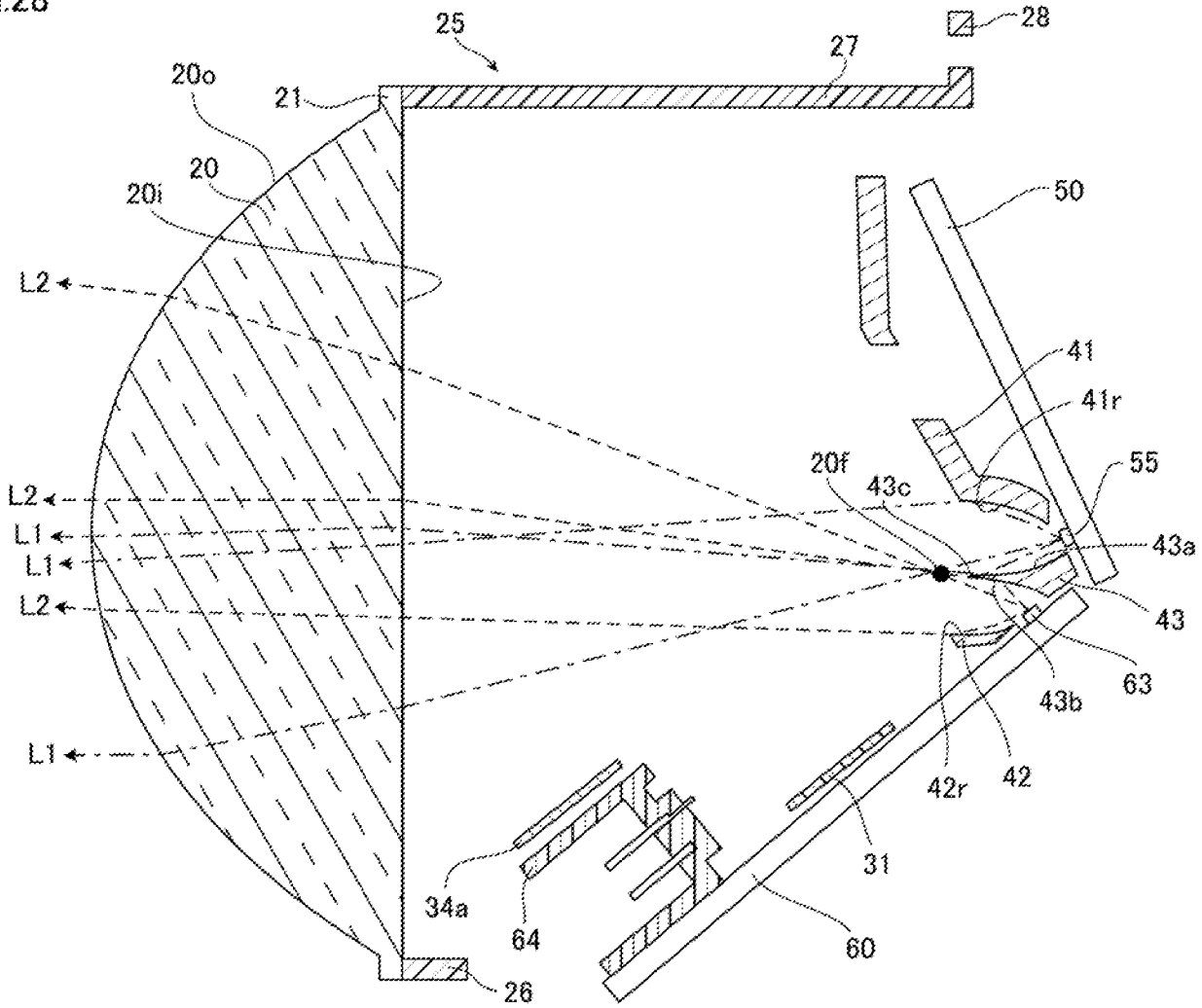
FIG. 28 is a view showing a lamp unit according to the third embodiment of the present invention from the same viewpoint as FIG. 21.

FIG. 28 is a view showing a lamp unit according to the third embodiment of the present invention from the same viewpoint as FIG. 21. As shown in FIG. 28, part of the first light L1 emitted from the first light emitting element 55 is directly incident on the incident surface 20*i* of the projection lens 20 and is emitted from the emission surface 20*o*. It is preferable that the first light L1 passes near the focus 20*f* of the projection lens 20.

Furthermore, part of the second light L2 emitted from the second light emitting element 63 is directly incident on the incident surface 20*i* of the projection lens 20 and is emitted from the emission surface 20*o*. It is preferable that the second light L2 passes near the focus 20*f* of the projection lens 20. Since the fourth reflection surface 42*r* of the reflector 42 is formed so as to cover the lower side of the second light emitting element, the fourth reflection surface 42*r* can reflect another part of the second light L2 toward the connector 64 and the like to the projection lens 20 side. The fourth reflection surface 42*r* of the present embodiment reflects another part of the second light L2 such that the another part of the second light L2 passes through a region other than the first region 121 and the uneven region 125 sandwiched between the plurality of first regions 121. Furthermore, the fourth reflection surface 42*r* of the present embodiment reflects another part of the second light L2 such that the another part of the second light L2 is incident on a region different from the incident region of part of light that is directly incident on the projection lens 20 among pieces of the second light L2. Moreover, the fourth reflection surface 42*r* of the present embodiment reflects the another part of the second light L2 so as to be incident on the region other than the refraction part 130.

By the way, the vehicular lamp disclosed in Patent Literature 1 further includes a projection lens through which the light emitted from the first light source and reflected by the first reflector, and the light emitted from the second light source and reflected by the second reflector pass, and a shade that shields part of light emitted from the first light source and reflected by the first reflector. In this vehicular lamp, the shade shields part of the light emitted from the first light source to form the cut line of the light distribution pattern of the low beam. Furthermore, the projection lens has a first lens part on which light from the first light source incident, and a second lens part formed below the first lens part and is from the second light source, and the rear focus of the first lens part and the rear focus of the second lens part are displaced in the up and down direction. Therefore, when a light distribution pattern is formed using two light sources arranged in the up and down direction via the shade, part of the light is shielded by the shade, and a dark portion occurs at the boundary between a light distribution pattern of light emitted from one light source and a light distribution pattern of light emitted from another light source, in some cases. In the vehicular lamp disclosed in Patent Literature 1, the rear focus of the second lens part on which the light emitted from the second light source is incident is located below the shade. Therefore, the light emitted from the second light source is less likely to be shielded by the shade, and a dark portion in the light distribution pattern may be suppressed.

However, the vehicular lamp disclosed in the Patent Literature 1 described above requires a first reflector provided so as to greatly extend forward so as to cover the first light source in order to allow the light emitted upward from the first light source to be incident on the projection lens. Furthermore, the vehicular lamp disclosed in the Patent Literature 1 described above also requires a second reflector provided so as to greatly extend forward so as to cover the second light source in order to allow the light emitted downward from the second light source to be incident on the projection lens. As described above, when the first reflector and the second reflector are increased in size, the vehicular lamp tends to be increased in size.

On the other hand, the vehicular headlight 1 of the third embodiment includes the first light emitting element 55, the second light emitting element 63, the shade 43, and the projection lens 20. Furthermore, the emission surface 20*o* of the projection lens 20 has a plurality of band-shaped first regions 121 in which no unevenness is formed, and the region sandwiching each of the first regions 121 is an uneven region 125 in which a plurality of uneven portions are formed. Moreover, the average surface roughness of the uneven region 125 sandwiched by the plurality of first regions 121 and the average surface roughness of the uneven region 125 not sandwiched by the plurality of first regions 121 are different from each other.

In the vehicular headlight 1 of the present embodiment as described above, part of the first light L1 and part of the second light L2 directly pass through the projection lens 20. That is, the part of the first light L1 and the part of the second light L2 are incident on the projection lens 20 without being reflected, and pass through the projection lens 20. As described above, since the first light emitting element 55 and the second light emitting element 63 are arranged such that the part of the first light L1 and the part of the second light L2 are directly incident on the projection lens 20, the vehicular headlight 1 of the present embodiment does not require a large reflector such as one disclosed in Patent Literature 1 described above. Therefore, upsizing of the vehicular headlight 1 of the present embodiment may be suppressed.

By the way, as described above, when the light distribution pattern is formed by using the two light sources arranged in the up and down direction through the shade, part of the light is shielded by the shade to form a dark portion in the light distribution pattern, in some cases. Here, if light emitted from the projection lens 20 is diffused by forming a plurality of uneven portions on the entire front surface or back surface of the projection lens 20, the boundary between the light distribution pattern formed by the first light L1 and the light distribution pattern formed by the second light L2 is unclear. Accordingly, formation of the dark portion in the light distribution pattern by the first light L1 and the second light L2 may be suppressed. However, the cut line of the low beam tends to become unclear when the first light L1 is diffused. As described above, there is a trade-off relationship between the clarification of the cut line of the low beam by the first light L1 and the suppression of the dark portion in the light distribution pattern by the first light L1 and the second light L2.

The projection lens 20 of the present embodiment has a plurality of band-shaped first region 121 in which no unevenness is formed and a plurality of uneven regions 125 in which an unevenness is formed. Diffusion of the first light L1 transmitted through the first region 121 is suppressed, which may contribute to clarifying the cut line of the low beam. On the other hand, the light transmitted through the uneven region 125 can be diffused and obscure the boundary between the light distribution pattern of the first light L1 and the light distribution pattern of the second light L2 to suppress the formation of the dark portion. Therefore, the vehicular headlight 1 of the present embodiment may suppress the formation of the dark portion in the light distribution pattern while clarifying the cut line of the low beam. As described above, the vehicular headlight 1 of the present embodiment may suppress the formation of the dark portion in the light distribution pattern while suppressing the increase in size.

Furthermore, when no unevenness is formed in the entire front and back surfaces of the projection lens 20, in addition to the dark portion as described above, brightness irregularity by the light directly incident on the projection lens from the light source and the light reflected by other members and incident on the projection lens 20 tends to be noticeable. Furthermore, when a plurality of light sources are provided, brightness irregularity by the interval between the light sources also tends to be noticeable. The average surface roughnesses of the uneven region 125 sandwiched by the plurality of first regions 121 and the uneven region 125 not sandwiched by the plurality of first regions 121 are made different, so that it is easy to adjust the degree of blurring of the light emitted from the projection lens 20 by blurring the light passing through the region close to the first region 121 is blurred and projected, and brightness irregularity can be suppressed.

Further, the first region 121 or the uneven region 125 sandwiched by the plurality of first regions 121 is formed at a position where the optical axis of the projection lens 20 passes. In the vehicular headlight 1 of the present embodiment, the first light L1 emitted from the first light emitting element 55 and the second light L2 emitted from the second light emitting element 63 are incident on the entire projection lens 20 and transmitted therethrough. However, the luminous intensities of the first light L1 and the second light L2 in the projection lens 20 are not constant and tend to increase in the vicinity of the optical axis. By forming the first region 121 or the uneven region 125 sandwiched by the plurality of first regions 121 at a position where the optical axis of the projection lens 20 passes, the first region 121 and the uneven region 125 sandwiched by the plurality of first regions 121 may be formed at a position through which high-luminance light passes. That is, the first region 121 may be formed at a position through which high-luminance light among pieces of light forming the cut line of the low beam easily passes. Accordingly, diffusion of light forming the cut line of the low beam can be further suppressed, and the cut line of the low beam can be made clearer. Furthermore, the uneven region 125 sandwiched by the plurality of first regions 121 may be formed at a position through which high-luminance light among pieces of second light L2 passes. Accordingly, the second light L2 may be diffused more, and formation of the dark portion in the light distribution pattern by the first light L1 and the second light L2 may be further suppressed.

Furthermore, the average surface roughness of the uneven region 125 sandwiched by the plurality of first regions 121 of the present embodiment is larger than the average surface roughness of the uneven region 125 not sandwiched by the plurality of first regions 121. In the first region 121, while the low beam cut line may contribute to more clarification, by clarifying the cut line, the boundary between the light distribution pattern of the first light L1 and the light distribution pattern of the second light L2 may be clarified, which may contribute to the formation of a dark portion in the light distribution pattern by the first light L1 and the second light L2. By increasing the average surface roughness of the uneven region 125 sandwiched by the plurality of first regions 121, that is, the uneven region 125 near the plurality of first regions 121, the second light L2 transmitted through near the plurality of first regions 121 is easily diffused, which may further suppress formation of a dark portion in the light distribution pattern of the first light L1 and the second light L2.

Furthermore, the uneven region 125 of the projection lens 20 of the present embodiment has the second region 122 and the third region 123 in which an unevenness smaller than that in the second region 122 is formed. By forming a region in which the degree of diffusion of light is relatively large and a region in which the degree of diffusion of light is relatively small on the projection lens 20, the gradation of the brightness of light due to the degree of diffusion of light may be prevented from being conspicuous.

Furthermore, the second region 122 and the third region 123 of the projection lens 20 of the present embodiment are adjacent to each other with the first region 121 interposed therebetween. Since the second region 122 and the third region 123 are adjacent to each other with the first region 121 interposed therebetween, the gradation of brightness of the light whose diffusion is suppressed by transmitting through the first region 121 and the light diffused by transmitting through the uneven region 125 may be prevented from being conspicuous.

Furthermore, the plurality of first region 121 of the projection lens 20 of the present embodiment are formed parallel to the horizontal surface. By forming the plurality of first regions 121 in parallel with the horizontal surface, the plurality of first regions 121 and the uneven region 125 sandwiched by the plurality of first regions 121 may be formed easily.

Furthermore, the uneven region 125 of the projection lens 20 of the present embodiment is formed on the front surface of the projection lens 20. When light is diffused on the back surface of the projection lens 20, that is, the incident surface 20*i*, the diffused light is refracted and emitted on the front surface of the projection lens 20, that is, the emission surface 20*o*. Therefore, the diffusion of light on the emission surface 20*o* of the projection lens 20 may be easier to adjust the degree of diffusion of light than on the incident surface 20*i* of the projection lens 20.

Furthermore, the vehicular headlight 1 of the present embodiment covers the lower side of the second light emitting element 63, and includes the fourth reflection surface 42*r* that is a reflection surface that reflects another part of the second light L2 such that the another part of the second light L2 is incident on the projection lens 20. By making another part of the second light L2 incident on the projection lens 20, the second light L2 can be effectively used.

Furthermore, the fourth reflection surface 42*r* of the present embodiment reflects another part of the second light L2 such that the another part of the second light L2 passes through a region other than the first region 121 and the uneven region 125 sandwiched between the plurality of first regions 121. As described above, the first region 121 and the uneven region 125 sandwiched by the plurality of first regions 121 may contribute to clarifying the cut line of the low beam and suppressing the formation of a dark portion in the light distribution pattern. Since the another part of the second light L2 transmits through a region other than these regions, clarifying the cut line of the low beam and suppressing the formation of a dark portion in the light distribution pattern may be prevented from being disturbed.

Furthermore, the fourth reflection surface 42*r* of the present embodiment reflects another part of the second light L2 such that the another part of the second light L2 is incident on a region different from the region on which a part of the second light L2 is directly incident. The irradiation range of the second light L2 may be widened by causing the another part of the second light L2 to be incident on a region different from the region where the part of the second light L2 is directly incident. For example, when the curvature of the projection lens 20 is controlled so that part of the second light L2 is emitted downward in order to reduce the dark portion of the boundary between the light distribution pattern of the second light L2 and the light distribution pattern of the first light L1, the light applied to above the light distribution pattern of the second light L2 is weakened in some cases. Here, since the another part of the second light L2 is incident on a region different from the region on which the part of the second light L2 is directly incident, the another part of the second light L2 may be emitted in a different direction from that of the part of the second light L2. As a result, by emitting the another part of the second light L2 above the part of the second light L2, it is possible to supplement the light emitted above the light distribution pattern of the second light L2.

Furthermore, the projection lens 20 of the present embodiment has the refraction part 130 that refracts part of the incident light so as to be light for overhead sign, and the fourth reflection surface 42*r* of the present embodiment reflects another part of the second light L2 so as to be incident on the region other than the refraction part 130. By suppressing unintended light from being incident on the refraction part 130 for overhead sign, the light for overhead sign may be prevented from being emitted in an unintended direction.

Fourth Embodiment

Next, a fourth aspect of the present invention will be described in detail by taking a vehicular headlight according to a third embodiment as an example. Note that the same or equivalent constituent elements as those of the first, second and third embodiments are denoted by the same reference numerals, and redundant explanation will be omitted except when particularly described.

Figure 29:
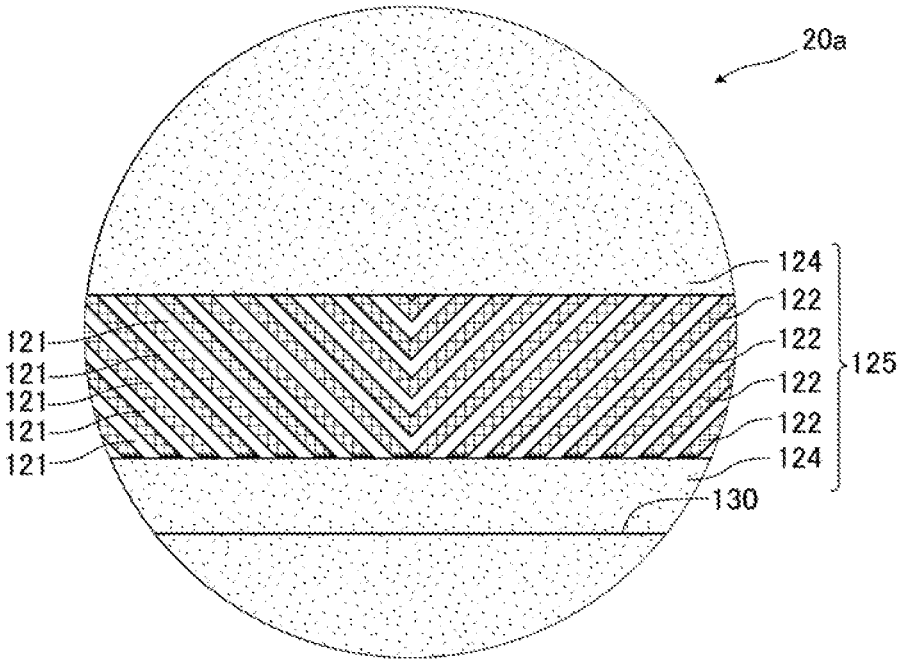
FIG. 29 is a view showing a projection lens according to a fourth embodiment of the present invention from the same viewpoint as FIG. 27.

FIG. 29 is a view showing a projection lens of the vehicular headlight according to the fourth embodiment from the same viewpoint as FIG. 27.

The projection lens 20*a* of the present embodiment is similar to the projection lens 20 of the third embodiment, except that the formation patterns of the first region 121 and the uneven region 125 formed on the front surface are different.

As shown in FIG. 29, the front surface of the projection lens 20*a* of the present embodiment has a plurality of first regions 121 formed on a line inclined with respect to the horizontal surface. More specifically, the front surface of the projection lens 20*a* of the present embodiment has a plurality of first regions 121 formed in a V-shape in a front view.

When the first region 121 is formed in parallel with the contour of the emission surface of the light source, the difference in brightness with the contours of the emission surface of the light source as a boundary tends to be less likely to be blurred. By the way, an LED chip having a rectangular emission surface is used as a light source of the vehicular headlight 1 of the present embodiment. In a case where such a light source having a rectangular emission surface is used, when the first region 121 is formed on a line inclined to the horizontal surface, in the front view of the projection lens 20, the extending direction of the first region 121 and the contour of the emission surface of the light source are easy to be made non-parallel to each other. Accordingly, the brightness difference with the contour of the emission surface of the light source as a boundary may be easily blurred. Furthermore, by forming the first region 121 in a V-shape, it may be easier to make the extending direction of the first region 121 and the contour of the emission surface of the light source non-parallel in the front view of the projection lens 20. Accordingly, the brightness difference with the contour of the emission surface of the light source as a boundary may be more easily blurred.

Note that FIG. 29 illustrates an example in which the entire uneven region 125 sandwiched by the plurality of first regions 121 is the second regions 122, but at least a part of the second region 122 may be the third regions 123. For example, in the uneven region 125 sandwiched between the plurality of first regions 121, the vicinity of the center in the right and left direction may be the second region 122, and in the uneven region 125 sandwiched between the first regions 121, the outside of the second region 122 in the right and left direction may be the third region 123. As described above, by making the average surface roughness of the uneven region 125 near the center of the projection lens 20*a* relatively larger than the average surface roughness of the other uneven regions 125, the high-luminance light transmitted through the projection lens 20*a* is easy to be diffused. Therefore, formation of a dark portion in the light distribution pattern by the first light L1 and the second light L2 may be further suppressed.

Although the third aspect of the present invention has been described above with the third and fourth embodiments as an example, the third aspect is not limited to these.

For example, the shapes of the first region 121 and the uneven region 125 sandwiched between the plurality of first regions 121 are not limited to the examples shown in the third and fourth embodiments.

Figure 30:
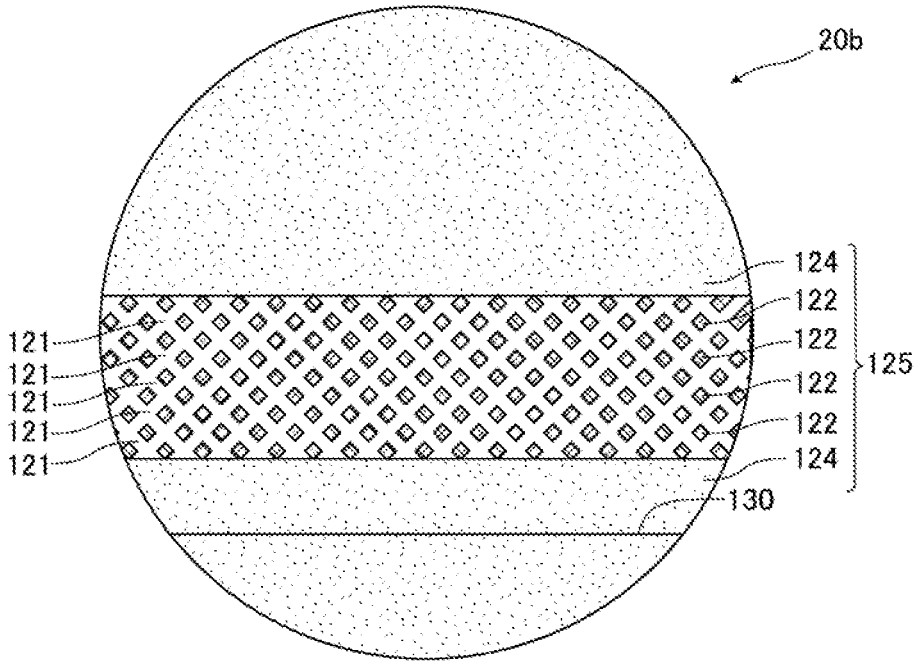
FIG. 30 is a view showing a projection lens according to a modification example from the same viewpoint as FIG. 27.

FIG. 30 is a view showing a projection lens according to a modification example from the same viewpoint as FIG. 27. As shown in FIG. 30, the projection lens 20*b* of the present modification example has a plurality of first regions 121 formed in a grid pattern. It can be considered that the first regions 121 of the present modification example are integrated by forming a plurality of first regions 121 extending in mutually different directions in a grid shape. Furthermore, the second region 122 is formed in each of the regions surrounded by the grid-patterned first regions 121. Note that, in the projection lens 20*b* of the present modification example, a part of the second region 122 may be the third region 123, as similar to the second embodiment.

Furthermore, although not particularly shown in the drawings, the plurality of first regions 121 are formed in a concentric circle shape, a zigzag shape, a wavy line shape, or the like, and the second region 122 and the third region 123 may be formed in a region sandwiched between the plurality of first regions 121.

Furthermore, in the description of the third and fourth embodiments, an example has been described in which a plurality of first regions 121 are formed left-right symmetrically, but the present invention is not limited to these forms, and the plurality of first regions 121 may be formed asymmetrically.

Furthermore, in the description of the third and fourth embodiments, an example has been described in which the uneven region 125 sandwiched between the plurality of first regions 121 is composed of only the second region 122, the second region 122 and the third region 123, or the second region 122, the third region 123 and the fourth region, the uneven region 125 sandwiched between the first regions 121 may include more regions having different sizes of unevennesses.

Furthermore, in the description of the third and fourth embodiments, an example has been described in which the uneven region 125 is formed on the emission surface 20*o* of the projection lens 20, but the uneven region 125 may be formed on the incident surface 20*i* of the projection lens 20.

As described above, according to the third aspect of the invention, there is provided a vehicular headlight capable of suppressing formation of a dark portion in a light distribution pattern while upsizing is prevented, and the vehicular headlight is available in a field of a headlight for vehicle such as an automobile.

REFERENCE SIGNS LIST

1 . . . vehicular headlight
3 . . . lamp unit
20 . . . projection lens
20*f* . . . focus
20*i* . . . incident surface
20*o* . . . emission surface
25 . . . lens holder
30 . . . support plate
40 . . . reflector unit
42*r* . . . fourth reflection surface
43 . . . shade
43*a* . . . first reflection surface
43*as* . . . protrusion part
43*c* . . . front end
43*cs* . . . step
43*d* . . . rear end
43*ds* . . . step
50 . . . first substrate
55 . . . first light emitting element
60 . . . second substrate
63 . . . second light emitting element
70 . . . flexible printed circuit board
80 . . . heat sink
81 . . . fan
121 . . . first region
122 . . . second region
123 . . . third region
124 . . . fourth region
125 . . . uneven region
130 . . . refraction part
L1 . . . first light
N1 . . . normal line of emission surface of first light emitting element
L2 . . . second light
N2 . . . normal line of emission surface of second light emitting element

The invention claimed is:

1. A vehicular headlight comprising:

a first light emitting element that emits a first light serving as a low beam, and has an emission surface of the first light whose normal line is directed obliquely downward to a front;

a second light emitting element that is arranged below the first light emitting element, emits a second light, and has an emission surface of the second light whose normal line is directed obliquely upward to the front;

a shade that extends forward from between the first light emitting element and the second light emitting element; and a projection lens that is arranged forward from the shade, and through which part of the first light and part of the second light directly pass, wherein an upper surface of the shade has a first reflection surface that reflects another part of the first light so that the another part of the first light passes through the projection lens, and a lower surface of the shade has a second reflection surface that reflects another part of the second light so that the another part of the second light passes through the projection lens, and a front end of the shade has a step in an up and down direction corresponding to a shape of a cut line of a light distribution pattern of the low beam.

2. The vehicular headlight according to claim 1, wherein a plurality of the first light emitting element are provided in parallel in a right and left direction, and the plurality of first light emitting elements arranged in one side of the right and left direction with reference to a specific one of the first light emitting elements and a plurality of the first light emitting elements arranged in another side have different heights at which they are provided.

3. The vehicular headlight according to claim 2, wherein an average interval between the specific first light emitting element and a pair of first light emitting elements arranged to sandwich the specific first light emitting element is narrower than an average interval of another plurality of first light emitting elements adjacent to each other.

4. The vehicular headlight according to claim 2, wherein, in a front view, the specific first light emitting element and the step of the front end of the shade overlap with each other in the up and down direction, a plurality of the first light emitting element arranged in one side of the right and left direction with reference to the specific first light emitting element is provided at a position lower than a plurality of the first light emitting element arranged in another side, and one side of the right and left direction of the front end of the shade is formed lower than another side with reference to the step.

5. The vehicular headlight according to claim 1, wherein a rear end of the first reflection surface has a step corresponding to the shape of the cut line of the light distribution pattern of the low beam.

6. The vehicular headlight according to claim 5, wherein, in a front view, the step of the front end of the shade and the step of the rear end of the first reflection surface overlap each other in the up and down direction.

* * * * *